US011504824B2

(12) United States Patent
Keiser et al.

(10) Patent No.: US 11,504,824 B2
(45) Date of Patent: Nov. 22, 2022

(54) ROTARY BRUSH AND ROTARY BRUSH WIRE CONFIGURATIONS

(71) Applicant: Osborn, LLC, Richmond, IN (US)

(72) Inventors: Brian Keiser, Cambridge City, IN (US); Brad Vanwinkle, Richmond, IN (US); Zachary Baumgardner, Lynn, IN (US); Zachary Small, Richmond, IN (US); Shane Clifford, Glenwood, IN (US)

(73) Assignee: OSBORN, LLC, Richmond, IN (US)

( * ) Notice: Subject to any disclaimer, the term of this patent is extended or adjusted under 35 U.S.C. 154(b) by 388 days.

(21) Appl. No.: 16/735,689

(22) Filed: Jan. 6, 2020

(65) Prior Publication Data

US 2020/0138179 A1 May 7, 2020
US 2020/0260855 A9 Aug. 20, 2020

Related U.S. Application Data

(63) Continuation-in-part of application No. 16/477,064, filed as application No. PCT/US2018/036166 on Jun. 5, 2018.

(Continued)

(51) Int. Cl.
*A46B 9/02* (2006.01)
*B24D 13/10* (2006.01)

(Continued)

(52) U.S. Cl.
CPC ..... *B24D 13/10* (2013.01); *A46B 7/08* (2013.01); *A46B 9/028* (2013.01); *A46B 9/06* (2013.01);

(Continued)

(58) Field of Classification Search
CPC ..... B24D 13/10; A46B 7/08; A46B 9/028; A46B 9/06; A46B 13/008; A46B 2200/3093
See application file for complete search history.

(56) References Cited

U.S. PATENT DOCUMENTS 2,866,989 A 1/1959 Peterson et al.
5,406,669 A 4/1995 Lesiw (Continued)

FOREIGN PATENT DOCUMENTS

EP 1356748 A1 * 10/2003 ..... A46B 13/008
EP 1356748 A1 10/2003

(Continued)

OTHER PUBLICATIONS

Supplemental European Search Report dated Jun. 22, 2022; European Patent Application No. 19882386.6 filed Nov. 5, 2018.

*Primary Examiner* — Shay Karls
(74) *Attorney, Agent, or Firm* — McDonald Hopkins LLC

(57) ABSTRACT

A rotary wire brush, such as a wheel brush, e.g., double-stringer or dually brush, cup brush, bevel brush, or knotted end brush, composed of knotted brush wire tufts of multistrand construction each having at least a plurality of brush wire strands, preferably at least a plurality of pairs of, i.e., at least three, strands each formed of at least a plurality, preferably at least a plurality of pairs of, i.e., at least three, wires. The wires forming strands are twisted, braided, or twisted and braided, and the strands that form tufts are twisted, braided, or twisted and braided. A preferred brush employs a center disc, e.g., hub, with radially offset tuft anchor holes, which can have different sizes, from which twist knot tufts, which also can have different sizes, can outwardly extend from the disc different distances by being configured with an offset trim preferably having different trim lengths.

21 Claims, 30 Drawing Sheets

Related U.S. Application Data

(60) Provisional application No. 62/756,073, filed on Nov. 5, 2018, provisional application No. 62/515,122, filed on Jun. 5, 2017.

(51) Int. Cl.

| | |
|---|---|
| ***B24D 13/20*** | (2006.01) |
| ***A46B 7/08*** | (2006.01) |
| ***A46B 9/06*** | (2006.01) |
| ***A46B 13/00*** | (2006.01) |
| *B24B 29/00* | (2006.01) |

(52) U.S. Cl.
CPC ..... *A46B 13/008* (2013.01); *B24D 13/20* (2013.01); *A46B 2200/3093* (2013.01); *B24B 29/005* (2013.01)

(56) References Cited

U.S. PATENT DOCUMENTS

| | | | |
|---|---|---|---|
| 5,926,904 | A | 7/1999 | Warner |
| 6,035,482 | A | 3/2000 | Belanger et al. |
| 6,217,431 | B1 | 4/2001 | Brinkmann |
| 2002/0132572 | A1 | 9/2002 | Lageson |
| 2011/0092144 | A1 | 4/2011 | Woods et al. |
| 2017/0304997 | A1 | 10/2017 | Akashi et al. |

FOREIGN PATENT DOCUMENTS

| | | | |
|---|---|---|---|
| JP | S61241071 | | 10/1986 |
| JP | 1989033311 | | 7/1989 |
| JP | 07-028433 | | 5/1995 |
| JP | 1995266241 | A | 10/1995 |
| JP | H08317608 | | 11/1996 |
| JP | 2008206798 | | 9/2008 |
| JP | 2007062003 | | 10/2008 |
| JP | 2013141731 | | 7/2013 |
| KR | 10-0289514 | | 5/2001 |
| KR | 101605525 | | 3/2016 |

* cited by examiner

ROTARY BRUSH AND ROTARY BRUSH WIRE CONFIGURATIONS

CROSS REFERENCE

This application claims priority under 35 U.S.C. § 119(e) in U.S. Provisional Patent Application No. 62/756,073 filed Nov. 5, 2018 and is a continuation-in-part of U.S. patent application Ser. No. 16/477,064, filed 10 Jul. 2019, which is a national stage of PCT Application No. PCT/US2018/036166, filed Jun. 5, 2018, which claims priority under 35 U.S.C. § 119(e) in U.S. Provisional Patent Application No. 62/515,212 filed Jun. 5, 2017, the entire disclosures of each of which are hereby expressly incorporated herein by reference.

FIELD

The present invention is directed to rotary brushes used in abrasive material removal applications and/or surface finishing applications, and more particularly to wheel brushes, cup brushes, bevel brushes, and knotted end brushes made with improved brush wire tuft configurations of twisted and/or braided multiwire and/or multistrand construction.

BACKGROUND

There are many different types and sizes of rotary wire brushes used in many different types of abrasive material removal and surface finishing applications. One type of rotary brush is a wheel wire brush that is removably attached to a powered rotary tool, such as a grinder, e.g., angle grinder, straight grinder, die grinder or bench grinder, a hand drill, or even a drill press, which typically is used in more demanding abrasive material removal and surface finishing applications. Examples of some applications well suited for wheel brush use include: surface finishing to improve surface finish without altering product dimensions, edge blending to smooth, round or blend corners, cleaning in wet or dry applications to remove surface matter and particles, roughening to rough surfaces prior to bonding or painting to improve adhesion, removing flash, removing rust, removing paint, deburring, de-flashing, cleaning weld beads, part finishing, sharpening, edge radiusing, edge blending, skiving, cleaning, polishing, and buffing.

While there are a multitude of different wheel brushes presently available, whose choice is dependent on the type of abrasive material removal or surface finishing application, wheel brushes come in two main types: crimped wire wheel brushes and knotted wire wheel brushes. Crimped wire wheel brushes are formed of elongate wavy brush wires which are captured by teeth or holes of a retaining ring around which an annular channel or pair of cover plates or face plates are tightly crimped. The crimped brush wires are evenly distributed about the circumference of the brush making them suited for less demanding abrasive material removal and surface finishing applications, such as decorative finishing, paint removal, light duty surface cleaning, and polishing, where more uniform material removal or a higher level of surface finishing is desired.

Knotted wire wheel brushes are a type of power brush which employ elongate brush wire tufts typically each composed of wires each of larger, e.g., relatively large, diameter producing stiffer tufts that increases the rate of abrasive material removal enabling such wheel brushes to be used in more demanding applications typically requiring more aggressive material removal or a greater rate of abrasive material removal. Brushes can be made with wire tufts formed of wires made of many different types materials, including nonmetallic materials, such as Tampico, nylon, or polypropylene, metallic materials, such as nonferrous materials, like brass or bronze, e.g., phosphorous bronze, ferrous materials, like medium or high-carbon steel, e.g., heat-treated, high tensile strength high-carbon or cold-drawn high steel wires, and stainless steel, e.g., Type 302 stainless steel, Type 304 stainless steel or Type 316 stainless steel, and can even be of coated or encapsulated construction, such as where the wires or tufts are coated or encapsulated with a polymer, e.g., plastic, an elastomer, e.g., an elastomeric material, or another material. Brush wire material choice typically depends on the application for which the brush is to be used.

In knotted wire wheel brushes, elongate brush wire tufts extend radially outwardly from holes in a center hub or disc that is sandwiched between a pair of cover plates with each tuft anchored to the center hub or disc using one of many different types of knots. In a standard knot wire wheel brush, each wire tuft is formed of a bundle of elongate wires extending through a corresponding hole in the center hub and twisted around part of the hub radially outwardly of the hole forming a knot that anchors the tuft to the disc. In a standard knot brush, each tuft is attached to the center hub by a standard twisted knot with the wires of the tuft twisted about two-thirds the length of the tuft in a manner that produces a tuft having an outwardly flared end that provides a relatively large yet relatively flexible abrasive material removing face that engages the workpiece during brush use and operation. Such standard knot brushes are commonly used to deflash and clean motor mounts, clean foundry molds, perform weld preparation and post-weld cleaning, remove heavy surface contamination, clean piping and pipelines, and for deburring. A less aggressive variation of a standard knot wire wheel brush is a hurricane twist knot wire wheel brush made with tufts attached with hurricane twist knots that twist the wires of each tuft less tightly than a standard knot producing a more flexible tuft having an even wider outwardly flared end defining an even larger even more flexible abrasive material removing face that provides less aggressive abrasive material removal and produces a smoother surface finish.

Another type of more aggressive knotted wire wheel brush is a cable knot wire wheel brush that provides greater material removal, and which is well suited for applications requiring some cutting action. In a cable knot wire wheel brush, each brush wire tuft is formed of a group of wires that extend through a corresponding hole in the hub of the brush that are twisted along substantially their entire length anchoring the tuft to the hub. This produces a brush wire tuft that not only is narrower or smaller in diameter along its entire length than a standard twisted knot brush wire, but which also produces a narrower relatively tight and stiff tuft end that defines the abrasive face that contacts the workpiece that is relatively small. As a result, the smaller abrasive face formed at the end of each cable knot wire tuft of such a cable knot brush is tighter and stiffer producing more aggressive tufts which provides more aggressive material removal resulting in a greater rate of material removal during use. Cable knot wire wheels are commonly used for brushing stainless steel, brushing aluminum, brushing other metals, cleaning and deburring, scale and rust removal, stripping carbon deposits, weld spatter removal, and other more aggressive abrasive material removal and surface finishing applications.

An even more aggressive type of brush is a stringer bead knot wire wheel brush made with tufts of thicker and stiffer wire typically composed of carbon steel, stainless steel, or aluminum whose wire ends are cut to form sharp tips. In a stringer bead knot wire wheel brush, each brush wire tuft is formed of a bundle of relatively stiff wires attached by a knot to an apertured center disc that are twisted even more tightly along the entire length of the tuft than a cable knot brush. This produces tufts of wire that have an even tighter and stiffer tuft end than a cable knot brush forming a workpiece engaging face that is even narrower than a cable knot brush with the sharp wire tips of the abrasive face of the tuft engaging the workpiece during brush use. As a result, stringer bead knot brushes provide even more aggressive material removal with a higher level of cutting action that removes a narrower swath of material from the workpiece with a greater cutting action than that of a cable knot brush. Stringer bead knot brushes are well suited for use in cleaning or finishing small grooves and channels, cleaning welding junctions, cleaning pipe welds between passes, cleaning stringer bead welds, and other abrasive material and surface finishing applications where an aggressive cutting action is desired or required. Stringer bead knot wire wheels are commonly used to abrasively remove material from small channels and grooves and are typically used for preparing pipe prior to welding.

It has long been desired to develop rotary brushes that achieves the ever elusive goal of optimizing material removal as a function of brush wear to obtain a "goldilocks" brush that removes enough material rapidly enough during use to be effective in a wide variety of surface finishing applications, including some of the most demanding abrasive material removal applications, while lasting a sufficiently long time before wearing out. While countless attempts have been undertaken in the past to produce such "goldilocks" brushes, with many claiming to have done so, it is heretofore believed all have fallen short in one or more areas resulting in less than optimal performance that significantly limits the number of applications in which they can be used.

Past attempts failed because tradeoffs or compromises were made to increase material removal rates at the expense of brush life, or vice versa. Attempts to increase material removal rates were typically achieved with brushes having wire tufts made of thicker and stiffer wires that were usually composed of harder and more abrasive wire materials, which undesirably suffered from increased wear rates that reduced brush life. Attempts to increase brush life were typically achieved with brushes having wire tufts made of thinner and more flexible wires that were usually composed of softer and less abrasive wire material, which undesirably fell far short of desired material removal rates. Even when one of these brush attempts shows promise, they typically cannot achieve balanced material removal rates and brush life without limiting their use to a relatively narrow range of applications where one is less important than the other.

What is therefore needed is a rotary brush having a construction or configuration having both increased material removal rates and a longer useful operating life and which also is well suited for both surface finishing applications and more demanding abrasive material removal applications.

SUMMARY

The present invention is directed to a rotary wire brush, such as a wheel brush, cup brush, bevel brush, knotted end brush, or another type of rotary brush configured with one or more of an improved brush wire tuft configuration and/or improved center disc or hub configuration that results in increased material removal rates while still providing good surface finishing and long lift thereby producing a rotary brush of the present invention that optimizes at least these operational parameters. Such an improved rotary brush of the present invention is a power-driven, e.g., rotary power tool driven, twisted knot, twisted tuft, or twist knotted rotary brush of the type used in surface finishing and abrasive material removal applications, such as deburring, cleaning, descaling, polishing, blending, and texturizing, and which is configured in accordance with the present invention with a combination of brush tufts, knot sizes, trim lengths, and center disc or hub tuft mounting holes that can have different hole sizes that produces a rotary brush of the invention having a balanced blend of surface finishing and aggressive material removal without reducing brush life making such brushes of the present invention well suited for a wider variety of surface finishing and material removal applications.

A rotary brush of the present invention is constructed with a novel configuration of (a) alternating radially staggered or radially offset brush wire tuft mounting holes spaced circumferentially about the center disc or hub of the brush, (b) alternating radially staggered or radially offset brush wire tuft mounting holes with the radially outermost located holes being larger in size than the radially innermost located holes, (c) brush wire tufts having different trim lengths with the tufts having longer trim lengths being more flexible than stiffer brush wire tufts with shorter trim lengths such that the stiffer shorter trim length tufts provide greater aggressiveness and material removal than the more flexible longer trim length tufts that provide improved surface finishing, including by helping to polish the workpiece surface, (d) brush wire tufts having different length knots with the shorter-length tufts having a longer trim length configured with larger and/or longer knots that further increasing the stiffness of the longer trim length tufts for even more aggressive workpiece material removal further increasing workpiece material removal rates, (e) brush wire tufts of twisted, braided and/or woven wire tufts and/or tufts formed of twisted, braided and/or woven strands of wires producing brush wire tufts with increased resilience, stiffness, vibration absorption, wear resistance, aggressiveness, surface polishing, and operating life, and/or (f) brush wire tufts, including brush wire tufts having the aforementioned different trim lengths, configured with different combinations of twisted, braided and/or woven wire tufts and/or tufts formed of twisted, braided and/or woven strands of wires in a single rotary brush. A rotary brush of the invention constructed with at least a plurality of (a)-(f) possesses an advantageous combination of increased aggressiveness, improved surface finishing, and greater brush life not believed to have been heretofore achieved. The present invention encompasses and thereby also is directed to a rotary brush constructed and/or configurated with at least a plurality of (a)-(f), preferably at least a plurality of pairs, i.e., at least three, of (a)-(f), more preferably at least four of (a)-(f), and even more preferably all of (a)-(f), thereby producing a rotary brush in accordance with the invention that advantageously provides balanced surface finishing or polishing and aggressive material removal during surface finishing or abrasive treatment of a workpiece while still possessing a desirably long brush operating life.

In at least one preferred embodiment, the present invention is directed to a rotary brush having brush wire tuft anchoring holes circumferentially spaced apart about its central disc or hub and which are staggered by being offset relative to one another by being spaced different distances from a center of the disc or hub about which the brush rotates. Such a rotary brush advantageously employs twisted or knotted brush wire tufts having different trim lengths and stiffnesses with a preferred brush having (i) stiffer less flexible more aggressive wire tufts with shorter trim lengths that more aggressively remove material from the workpiece surface, (ii) more flexible wire tufts with a longer trim length that make earlier less aggressive contact with the workpiece than the stiffer shorter trim length tufts with the more flexible longer trim length tufts providing improved surface finish, including by polishing a portion of the workpiece surface previously immediately abraded by stiffer more aggressive shorter trim length tufts. In a preferred rotary brush embodiment, the radially outermost tuft mounting openings formed in the center hub or disc are larger in size than the radially innermost openings effectively increasing the flexibility of the more flexible longer trim length tufts improving surface finishing, e.g., polishing, of the workpiece during brush use.

The present invention can be and preferably is directed to a rotary brush constructed or configured in the form of a rotary radial wire brush of the type used for abrasive material removal in performing a surface treatment or surface finishing operation, such as a wire wheel brush, and which can be a power brush, which can be used in weld surface preparation, cleaning of finished welds, e.g., slag removal, rust removal, paint removal, deburring, and/or other types of abrasive material removal, abrasive surface treatment, and abrasive surface finishing applications. Depending on the type of surface to be treated, the amount of material which needs to be removed, the depth of which material can be abrasively removed, and other factors, such a rotary brush constructed in accordance with the present invention can also be used for other types of abrasive material removal applications, such as even some grinding applications, such as where a rotary grinding wheel might also be used. Such a rotary brush can be and preferably is electrically or pneumatically powered, such as by a rotary power tool that can be a grinder, such as an electrically or pneumatically powered angle grinder, e.g., right angle grinder, an electrically or pneumatically powered straight grinder, an an electrically or pneumatically powered die grinder, an electrically or pneumatically powered bench grinder, an electrically or pneumatically powered drill, an electrically or pneumatically powered drill press, or another type of electric or pneumatic powered rotary power tool.

In one preferred embodiment, the rotary brush is a rotary radial brush or wheel brush made with a central brush wire tuft mounting disc or hub having circumferentially spaced apart brush wire tuft mounting holes, preferably equiangularly circumferentially spaced apart, where the holes are radially staggered or radially offset with elongate brush wire tufts extending radially outwardly from the mounting holes and configured with different trim lengths. Mounting holes of the brush are radially staggered or radially offset different radial distances from a center of the disc or hub with brush wire tufts extending from the mounting holes having abrasive faces at their free ends radially spaced or radially offset different radial distances from the disc or hub center and from or relative to an outer peripheral edge of the disc or hub providing the brush with tufts of different trim lengths.

The mounting holes of the center disc or hub of the brush preferably are alternatingly radially staggered or alternatingly radially offset different radial distances from the center of the hub or disc with a first set of the brush wire tuft holes, e.g., innermost set of holes, which are spaced a first radial distance that is closer to the hub or disc center and a second set of the holes, e.g., outermost set of holes, which are spaced a second radial distance that is disposed radially outwardly of the first set of holes and radially spaced farther away from the hub or disc center than the first set of holes. In such a brush of the invention, the holes are alternating radially offset relative to one another such that the holes of the second set are radially outwardly offset relative to the holes of the first set. In one embodiment, the first set of mounting holes are circumferentially spaced apart equal distances from each other, e.g., equiangularly circumferentially spaced apart, and arranged with their centers or centerlines along a first circle spaced the first distance from the hub or disc center, and the second set of mounting holes are also circumferentially spaced apart equal distances from each other, e.g., equiangularly circumferentially spaced apart, and arranged with their centers or centerlines along a second circle spaced the second distance from the hub or disc center. The shape of the holes can be circular or oblong, such as by being oval or elliptical, e.g., an ellipse, in shape. In one embodiment, the mounting holes of one set are larger in size, e.g., larger in width or diameter, than the mounting holes of the other set with a preferred embodiment of the brush wire tuft mounting hub or disc having the mounting holes of the second set being larger in size, e.g., larger in width or diameter, than the mounting holes of the first set. The larger sized mounting holes of the second set are thereby advantageously configured to enable attachment of brush wire tufts that can be and preferably are thicker, wider, contain more wires, and/or which have a greater tuft diameter than the tufts extending from each one of the smaller sized mounting holes of the first set. The larger sized mounting holes of the second set can also impart greater flexibility to brush wire tufts extending from each larger sized mounting hole by the larger sized mounting hole allowing the brush wire tuft to more easily angular orient and/or angularly reorient itself relative to the hub or disc and/or the workpiece surface during rotary brush operation.

A wheel brush or rotary radial brush constructed in accordance with the present invention is configured with between 20 and 80 brush wire tuft anchoring or mounting holes, preferably between 22 and 78 tuft anchoring or mounting holes, and more preferably between 28 and 72 holes, each having a brush wire tuft that preferably is elongate extending from each one of the tuft anchoring or mounting holes. Preferred embodiments of rotary radial or wheel brushes of the invention are configured in different sizes, including four-inch diameter, five-inch diameter, and seven-inch diameter sized brushes configured with the same number of brush wire tufts as the number of holes formed in the center hub or disc of the brush. The shape of the holes can be circular or oblong such as by being oval or elliptical, e.g., an ellipse, in shape. The holes of the center hub or disc have a plurality of sets of holes arranged so they are alternatingly radially offset or staggered and can be configured such that one set of the holes is larger in size, e.g., longer, larger in width, or larger in diameter, than another set of the holes. The brush wire tufts preferably are knotted or twist knot tufts having at least a plurality of elongate metallic brush wires per tuft, and which can be composed of a plurality of elongate brush wire strands with each strand formed of at least a plurality of brush wires per strand. In a preferred embodiment, the metallic wires of each tuft or strand are made of stainless or carbon steel, depending on the application. In a preferred embodiment, each wire tuft is composed of between 20 and 40 stainless or carbon steel wires having wire diameters ranging between 0.008 inches and 0.035 inches. In one preferred embodiment, each wire tuft has between 20 and 40 stainless or carbon steel wires with a wire diameter of between 0.008 inches and 0.035 inches where the wires of each tuft is formed of at least a plurality of pairs, i.e., at least three, twisted strands, braided strands, or twisted and braided strands, with each strand composed of at least a plurality of pairs, i.e., at least three, of the wires.

A four-inch diameter size wheel brush or rotary radial brush of the invention has a center disc or hub with between 22 and 42 alternating radially offset or staggered tuft anchoring or mounting holes formed therein having a brush wire tuft extending radially outwardly from each one of the holes arranged with a plurality of different trim lengths providing a four-inch brush with between 22 and 42 radially offset holes and between 22 and 42 radially offset trim brush wire tufts. A preferred four-inch wheel or rotary radial brush is configured with between 28 and 34 holes with each hole having a brush wire tuft extending radially outwardly from it such that the brush has the same number of tufts as the number of holes. In a preferred embodiment, each tuft is composed of between 20 and 40 stainless or carbon steel wires having wire diameters of between 0.008 inches and 0.035 inches and each tuft can be formed of a plurality of pairs, i.e., at least three, of twisted strands, braided strands, or twisted and braided strands each composed of at least a plurality of pairs, i.e., at least three, of the wires. The shape of the holes can be circular or oblong such as by being oval or elliptical, e.g., an ellipse, in shape. The holes of the center hub or disc of the brush have a pair of sets of holes arranged so the holes of one set are alternatingly radially offset or radially staggered relative to the holes of the other set and can be configured such that the holes one of the sets of holes, preferably the radially outermost holes, are larger in size, e.g., longer, larger in width, and/or larger in diameter, than the holes of the other one of the sets of holes. Each brush preferably is configured with at least one, preferably at least a plurality, more preferably at least a plurality of pairs, i.e., at least three, of its brush wire tufts having an offset trim with a preferred brush embodiment configured with every other tuft having a trim length shorter than the trim length of an adjacent tuft. In a preferred brush embodiment, the alternatingly staggered brush wire tuft anchoring holes can impart or help impart corresponding alternating brush wire tufts with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

A five-inch diameter size wheel brush or rotary radial brush of the invention has between 25 and 65 alternating radially staggered or offset tuft mounting holes formed in its center hub or disc with a brush wire tuft extending radially from each hole with a preferred five-inch diameter brush having between 56 and 60 alternating radially staggered or offset holes and the same amount of tufts with a tuft extending radially from each hole. In one preferred five-inch brush, the brush has a center disc or hub configured with about 56 tuft mounting holes in an alternating radially staggered or offset arrangement forming a pair of sets of holes with one set of holes spaced the same distance away from but radially closer to a center of the disc or hub than the other one of the sets of holes with the brush having about 56 tufts as the brush has the same number of tufts as holes with a tuft extending radially from each one of the holes. In a preferred embodiment, each tuft is composed of between 20 and 40 stainless or carbon steel wires having wire diameters of between 0.008 inches and 0.035 inches and each tuft can be formed of a plurality of pairs, i.e., at least three, of twisted strands, braided strands, or twisted and braided strands each composed of at least a plurality of pairs, i.e., at least three, of the wires. The shape of the holes can be circular or oblong such as by being oval or elliptical, e.g., an ellipse, in shape. The holes of the center hub or disc of the brush have a pair of sets of holes arranged so the holes of one set are alternatingly radially offset or radially staggered relative to the holes of the other set and can be configured such that the holes of one of the sets of holes is larger in size, e.g., longer, larger in width, or larger in diameter, than the holes of the other one of the sets of holes. Each brush preferably is configured with at least one, preferably at least a plurality, more preferably at least a plurality of pairs, i.e., at least three, of its brush wire tufts having an offset trim with a preferred brush embodiment configured with every other tuft having a trim length shorter than the trim length of an adjacent tuft. In a preferred brush embodiment, the alternatingly staggered brush wire tuft anchoring holes can impart or help impart corresponding alternating brush wire tufts with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

A seven-inch diameter size wheel brush or rotary radial brush of the invention has between 45 and 65 alternating radially staggered or offset tuft mounting holes formed in its center hub or disc with a brush wire tuft extending radially from each hole with a preferred five-inch diameter brush having between 52 and 60 alternating radially staggered or offset holes and the same amount of tufts with a tuft extending radially from each hole. In one preferred seven-inch brush, the brush has a center disc or hub configured with about 56 tuft mounting holes in an alternating radially staggered or offset arrangement forming a pair of sets of holes with one set of holes spaced the same distance away from but radially closer to a center of the disc or hub than the other one of the sets of holes with the brush having about 56 tufts and having the same number of tufts as holes with a tuft extending radially from each one of the holes. In a preferred embodiment, each tuft is composed of between 20 and 40 stainless or carbon steel wires having wire diameters of between 0.008 inches and 0.035 inches and each tuft can be formed of a plurality of pairs, i.e., at least three, of twisted strands, braided strands, or twisted and braided strands each composed of at least a plurality of pairs, i.e., at least three, of the wires. The shape of the holes can be circular or oblong such as by being oval or elliptical, e.g., an ellipse, in shape. The holes of the center hub or disc of the brush have a pair of sets of holes arranged so the holes of one set are alternatingly radially offset or radially staggered relative to the holes of the other set and can be configured such that the holes of one of the sets of holes is larger in size, e.g., longer, larger in width, or larger in diameter, than the holes of the other one of the sets of holes. Each brush preferably is configured with at least one, preferably at least a plurality, more preferably at least a plurality of pairs, i.e., at least three, of its brush wire tufts having an offset trim with a preferred brush embodiment configured with every other tuft having a trim length shorter than the trim length of an adjacent tuft. In a preferred brush embodiment, the alternatingly staggered brush wire tuft anchoring holes can impart or help impart corresponding alternating brush wire tufts with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

Another preferred rotary brush constructed in accordance with the present invention is configured with one set of knotted brush wire tufts having a shorter offset trim and which are stiffer and more aggressive providing increased material removal rates than another set of knotted brush wire tufts having a longer offset trim and which are more flexible and less aggressive providing increased surface finishing, e.g., polishing. Such alternating stiffer more aggressive tufts and flexible less aggressive tufts work in concert to produce a rotary brush of the invention having balanced but relatively high material removal rates while producing a consistently good surface finish.

In another preferred rotary brush embodiment, each more flexible, less aggressive longer offset trim brush wire tuft is anchored in a corresponding radially outermost tuft mounting hole of the disc or hub using a standard twist knot with the twist of the wires of each longer offset trim tuft extending at least half the length of the tuft but, preferably no more than two-thirds the length of the tuft, and each shorter offset trim brush wire tuft is anchored in a corresponding radially innermost hole or disc using a cable twist knot with the twist of the wires of each shorter offset trim tuft extending the full length of the tuft to further increase tuft stiffness and aggressiveness. Where greater polishing action and/or less aggressiveness in material removal of the longer offset trim tufts is desired, the size of each radially outermost tuft mounting hole in the hub or disc is formed to be larger than the size of each radially innermost tuft mounting hole effectively increasing tuft flexibility by enabling the tufts to reorient themselves more easily relative to the disc or hub and/or the workpiece being abrasively treated by the rotary brush.

In still another preferred rotary brush embodiment, each more flexible, less aggressive, longer offset trim brush wire tuft is anchored in a corresponding radially outermost hole of the disc or hub using a standard twist knot with the twist of the wires of each longer tuft extending at least half the length of the tuft but preferably no more than two-thirds the length of the tuft, and each shorter brush wire tuft is anchored in a corresponding radially outermost hole or disc using a stringer bead twist knot with the twist of the wires of each shorter tuft extending the full length of the tuft. Where greater polishing action and/or less aggressiveness in material removal of the longer offset trim tufts is desired, the size of each radially outermost tuft mounting hole in the hub or disc is formed to be larger than the size of each radially innermost tuft mounting hole effectively increasing tuft flexibility by enabling the tufts to reorient themselves more easily relative to the disc or hub and/or the workpiece being abrasively treated by the rotary brush.

In a further preferred embodiment, each longer offset trim brush wire tuft is anchored in a corresponding radially innermost hole of the disc or hub using a cable twist knot with the twist of the wires of each longer tuft extending at least two-thirds the length of the tuft but preferably substantially the entire length of the tuft, and each stiffer shorter offset trim brush wire tuft is anchored in a corresponding radially outermost hole or disc using one of a cable twist knot or stringer bead twist knot with the twist of the wires of each shorter tuft extending the full length of the tuft. In such a preferred brush embodiment, the cable twist knot or stringer bead twist knot of each shorter offset trim length tuft has a radial length that is longer than the standard twist knot or cable twist knot of each longer offset trim length tuft thereby imparting greater stiffness, aggressiveness and a greater material removal rate to the shorter offset trim length tufts of the rotary brush.

Each one of these rotary brushes constructed in accordance with the present invention can be and preferably is configured such that each wire tuft having between 10 and 50 wires per tuft, preferably between 15 and 45 wires per tuft, and more preferably between 20 and 40 wires per tuft to help produce a rotary brush having balanced surface finishing, e.g., polishing, and aggressive material removal characteristics while still providing a long brush life. Each one of these rotary brushes is made with tufts having such numbers or ranges of numbers of stainless steel and/or carbon steel wires with each wire having a diameter ranging between 0.005 inches and 0.050 inches, preferably between 0.075 inches and 0.045 inches, and more preferably 0.012 inches and 0.035 inches. If desired, one or both the longer and shorter trim length brush wire tufts can be made of wires having more than one diameter, e.g., mixed diameters, falling within one of the aforementioned wire diameter ranges. In at least one embodiment of such a rotary brush of the present invention, one or both of the longer trim length tufts and/or shorter trim length tufts are made with wires having mixed diameters, e.g., having at least a plurality of different wire diameters, falling within at least one of the aforementioned wire diameter ranges. In at least one other embodiment of such a rotary brush of the present invention, one or both of the longer trim length tufts and/or shorter trim length tufts are made with wires having at least a plurality of pairs of, i.e., at least three, different wire diameters that fall within at least one of the aforementioned wire diameter ranges.

In another preferred embodiment of such a brush of the present invention, one or both of the longer and shorter tufts are made with wires having at least a plurality of pairs of, i.e., at least three, different wire diameters falling within at least one of the aforementioned wire diameter ranges. In one such preferred embodiment of a brush of the present invention, one or both of the longer and shorter tufts are made with wires having at least a plurality of, i.e., at least two, different wire diameters falling within a diameter range of between 0.012 inches and 0.035 inches. In one preferred embodiment of such a brush of the present invention, the brush is made with one or both of the long and short brush wire tufts composed of between 20 and 40 stainless or carbon steel wires per tuft having wire diameters ranging between 0.012 inches and 0.035 inches, including where the wires of the tufts are braided, twisted and/or woven together in forming the tuft. In another preferred embodiment of such a brush of the present invention, the brush is made with one or both of the long and short brush wire tufts composed of between 20 and 40 wires per tuft, with each such tuft having at least a plurality of different wire diameters ranging between 0.012 inches and 0.035 inches, including where the wires of the tufts are braided, twisted and/or woven together in forming the tuft. In a further preferred embodiment of such a brush of the present invention, the brush is made with one or both of the long and short brush wire tufts composed of between 20 and 40 wires per tuft, with each such tuft having at least a plurality of pairs of different wire diameters ranging between 0.012 inches and 0.035 inches, including where the wires of the tufts are braided, twisted and/or woven together in forming the tuft.

In another such preferred embodiment of a brush of the present invention, one or both of the longer and shorter tufts are made with wires having at least a plurality of pairs of, i.e., at least three, different wire diameters falling within a diameter range of between 0.012 inches and 0.035 inches. In one preferred embodiment of such a brush of the present invention, the brush is made with one or both of the long and short brush wire tufts composed of between 20 and 40 wires per tuft, with each tuft having wire diameters ranging between 0.012 inches and 0.035 inches, including where the wires of the tufts are braided, twisted and/or woven together in forming the tuft. In one preferred embodiment of such a brush of the present invention, the brush is made with one or both of the long and short brush wire tufts composed of between 20 and 40 wires per tuft, with each tuft composed of wires having at least a plurality of different wire diameters ranging between 0.012 inches and 0.035 inches, including where the wires of the tufts are braided, twisted and/or woven together in forming the tuft. In another preferred embodiment of such a brush of the present invention, the brush is made with one or both of the long and short brush wire tufts composed of between 20 and 40 wires per tuft, with each tuft composed of wires having at least a plurality of pairs of different wire diameters ranging between 0.12 inches and 0.35 inches, including where the wires of the tufts are braided, twisted and/or woven together in forming the tuft.

In one preferred embodiment of a brush constructed in accordance with the present invention, each shorter trim length brush wire tuft is composed of between twenty and forty wires with each wire of each shorter tuft having a diameter greater than each wire of each longer trim length tuft with the larger diameter wires of each shorter trim length tuft imparting greater stiffness as compared to each longer trim length tuft. In another preferred embodiment of a brush of the present invention, each longer length tuft is composed of between twenty and forty wires with each wire of each longer tuft having a diameter less than each wire of each shorter length tuft with the shorter diameter wires of each longer tuft imparting a greater sweeping action when engaging the surface of the workpiece thereby less aggressively abrasively treating, e.g., polishing, the workpiece surface. Such brushes of the present invention have shorter stiffer tufts that provide more aggressive abrasive material removal treatment and longer more flexible tufts that provide less aggressive surface finishing treatment of a workpiece being abrasively treated. In a preferred embodiment, brushes of the present invention are configured with shorter stiffer narrower tufts that provide more aggressive abrasive material removal treatment over a narrower treatment swath or footprint of the surface of the workpiece being abrasively treated, and longer more flexible wider tufts that provide less aggressive surface finishing treatment, e.g., polishing, over a wider treatment swath or footprint on the surface of the workpiece being abrasively.

In a further preferred embodiment of a such a brush of the present invention, each shorter tuft has a lesser number of wires than each longer tuft, with each wire of each shorter tuft having a diameter greater than each wire of each longer tuft thereby advantageously imparting greater stiffness to each shorter length tuft with the smaller diameter wires of each longer tuft providing a less aggressive sweeping action producing a brush of the present invention of hybrid abrasive material removal action. More specifically, such a brush of the present invention has shorter stiffer tufts that provide more aggressive abrasive material removal treatment and longer more flexible tufts that provide less aggressive surface finishing treatment of a workpiece being abrasively treated with the brush. In one such brush of the present invention, the brush has shorter stiffer narrower tufts that provide more aggressive abrasive material removal treatment over a narrower treatment swath or footprint of the surface of the workpiece, and longer more flexible wider tufts that provide less aggressive surface finishing treatment, e.g., polishing, over a wider treatment swath or footprint on the surface of the workpiece.

While prior art wire wheel or radial brushes have been made with a central disc or hub having (a) a 32 hole center-slot patterns, where the holes or slots are aligned circumferentially by being spaced the same radial distance from the center of the disc hub, and (b) a 30 hole offset-hole pattern having (i) one set of the holes aligned circumferentially and spaced a first radial distance from the center of the disc hub, and (ii) another set of the holes aligned circumferentially and spaced a second radial distance from the center of the disc hub radially outwardly offset from the first radial distance, it is believed that a radial brush having a central disc hub with a 32 hole offset-hole pattern has heretofore never been employed. As such, at least one preferred radial brush embodiment shown and disclosed herein has a 32-hole offset-hole pattern constructed in accordance with the present invention that unexpectedly achieved improved performance and extended life, producing a 32-hole offset-hole pattern radial brush of the present invention that removes a higher rate of material during surface finishing use for a longer period of time before requiring replacement. Such a preferred 32-hole offset-hole pattern radial brush constructed in accordance with the present invention unexpectedly and advantageously possesses an optimal combination of a higher rate of material removal and longer or extended radial brush life believed not heretofore seen in the prior art.

In addition, it also is believed that such a rotary radial brush made with a center disc hub of 32-hole offset hole configuration having an elongate brush wire tuft extending radially from each one of the 32 holes, where each tuft is formed of at least 22 wires per hole and preferably no more than about 34 wires per hole, with each wire having a diameter of between 0.012 inches and 0.035 inches, also has heretofore never been employed. Such a rotary radial brush of the present invention having a 32-hole offset hub with between 22 and 34 wires per hole with each wire having a diameter of between 0.012 and 0.035 inches advantageously possesses outstanding brush life and very good to excellent material removal characteristics producing a wire wheel or rotary radial brush of the present invention that preferably is of optimized construction well suited for an even wider variety of surface finishing and material removal applications than conventional brushes.

In one preferred embodiment, a 32-hole offset hole configuration rotary radial brush constructed in accordance with the present invention has elongate brush wire tufts each formed of at least 22 elongate brush wires each having a diameter of between 0.012 and 0.035 inches which are braided substantially along the length of each tuft, further improving brush life and/or abrasive material removal performance. In one such preferred embodiment, each one of the brush wire tufts is formed of no more than 34 wires and preferably is formed of no more than about 32 wires. Each wire preferably has a diameter of between 0.012 and 0.035 inches and can be composed of wires of mixed or different diameters falling within the diameter range of 0.012 and 0.035 inches as the shorter length brush wire tufts anchored by twist knots to the radially outermost holes will be stiffer, more aggressively remove material from the workpiece surface, and remove a greater amount of material from a narrower swatch, path or surface area of the workpiece, and the longer length brush wire tufts anchored by twist knots to the radially innermost holes will be more flexible and more broadly sweep over a wider swath, path or surface area of the workpiece during rotary brush use.

The length that the shorter trim length brush wire tufts extends radially beyond outer peripheral edge of the center disc or hub to which the tufts are anchored less than the length that the longer trim length brush wire tufts extends radially beyond the outer peripheral edge of the center disc or hub to which the tufts are anchored producing an offset trim between the shorter length brush wire tufts and the longer length brush wire tufts. This offset trim between the longer trim length brush wire tufts and the shorter trim length wire tufts means that the more flexible wider longer length wire tufts will make first contact with the surface of the workpiece being abrasively treated with the brush thereby ensuring that milder more gentler abrasive material removal, e.g., polishing, is performed by contact between the longer length tufts and the workpiece. The offset trim between the longer wire tufts and shorter wire tufts provided by the longer length wire tufts extending farther radially outwardly from the disc or hub, not only ensures that the abrasive faces at the end of the longer tufts make first contact with the workpiece, but that the longer tufts help locate or space the abrasive faces of the shorter tufts relative to the workpiece to help ensure the sharp tips of the wires that form each abrasive face of the shorter tufts contact the workpiece. This helps ensure more optimally aggressive material removal by the shorter tufts while minimizing contact force with the workpiece thereby helping to maximize the life of the shorter tufts. As a result, such a brush of the present invention advantageously maintains greater material removal rates for a longer period of time. In addition, the use of more flexible tufts having a wider abrasive face more gently sweeps over or against the workpiece less aggressively removing material from the workpiece surface advantageously producing a better surface finish ordinally not accomplished with a brush having such a high material removal rate without using a second brush that is less aggressive and/or which is a polishing brush.

The brush wire tufts can be composed of wires made of Tampico, nylon, or polypropylene, nonferrous filaments, such as wires or wire filaments made of brass or bronze, e.g., phosphorous bronze, ferrous wires or filaments such as a medium or high-carbon steel, e.g., heat-treated, high tensile strength high-carbon or high drawn steel wires or wire filaments, and stainless steel, e.g., Type 302 stainless steel, Type 304 stainless steel or Type 316 stainless steel, and coated or encapsulated wires or wire filaments, such as elastomer or plastic coated metallic wires or wire filaments.

If desired, each one of the tufts of a brush of the present invention can be composed of multiples wires each formed of a plurality or plurality of pairs of strands braided, twisted or otherwise woven together to form the wires which are in turn twisted to form the brush tuft. In a preferred embodiment, each one of the brush wire tufts is formed of at least a plurality of pairs, i.e., at least three, of wires each formed of at least a plurality of pairs, i.e., at least three, strands that are braided, twisted or otherwise woven together. In one such preferred embodiment, a 32-hole offset hole configuration rotary radial brush of the present invention has an elongate brush wire tuft extending radially outwardly from each hole that is of twisted knot construction with each tuft formed of between 22 and 34, preferably between 22 and 32, wires or wire filaments. In a preferred embodiment, each one of the wires that form each tuft can be and preferably are formed of two or more, preferably at least a plurality of pairs, i.e., at least three, strands braided, twisted and/or woven together with the resultant formed wires then attached by a twist knot to the disc or hub of the brush that twists the wires together along at least fifty percent and preferably at least two-thirds the length of the twist knot anchored tuft.

In a preferred embodiment, each brush wire of at least one and preferably a plurality, more preferably a plurality of pairs, of the tufts of the brush is formed of at least a plurality, preferably at least a plurality of pairs, of strands braided together substantially the entire length of the wire. In another preferred embodiment, each brush wire of at least one and preferably a plurality, more preferably a plurality of pairs, of the tufts of the brush is formed of at least a plurality, preferably at least a plurality of pairs, of strands twisted together substantially the entire length of the wire. In still another preferred embodiment, each brush wire of at least one and preferably a plurality, more preferably a plurality of pairs, of the tufts of the brush is formed of at least a plurality, preferably at least a plurality of pairs, of strands woven together substantially the entire length of the wire.

Wires of one or more or all of the tufts of a brush configured in accordance with the present invention can be composed of wires one or more or all of which can be composed of one or more strands braided, twisted and/or woven together to impart to the tufts greater shock and vibration resistance and absorption, produce a more resilient tuft having an abrasive workpiece surface contacting face that more readily conforms to the three dimensional contour of the surface of the workpiece being abrasively treated, and which helps produce a stiffer tuft that increases material removal but yet which also is relatively flexible producing an improved surface finish. In yet another preferred embodiment, each brush wire of at least one and preferably a plurality, more preferably a plurality of pairs, of the tufts of the brush is formed of at least a plurality, preferably at least a plurality of pairs, of strands braided and twisted together substantially the entire length of the wire. In still yet another preferred embodiment, each brush wire of at least one and preferably a plurality, more preferably a plurality of pairs, of the tufts of the brush is formed of at least a plurality, preferably at least a plurality of pairs, of strands braided and woven together substantially the entire length of the wire. In a further preferred embodiment, each brush wire of at least one and preferably a plurality, more preferably a plurality of pairs, of the tufts of the brush is formed of at least a plurality, preferably at least a plurality of pairs, of strands twisted and woven together substantially the entire length of the wire. In yet a further preferred embodiment, each brush wire of at least one and preferably a plurality, more preferably a plurality of pairs, of the tufts of the brush is formed of at least a plurality, preferably at least a plurality of pairs, of strands braided, twisted, and woven together substantially the entire length of the wire.

In another preferred embodiment, each brush wire is formed of at least a plurality, preferably at least a plurality of pairs, of strands twisted together substantially the length of the wire and tuft. In still another preferred embodiment, each brush wire is formed of at least a plurality of, preferably at least a plurality of pairs, strands that are both braided and twisted together substantially the length of the wire and tuft. Brush wire strands are each smaller in width or diameter than the brush wires formed from braiding, twisting and/or weaving together the strands. Where each brush wire is formed of multiple strands, such strands can be made or otherwise composed of Tampico, nylon, or polypropylene, nonferrous material, such as brass or bronze, e.g., phosphorous bronze, ferrous material, such as a medium or high-carbon steel, e.g., heat-treated, high tensile strength high-carbon or high drawn steel, and stainless steel, e.g., Type 302 stainless steel, Type 304 stainless steel or Type 316 stainless steel, and can be coated or encapsulated, such as with an elastomer or plastic.

In another preferred embodiment, such an offset hole configured rotary radial brush constructed in accordance with the present invention has a disk or hub with between 28 and 72 holes arranged in such a staggered radially offset pattern has brush wire tufts each formed of at least 22 brush wires twisted substantially along the length of the tuft further improving brush life and/or abrasive material removal performance. In one such preferred embodiment, each one of the brush wire tufts is formed of no more than 34 wires and preferably no more than about 32 wires. Such brush wires can be made or otherwise composed of Tampico, nylon, or polypropylene, nonferrous material, such as brass or bronze, e.g., phosphorous bronze, ferrous material such as a medium or high-carbon steel, e.g., heat-treated, high tensile strength high-carbon or high drawn steel, and stainless steel, e.g., Type 302 stainless steel, Type 304 stainless steel or Type 316 stainless steel, and can also be coated or encapsulated, such as with an elastomer or plastic.

If desired, brush wires of one or more of all of the tufts of the brush in turn can be formed of at least a plurality of strands braided, twisted and/or otherwise woven together. In a preferred embodiment, brush wires are formed of at least a plurality of pairs, i.e., at least three, of strands that are braided, twisted or otherwise woven together. In one such preferred embodiment, an offset hole configured rotary radial brush constructed in accordance with the present invention has a disk or hub with between 28 and 72 holes arranged in a staggered radially offset pattern with a brush wire tuft extending radially outwardly from each hole that is of twisted knot construction formed of wires having between 22 and 34, preferably between 22 and 32, wires twisted together at least half and preferably at least two-thirds the length of the tuft. In a preferred embodiment, tufts of the brush are composed of brush wires each formed of at least a plurality, preferably at least a plurality of pairs, of strands twisted together substantially the length of the wire. In another preferred embodiment, tufts of the brush are composed of wires formed of at least a plurality, preferably at least a plurality of pairs, of strands braided together substantially the length of the wire. In still another embodiment, tufts of the brush are formed of wires composed of at least a plurality, preferably at least a plurality of pairs, of strands both braided and twisted together substantially the length of the wire. Where each brush wire is formed of strands, the strands can be made or otherwise composed of Tampico, nylon, or polypropylene, nonferrous material, such as brass or bronze, e.g., phosphorous bronze, ferrous material such as a medium or high-carbon steel, e.g., heat-treated, high tensile strength high-carbon or high drawn steel, and/or stainless steel, e.g., Type 302 stainless steel, Type 304 stainless steel or Type 316 stainless steel, and can be coated or encapsulated, such as with an elastomer or plastic.

In a further preferred embodiment, an offset hole configured rotary radial brush of the invention has a disk or hub with between 28 and 72 holes arranged in a staggered radially offset pattern in accordance with the present invention employs brush wire tufts each formed of between 22 and 40 wires twisted together along at least half, preferably at least two thirds the length of the brush wire tuft. If desired, each brush tuft can be composed of wires formed of multiple strands that are both twisted and braided along the entire length of the wire formed of the strands imparting increased resilience, vibration absorption, and stiffness to each tuft formed therewith further improving brush life and/or abrasive material removal performance. In one such preferred embodiment, each one of the brush wire tufts is formed of no more than 34 wires and preferably no more than about 32 wires. As previously discussed, the wires can be formed of a plurality or even a plurality of pairs of strands braided, twisted and/or woven together along the entire length of the wire. Such wires and wire strands can be made or otherwise composed of Tampico, nylon, or polypropylene, nonferrous material, such as brass or bronze, e.g., phosphorous bronze, ferrous material such as a medium or high-carbon steel, e.g., heat-treated, high tensile strength high-carbon or high drawn steel, and stainless steel, e.g., Type 302 stainless steel, Type 304 stainless steel or Type 316 stainless steel, and can be coated or encapsulated with an elastomer or plastic.

If desired, one or more or even all of the wires of one or more or all of the tufts of the brush can be formed of at least a plurality of strands braided, twisted and/or otherwise woven together to form the wires. In a preferred embodiment, tufts of the brush are composed of brush wires formed of at least a plurality of pairs, i.e., at least three, of strands that are braided, twisted and/or otherwise woven together. In one such preferred embodiment, an offset hole configured rotary radial brush of the invention has a disk or hub with between 28 and 72 holes arranged in a staggered radially offset pattern in accordance with the present invention has each tuft composed of between 20 and 40 wires per tuft with each wire preferably formed of at least a plurality, preferably at least a plurality of pairs, of strands braided, twisted and/or woven together. In one preferred embodiment, each tuft is composed of between 22 and 34, preferably between 22 and 32, wires twisted together in forming a twisted knot, such as a standard knot, cable knot, or stringer bead knot, used to anchor the wires of the tuft to the disc or hub of the brush. In a preferred embodiment, each tuft is composed of wires each formed of at least a plurality, preferably at least a plurality of pairs, of filament strands twisted together substantially the length of the wire and tuft. In another preferred embodiment, each tuft is composed of wires each formed of at least a plurality, preferably at least a plurality of pairs, of strands braided together substantially the length of the wire and tuft. In still another embodiment, each tuft is composed of wires each formed of at least a plurality, preferably at least a plurality of pairs, of strands both braided and twisted together substantially the length of the wire and tuft. In yet another embodiment, each tuft is composed of wires each formed of at least a plurality, preferably at least a plurality of pairs, of strands braided, twisted and woven together substantially the length of the wire and tuft. Such wires and strands forming the wires can be formed of Tampico, nylon, or polypropylene, nonferrous material, such as brass or bronze, e.g., phosphorous bronze, ferrous material such as a medium or high-carbon steel, e.g., heat-treated, high tensile strength high-carbon or high drawn steel wire, and stainless steel, e.g., Type 302 stainless steel, Type 304 stainless steel or Type 316 stainless steel, and can be coated or encapsulated with an elastomer or plastic.

Each brush wire tuft is anchored to the center disk or hub of the brush by threading its wires through a corresponding hole formed the center disc hub and twisting the wires to form a twisted knot that twists the wires of the tuft along at least half their length or at least half the length of the wires of the tuft and which preferably twists the of the tuft along at least two-thirds their length or at least two-thirds the length of the wires of the tuft. In a preferred embodiment, the wires can be twisted during forming of a cable twist knot or stringer bead twist knot substantially the length of the wires and/or tuft to produce a relatively tightly twisted tuft that is stuffer and has more aggressive material removal properties. In one preferred embodiment, shorter trim length tufts extending from radially outermost holes of the disk or hub are anchored to the hub by cable twist knots and/or stringer bead twist knots twisting the wires forming each shorter trim length tuft the entire length of the tuft producing stiffer more aggressive narrower shorter length tufts imparting increased material removal capability to the brush. In one such preferred embodiment, the longer trim length tufts extending from radially innermost holes of the disk or hub are anchored to the hub or disk using standard twist knots twisting the wires of each longer trim length tuft at least half the length of the longer tuft and preferably about two-thirds the length of the longer tuft producing wider more flexible sweeping longer length tufts imparting improved surface finishing and/or polishing capabilities to the brush.

In a preferred embodiment, each tuft is anchored by a twisted knot where the wires of the tuft preferably are relatively tightly twisted and/or braided along substantially the entire length of the tuft having a relatively narrow abrasive working face at or adjacent the free or working end of the tuft. In a preferred embodiment, each tuft is anchored to the center disc hub by a twisted knot that is relatively tightly twisted and preferably tightly twisted enough to produce a free end or working end of the tuft with a face that is substantially the same as the width or diameter of the brush wires that make up the tuft. Having such a tightly twisted knot that produces such a narrow relatively small working face at the free end or working end of each tuft is critical to producing a rotary brush in accordance with the present invention having such high material removal rates and such an extended brush wire life. The use of such a tightly twisted knot produces a brush of the present invention with brush wire tufts each made of multiple wires which in turn can be formed of multiple strands twisted and/or braided together tightly enough to produce an abrasive working face width or diameter substantially the same as that of the tuft and/or wires that form the tuft when in a straightened and parallel condition where the wires adjoin one another along their lengthwise sides or outer surfaces.

In one preferred embodiment, each wire is anchored to the center disc hub by a twisted knot that preferably is a cable knot of relatively tight twist where the filaments that make up each wire are twisted and/or braided substantially along the entire length of the wire to produce such a desirably small or narrow tuft and such a desirable small working face. In one such preferred embodiment, the wire filaments that make up each wire are both braided and twisted with each wire attached to the center disc hub by such a cable knot. The use of such a cable knot produces a brush wire of the present invention made of multiple filaments twisted and/or braided together tightly enough to produce a tuft width or diameter and/or a working face width and/or diameter substantially the same as that of the brush wire filaments in a straightened and parallel condition where the filaments adjoin one another along their lengthwise sides or outer surfaces.

In another such preferred embodiment, each wire is anchored to the center disc hub by a twisted knot that preferably is a stringer bead knot where the filaments that make up each wire are tightly twisted substantially along the entire length of the wire to produce such a desirably small or narrow tuft and such a desirable small working face. In one such preferred embodiment, the wire filaments that make up each wire are both braided and twisted with each wire attached to the center disc hub by such a stringer bead knot. The use of such a stringer knot produces a brush with brush wires of the present invention made of multiple filaments twisted and/or braided together tightly enough to produce a tuft width or diameter and/or a working face width and/or diameter substantially the same as that of the brush wire filaments in a straightened and parallel condition where the filaments adjoin one another along their lengthwise sides or outer surfaces.

A rotary radial brush constructed in accordance with the present invention is composed of the 32-hole offset hole center disc hub each having a brush wire extending radially outwardly from each hole with the hub coupled to or carrying at least one outer cover plate and preferably sandwiched between a pair of outer cover plates. In one preferred embodiment of a radial brush of the present invention, each one of the outer cover plates of the brush are three-dimensionally contoured in a manner that strengthens the brush of the invention preferably by stiffening and/or structurally rigidifying the brush.

In one preferred embodiment, each cover plate has at least a plurality of pairs, i.e., at least three, radially extending ribs formed therein that strengthen at least the cover plate and which preferably strengthen the entire assembly of the cover plates and the center hub thereby advantageously strengthening the entire brush. In one such preferred embodiment, each cover plate has at least four ribs equiangularly spaced apart that each extend from at or adjacent a mount disposed at or adjacent a center of the plate radially outwardly to or adjacent an outer peripheral edge of the plate. Another such preferred embodiment has four such equiangularly spaced apart radial ribs integrally formed in or of each cover plate of the brush. In at least one embodiment, each radial rib formed in or of part of one or both cover plates are upraised ribs that extend axially outwardly away from the center disc hub sandwiched between the plates.

In another preferred embodiment, at least one and preferably both cover plates of the brush have at least one circumferentially extending upraised ridge disposed between the mount and outer peripheral edge of each plate. In one such preferred embodiment, each plate has a single circumferentially extending upraised ridge disposed in a mid-portion of the plate preferably spaced nearly equidistantly radially between the mount and outer peripheral plate edge. In at least one embodiment, the circumferential ridge is of continuous construction such that the resultant ridge is continuous and uninterrupted, i.e., an annular or circular continuous and uninterrupted ridge, integrally formed in or of part of each plate. The annular continuous and uninterrupted ridge formed in each cover plate preferably strengthens at least the plate and preferably the entire brush by stiffening at least the plate and preferably the brush by reducing and preferably minimizing flexure of at least the plate and preferably the entire brush when pressure is being applied against a surface being abrasively surface treated by the brush during rotation of the brush.

A rotary radial brush constructed in accordance with the present invention has a center disc hub of 32-hole offset-hole construction with a brush wire extending radially from each hole that is formed of at least 22 wire filaments, preferably no more than 34 wire filaments, preferably no more than about 32 wire filaments, at least about 30 wire filaments, and more preferably exactly 30 wire filaments and which can be anchored to the hub using a twist knot of relatively tight twisted construction. Suitable twist knots usable to produce a tuft and/or working face at or adjacent the free end or working end of each wire include cable knots and/or stringer knots as they produce a brush wire composed of twisted brush wire filaments having a tuft width or diameter and/or a working face width and/or diameter substantially the same as that of the filaments in a straightened and parallel condition where the filaments adjoin one another along their lengthwise sides or outer surfaces.

While each brush wire of such a rotary radial brush of the present invention can be of a conventional twisted knot wire construction, e.g., standard twisted knot, cable twisted knot, or stringer bead twisted knot, each brush wire can be and preferably is one of a twisted multifilament twisted multistrand brush wire construction and a braided filament or braided strand wire construction. Such a rotary radial brush of the present invention also can include outer cover plates having at least one annular upraised ridge and/or at least a plurality of pairs, i.e., at least three, upraised radial ribs that strengthen the plate and preferably the entire brush. While such a radial rotary wire brush preferably is configured for use as a wheel wire brush that more preferably can be configured as a power wire brush, it is also contemplated that a rotary cup brush, e.g., twisted wire cup brush, can also be constructed in accordance with the present invention in a manner that incorporates one or more or all the above novel and inventive features and/or components, the 32-hole offset hole arrangement, and/or brush wire configurations.

The present invention also is directed to a double-stringer radial brush formed of a pair of center discs or center hubs operatively coupled coaxially together in tandem for rotation in unison about a common axis of rotation where one or both discs or hubs is formed with circumferentially spaced apart brush wire tuft anchoring or mounting holes that are alternating radially offset or radially staggered with elongate brush wire tufts extending radially outwardly from each one of the openings with alternating tufts configured with different stiffnesses producing a double-stringer brush assembly possessing both aggressive material removal characteristics from the stiffer tufts and good surface finishing characteristics from the more flexible tufts. The alternating radially offset or radially staggered holes formed in one and preferably both of the hubs are arranged in a first set of radially innermost holes circumferentially spaced apart about the hub a first radial distance from a center of the hub and a second set of radially outermost holes circumferentially spaced apart about the hub a second radial distance from a center of the hub that is greater than the first radial distance.

The tufts extending from the radially innermost and radially outermost sets of holes of at least one and preferably both of the hubs have tuft lengths configured to provide an offset trim such that alternating tufts extend radially outwardly different lengths beyond the hub to which they are attached with the tufts extending from one of the radially innermost or radially outermost sets of holes having an abrasive workpiece engaging face at their free end that extends radially outwardly of the workpiece engaging face of the tufts extending from the other one of the radially innermost or radially outermost sets of holes. In a preferred embodiment, the more flexible tufts extend from one of the sets of radially innermost or radially outermost holes radially outwardly beyond the hub to which the tufts are attached a greater distance than the stiffer tufts that extend from the other one of the sets of radially innermost or radially outermost holes such that a face of one of the more flexible tufts engages the workpiece first polishing the workpiece before the face of an adjacent one of the stiffer tufts engages the workpiece abrasively removing material therefrom. Because the more flexible tufts flex more than the stiffer tufts and extend farther radially outwardly from the hub than the stiffer tufts, flexure of the flexible tuft from contact with its workpiece engaging face with the workpiece enables the workpiece engaging face of the stiffer tuft following the more flexible tuft to nearly simultaneously contact the workpiece substantially simultaneously polishing and abrading the workpiece as the brush rotates during operation.

The radially outermost holes of at least one and preferably both of the hubs are each larger in size than the radially innermost holes with each one of the radially outermost holes having a width or diameter that is greater than a width or diameter of each one of the radially innermost holes. In such a preferred brush embodiment, the more flexible tufts are mounted in each one of the radially outermost holes and the stiffer tufts are mounted in the radially innermost holes with the larger size of the radially outermost holes helping the tufts mounted thereto or therein to flex more. The support provided by a stiffer tuft one either side of each flexible tuft helps increase the life of the more flexible tufts by preventing bending and fatigue cracking of wires of the flexible tufts thereby advantageously increasing overall brush life.

Each one of the tufts are mounted in a corresponding one of the radially innermost and radially outermost holes of at least one and preferably both of the hubs by knots having a plurality of different knot sizes with a preferred embodiment of the brush using a larger knot to mount tufts, preferably the stiffer tufts, in the radially innermost holes and a smaller knot to mount tufts, preferably the more flexible tufts, in the radially outermost holes. The use of a larger knot to attach tufts to the radially innermost holes increases the stiffness of the tufts attached to the radially innermost holes thereby increasing the abrasive material removal aggressiveness of the tufts mounted to the radially innermost holes. The use of a smaller knot to attach tufts to the radially outermost holes imparts greater flexibility to the tufts mounted to the radially outermost holes thereby reducing their aggressiveness of material removal and improving their ability to polish the workpiece during brush operation.

In one embodiment, both hubs can be angularly arranged with the radially innermost holes of one of the hubs generally coaxial with the radially innermost holes of the other one of the hubs and the radially outermost hubs of the one of the hubs generally coaxial with the radially outermost holes of the other one of the hubs such that the stiffer tufts of both hubs are substantially angularly aligned and axially overlie or axially inline with one another and the more flexible tufts of both hubs are also substantially angularly aligned and axially overlie or axially inline with one another. In a preferred embodiment, one of the hubs is angularly offset relative to the other one of the hubs such that each one of the radially innermost holes of the one of the hubs is angularly offset, not coaxial with, and eccentric relative to a corresponding one of the radially innermost holes of the other one of the hubs and the each one of the radially outermost holes of the one of the hubs is angularly offset, not coaxial with, and eccentric relative to a corresponding one of the radially outermost holes of the other one of the hubs. This results in the stiffer tufts of the one of the hubs being angularly offset and not axially inline relative to the stiffer tufts of the other one of the hubs and the more flexible tufts of the one of the hubs being angularly offset and not axially inline relative to the more flexible tufts of the other one of the hubs. In one such preferred embodiment, one of the hubs is angularly offset by at least five degrees relative to the other one of the hubs such that the radially innermost holes and radially outermost holes of both hubs overlap but are not coaxial, the more flexible tufts of one of the hubs overlaps with but is not axially inline with corresponding more flexible tufts of the other one of the hubs, and the stiffer tufts of the one of the hubs overlaps with but is not axially inline with corresponding stiffer tufts of the other one of the hubs. In another such preferred embodiment, the hubs of the double-stringer brush are configured with an angular offset such that the radially innermost holes of one of the hubs overlap corresponding radially outermost holes of the other one of the hubs, the radially outermost hubs of the one of the hubs overlap corresponding radially innermost holes of the other one of the hubs, the stiffer tufts of the one of the hubs overlap and can be axially inline with corresponding more flexible tufts of the other one of the hubs, and the more flexible tufts of the one of the hubs overlap and can be axially inline with corresponding stiffer tufts of the other one of the hubs.

Such a double-stringer rotary radial brush of the present invention has two sets of tufts side-by-side rotating in unison with the stiffer tufts of both hubs providing more aggressive material removal and the more flexible tufts of both hubs providing increased polishing producing an advantageous combination of relatively high material removal rates and excellent surface finishing reducing or eliminating the need for subsequent surface finishing operations while possessing increased double-stringer rotary radial brush life.

These and other objects, features and advantages of this invention will become apparent from the following more detailed description of the invention and accompanying drawings.

DRAWING DESCRIPTION

One or more preferred exemplary embodiments of the invention are illustrated in the accompanying drawings in which like reference numerals represent like parts throughout and in which.

Figure 1:
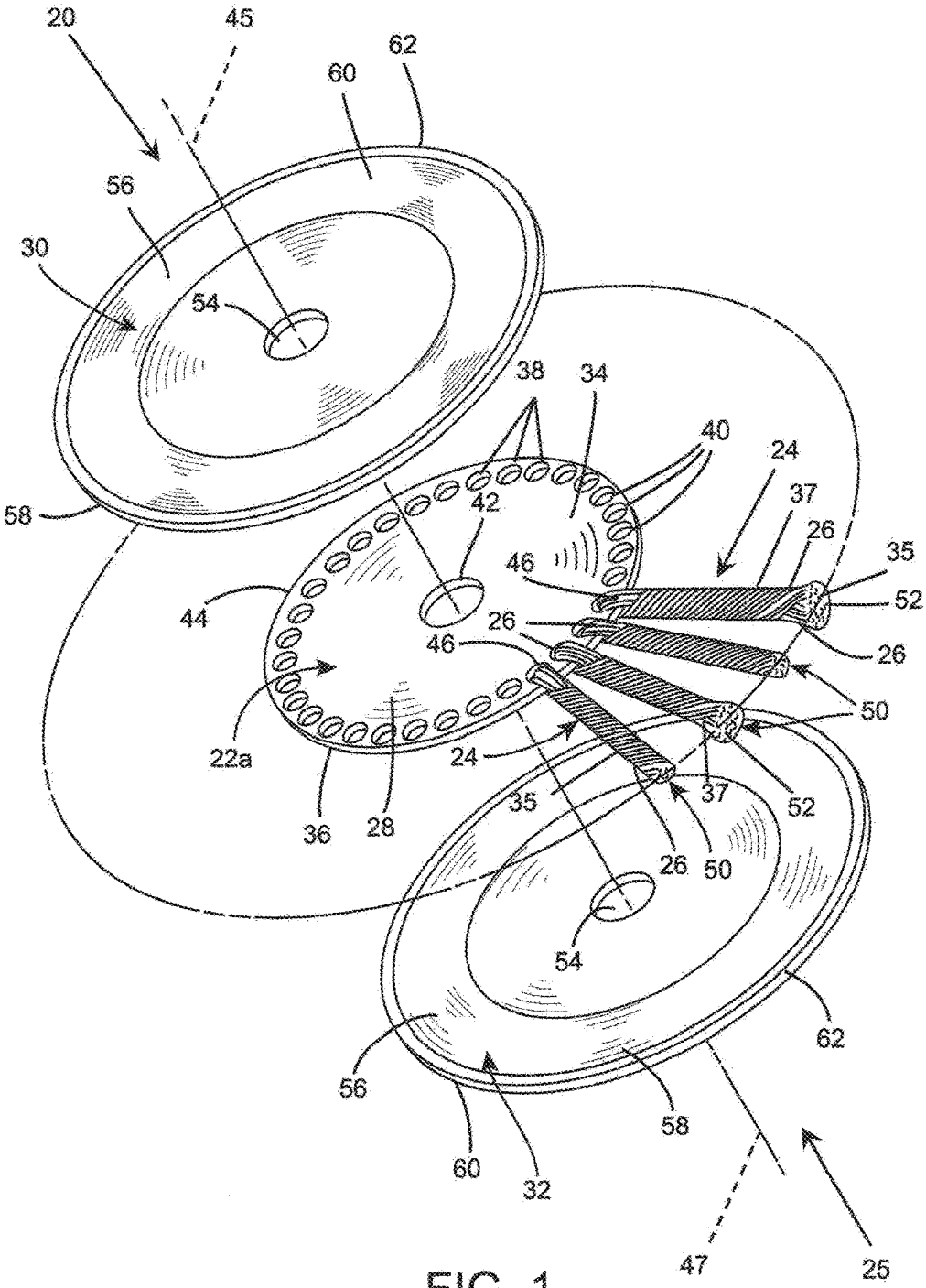
FIG. 1 (PRIOR ART)
FIG. 1 is an exploded perspective view of a prior art rotary radial wheel wire brush assembly illustrating a conventional central disc hub with brush wire tuft anchoring holes uniformly circumferentially spaced about the periphery of the hub from which brush wires radially extend and having a pair of circular cover plates sandwiching the hub.

Before explaining one or more embodiments of the invention in detail, it is to be understood that the invention is not limited in its application to the details of construction and the arrangement of the components set forth in the following description or illustrated in any appended drawings. The invention is capable of other embodiments, which can be practiced or carried out in various ways. Also, it is to be understood that the phraseology and terminology employed herein is for the purpose of description and should not be regarded as limiting.

DETAILED DESCRIPTION

Introduction

As depicted in the accompanying drawing figures and discussed in more detail below, the present invention is directed to power-driven, e.g., rotary power tool driven, rotary brushes equipped with twisted knot brush wire tufts which are of the type used in surface finishing and abrasive material removal applications, such as deburring, cleaning, descaling, polishing, blending, and texturizing, and of an improved configuration that provides a balanced blend of surface finishing and aggressive material removal making such rotary brushes of the invention usable in a wider variety of surface finishing and material removal applications. Such a rotary brush of the present invention is constructed with a novel configuration of (a) radially staggered or radially offset brush wire tuft mounting holes spaced circumferentially about the center disc or hub of the brush, (b) alternating radially staggered or radially offset brush wire tuft mounting holes arranged with one set of the holes having centerlines extending along a circle and being radially innermost holes located radially closest to a center of the center disc or hub about which the brush rotates, and another set of the holes having centerlines extending along a circle and being radially outermost holes located radially farthest away from the center of the hub about which the brush rotates where the holes of one of the sets is larger than the holes of the other one of the sets, (c) brush wire tufts having different trim lengths with the shorter trim length tufts being stiffer providing greater more aggressive workpiece material removal with increased workpiece material removal rates and the longer trim length tufts being more flexible providing greater workpiece polishing improving workpiece surface finish, (d) brush wire tufts having different length knots with the shorter trim length tufts configured with larger longer knots further increasing the stiffness of the shorter trim length tufts increasing aggressiveness of workpiece material and workpiece material removal rates, (e) brush wire tufts of twisted, braided and/or woven wire tufts and/or tufts formed of twisted, braided and/or woven strands of wires producing brush wire tufts with increased resilience, stiffness, vibration absorption, wear resistance, aggressiveness, surface polishing, and operating life, and/or (f) brush wire tufts having different combinations of twisted, braided and/or woven wire tufts and/or tufts formed of twisted, braided and/or woven strands of wires in a single rotary brush producing in a single rotary brush having combinations of brush wire tufts with combinations of tufts with increased resilience and other tufts with increased stiffness, tufts with increased material removal and other tufts with increased vibration absorption, and/or tufts with increased material removal rates and other tufts with increased polishing improving surface finishing quality, such that a rotary brush constructed with one or more of (a)-(f) in accordance with the present invention possesses an advantageous combination of increased aggressiveness, improved surface finishing, and greater brush life not heretofore believed possible. The present invention encompasses a rotary brush constructed and/or configurated with at least a plurality of (a)-(f), preferably at least a plurality of pairs, i.e., at least three, of (a)-(e), more preferably at least four of (a)-(ef, and even more preferably all of (a)-(f), thereby producing a rotary brush in accordance with the invention that advantageously provides balanced surface finishing or polishing and aggressive material removal during surface finishing treatment or abrasive treatment of a workpiece while still possessing a desirably long operating life.

In at least one preferred embodiment, the present invention is directed to a rotary brush having brush wire tuft anchoring holes circumferentially spaced apart about its central disc or hub and which are staggered by being radially offset relative to one another. Such a rotary brush advantageously employs twisted or knotted wire tufts having different trim lengths and stiffnesses producing a brush with longer more flexible wire tufts that provide less aggressive and a lesser rate of material removal and shorter stiffer flexible wire tufts that provide more aggressive and a greater rate of material removal. The present invention can be and preferably is directed to a rotary brush constructed or configured in the form of a rotary radial wire brush of the type used for abrasive material removal in performing a surface treatment or surface finishing operation and which preferably is a wire wheel brush and which can be a power brush well suited for use in weld surface preparation, cleaning of finished welds, e.g., slag removal, rust removal, paint removal, deburring, and/or other types of abrasive material removal, abrasive surface treatment, and abrasive surface finishing applications. Depending on the type of surface to be treated, the amount of material which needs to be removed, the depth of which material can be abrasively removed, and other factors, such a rotary brush constructed in accordance with the present invention can also be used for other types of abrasive material removal applications, such as even some grinding applications, such as where a rotary grinding wheel might also be used. Such a rotary brush can be and preferably is electrically or pneumatically powered, such as by a rotary power tool that can be a grinder, such as an electrically or pneumatically powered angle grinder, e.g., right angle grinder, an electrically or pneumatically powered straight grinder, an an electrically or pneumatically powered die grinder, an electrically or pneumatically powered bench grinder, an electrically or pneumatically powered drill, an electrically or pneumatically powered drill press, or another type of electric or pneumatic powered rotary power tool.

The present invention also encompasses a double-stringer brush composed of a pair of rotary brushes joined together for rotation about a common axis of rotation substantially in unison with one and preferably both brushes of the double-stringer brush constructed and/or configurated with at least a plurality of (a)-(e), preferably at least a plurality of pairs, i.e., at least three, of (a)-(e), more preferably at least four of (a)-(e), and even more preferably all of (a)-(e), thereby producing a rotary brush in accordance with the invention that advantageously provides balanced surface finishing or polishing and aggressive material removal during surface finishing treatment or abrasive treatment of a workpiece while still possessing a desirably long operating life.

DESCRIPTION OF ONE OR MORE PREFERRED EMBODIMENTS OF THE INVENTION

With reference to the drawings, FIG. 1 illustrates an exemplary rotary radial wire brush assembly 20 of a rotary radial wire brush 25 of generally the same construction as a rotary radial brush assembly constructed in accordance with the present invention, but which differs in the brush assembly 20 and brush 25 of FIG. 1 has a conventional disc-shaped brush wire carrying center disc or hub 22*a* from which circumferentially spaced abrasive wire tufts 24, each formed of bundles of twisted wires 26, radially outwardly extend. The brush assembly 20 further includes a pair of generally circular cover plates 30, 32 between which is sandwiched the generally circular body or platter 28 of the disc or hub 22*a* with the cover plates 30, 32 covering respective oppositely outwardly facing outer platter surfaces 34, 36 of the hub 22*a*. As discussed in more detail below, a rotary wire brush assembly and rotary wire brush constructed in accordance with the present invention is different from the brush assembly 20 and brush 25 of FIG. 1 in that it employs a novel disc-shaped center disc or hub and an arrangement of brush wire tufts configured to produce a rotary wire brush assembly and rotary wire brush of the invention with an improved more optimal combination of increased material removal, improved surface finishing, and longer brush life.

With continued reference to FIG. 1, center disk or hub 22*a* has brush wire tuft-seating holes 40 circumferentially spaced apart about the entire periphery of the hub 22*a*, with each hole 40 forming part of a corresponding brush wire tuft anchor 38 that also includes a portion of the hub platter 28 extending from the hole 40 radially outwardly to an outer peripheral edge 44 of the hub 22*a*. The tuft-seating holes 40 are equiangularly spaced apart and extend circumferentially about the periphery 44 of the hub 22*a* with each one of the holes 40 spaced the same radial distance from a center 45 of the hub 22*a* that also is substantially coincident with an axis 47 about which the hub 22*a* and brush 25 rotates during abrasive material removal use and operation. As is also shown in FIG. 1, the tuft-seating holes 40 are also radially spaced from a rotary drive mounting arbor hole 42 of the hub 22*a* through which the hub center 45 and rotation axis 47 centrally extends.

As shown in FIG. 1, all the tuft-seating holes 40 are arranged in a circle circumferentially in line with one another spaced a common distance inboard of the outer radial peripheral edge 44 of the hub 22*a*. An elongate radially extending brush wire tuft 24 is seated in each hole 40 that is formed of elongate wires or filaments 26 twisted in a manner that anchors the wires 26 and tuft 24 to the portion of the hub 22*a* disposed radially between the hole 40 and peripheral hub edge 44 using a twisted knot 46, which can be a standard twist knot, a cable twist knot or a stringer bead twist knot. Each brush wire tufts 24 is formed of up to 14 wires or filaments 26 that extend radially outwardly from each hole 40 and which are twisted along at least a portion of the length of the tuft 24 as a result of being twist knot anchored to the corresponding brush anchor 38 of the hole 40 forming up to 28 brush wire bristles 35. The twisted wires 26 of each tuft 24 forms an elongate tuft 37 with the tips 52 of the wires 26 of each tuft 24 forming an abrasive surface-contacting head 50 at the end of the tuft 24.

As is also shown in FIG. 1, each cover plate 30, 32 is generally circular and generally coaxial with the central hub 22*a* sandwiched between the plates 30, 32 with the plates 30, 32 having a generally circular arbor hole 54 coaxially aligned with the arbor hole 42 in the hub 22*a*. Each cover plate 30, 32 has a generally circular body 56 with an interior facing surface 58 facing toward a respective one of the oppositely outwardly facing surfaces 34, 36 of the hub 22*a* and an exterior facing surface 60 facing outwardly away from the hub 22*a*. When the cover plates 30, 32 of the brush assembly 20 are fixed to the hub 22*a*, the cover plates 30, 32 radially overlap opposite sides 34, 36 of the hub 22*a*, including the brush anchors 38 and holes 40 of the hub 22*a* as well as the twisted knots 46 with an outer radial edge 62 of each plate 30, 32 overlapping a portion of the radially extending wires 26 of each brush wire tuft 24 that extend radially outwardly beyond the radial edge 44 of the hub 22*a*.

Figure 2:
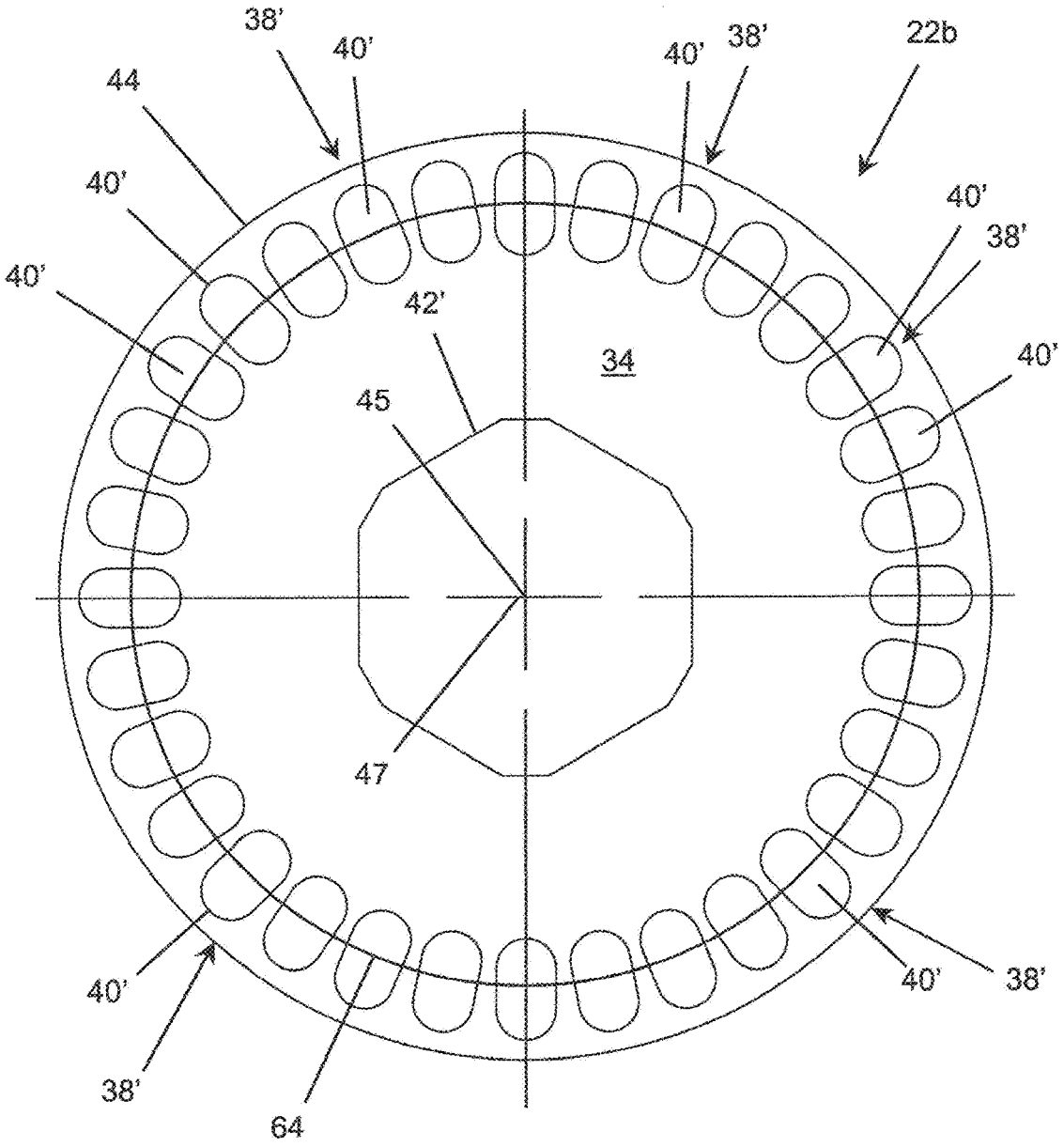
FIG. 2 (PRIOR ART)
FIG. 2 is a plan view of a prior art rotary radial brush center disc hub having 32-slots of a circumferentially aligned configuration where all the slots are spaced circumferentially about the periphery of the hub the same radial distance from a center of the hub.

FIG. 2 illustrates a second prior art rotary brush center disc hub 22*b* of circular and substantially flat or planar construction of a 32-hole circumferentially aligned configuration having radially extending oblong brush wire seating slots 40', each of which also forms part of a corresponding brush tuft anchor 38' extending radially outwardly therefrom to the outer peripheral edge 44 of the hub 22*b*. The slots 40' are equiangularly spaced apart and circumferentially aligned with all of the slots 40' spaced the same radial distance from the center 45 and rotational axis 47 of the hub 22*b*. As such, each one of the slots 40' has a radial centerline spaced the same radial distance from the hub center axis 45 such that the radial centerlines of all the slots 40' lie along a circle 64 coaxial with the center of the hub 22*b*, e.g., the hub center axis 45.

Figure 3:
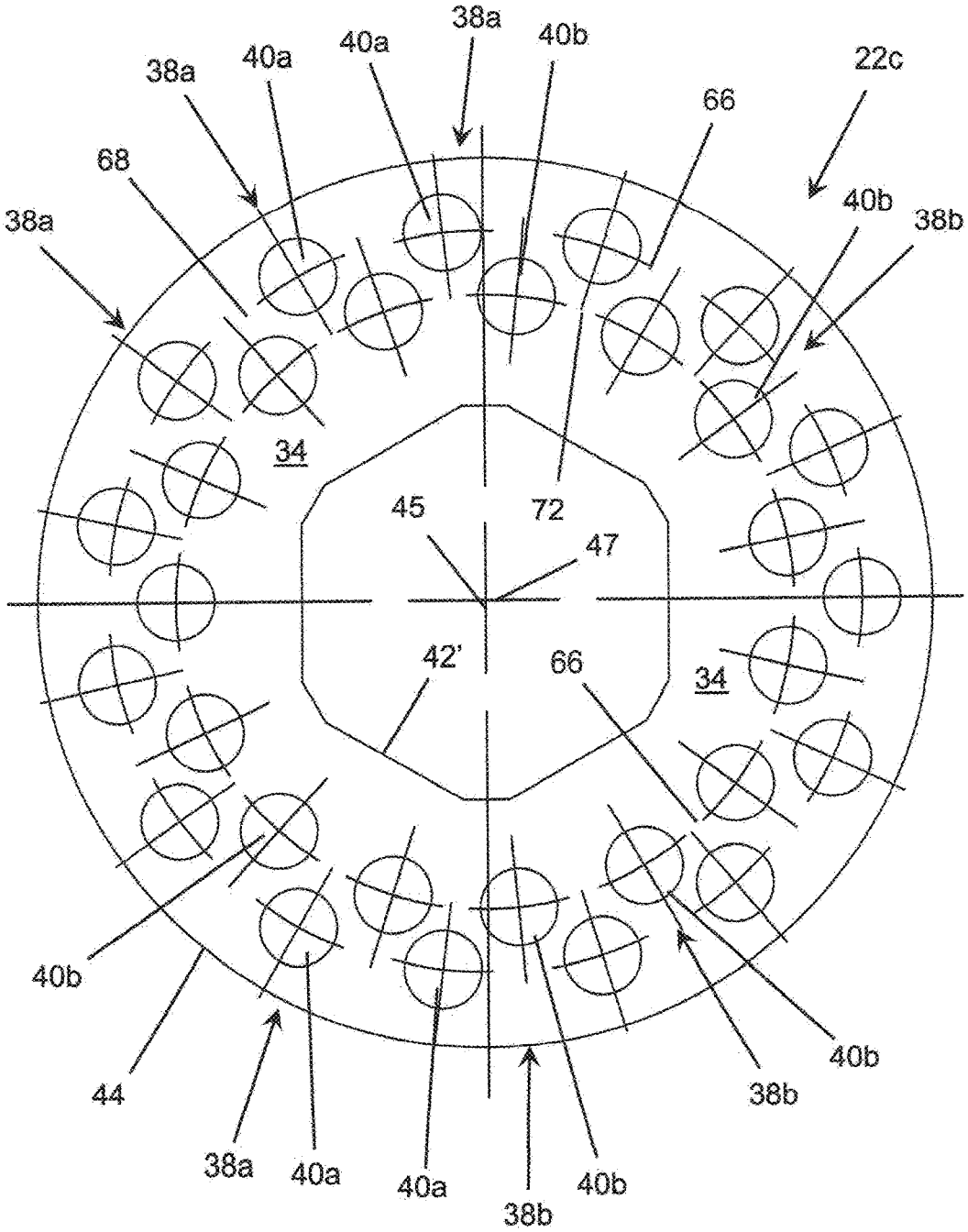
FIG. 3 (PRIOR ART)
FIG. 3 is a plan view of a prior art rotary radial brush center disc hub of a prior art 30-hole offset hole configuration where alternating holes are staggered or offset two different radial distances from the center of the hub.

FIG. 3 illustrates a third prior art rotary brush central disc hub 22*c* of circular and substantially flat or planar construction of a 30-hole offset hole configuration where the brush tuft seating holes 40*a* and 40*b* and brush tuft anchors 38*a* and 38*b* are arranged with an alternating staggered radial offset. As also shown in FIG. 3, the hub 22*c* has a first or radially outermost set of holes 40*a* with circumferentially extending centerlines 66 spaced a first radial distance from the hub center 45 or rotational axis 47 along a first radially outermost circle 68 and a second or radially innermost set of holes 40*b* with circumferentially extending centerlines 72 spaced a second radial distance from the hub center 45 or rotational axis 47 along a second radially innermost circle 70 having a radius less than that of the outermost circle 68.

Figure 4A:
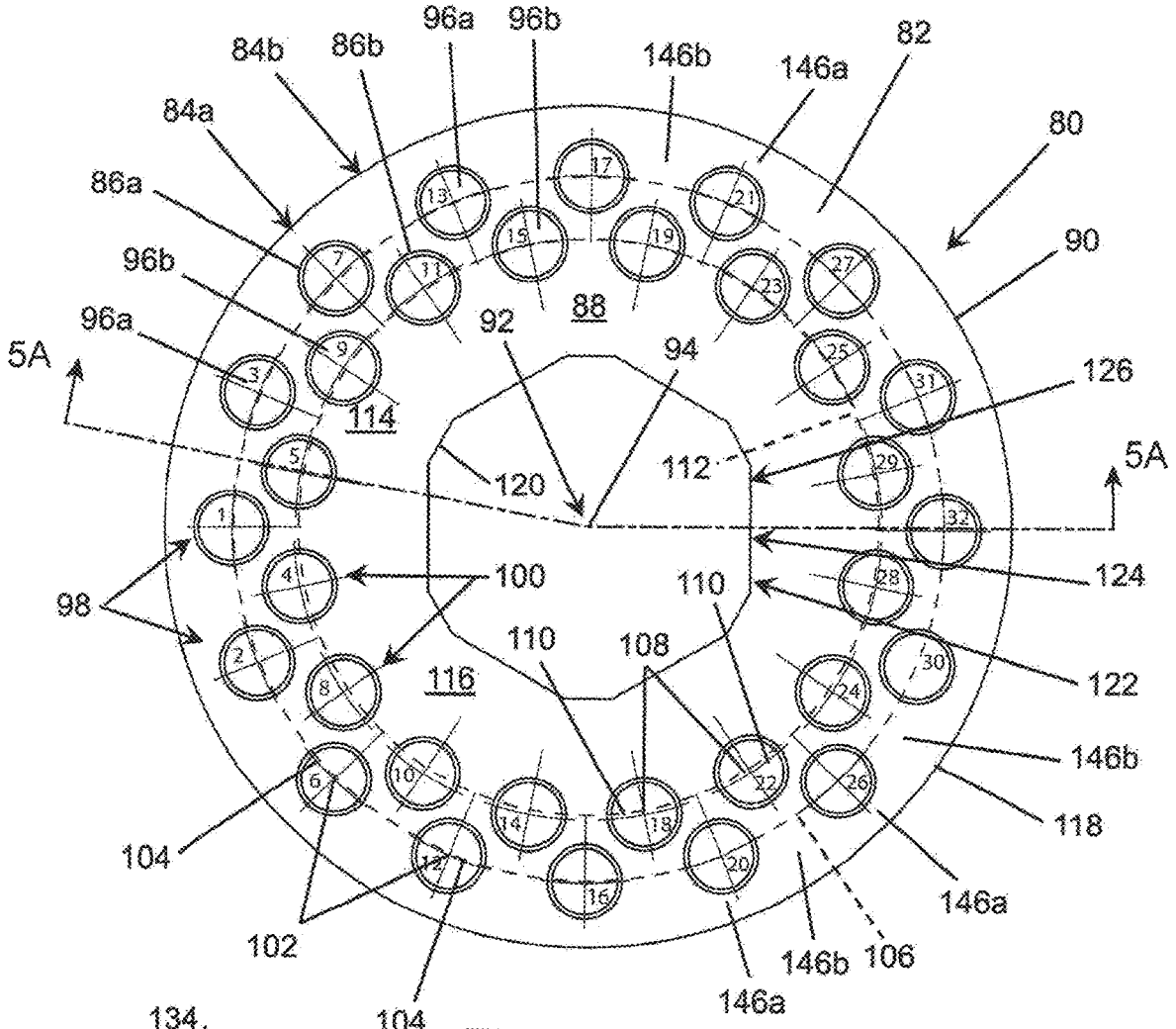
FIG. 4A is a plan view of a rotary radial brush center disc hub of the present invention having 32-holes of an offset hole configuration where the brush wire tuft anchoring holes are alternatingly staggered two different radial distances from the center of the hub.
Figure 5A:
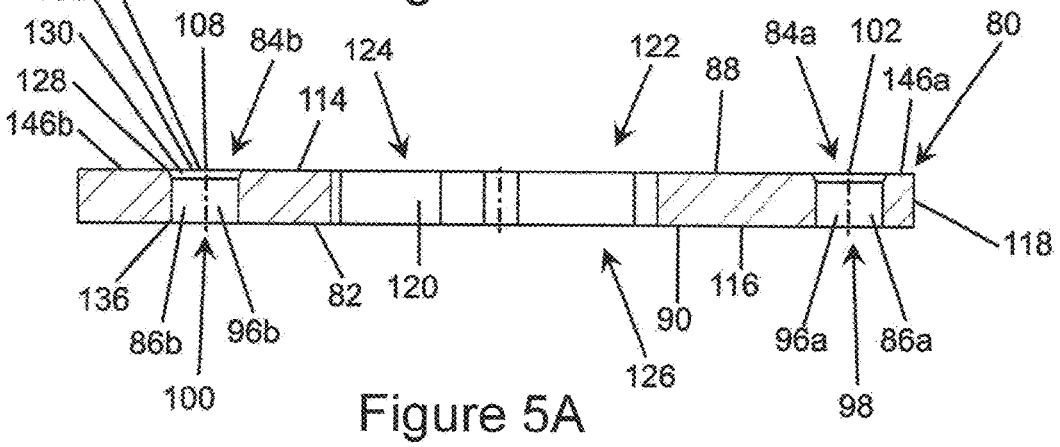
FIG. 5A is a cross-sectional view of the hub of FIG. 4A taken through line 5A-5A of FIG. 4A.
Figure 6A:
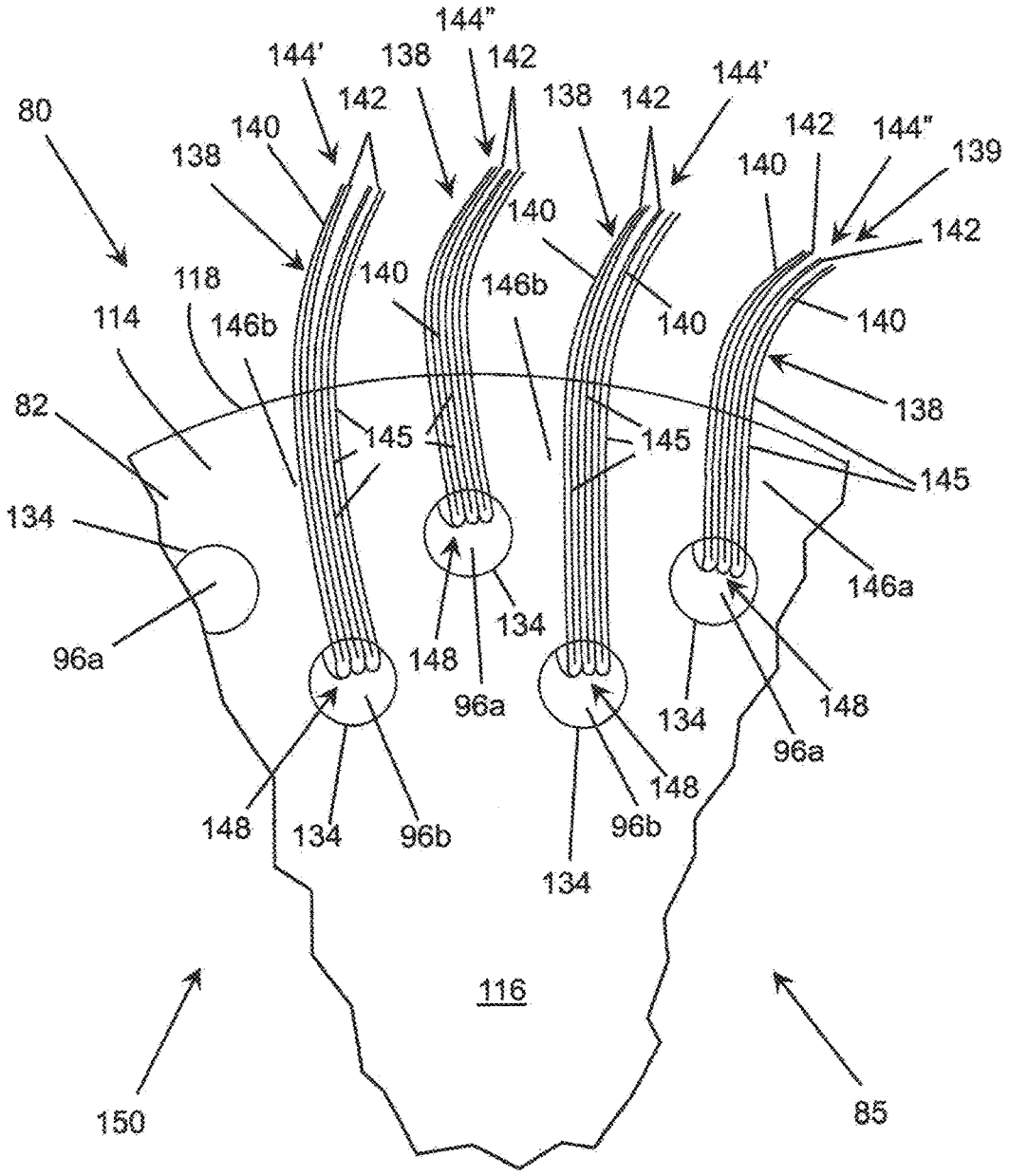
FIG. 6A is an enlarged fragmentary view of a portion of a rotary brush center disc hub constructed in accordance with the present invention configured with alternatingly radially staggered brush wire tuft anchoring holes from which multiwire brush wire tufts extend radially outwardly from each one of four of the brush-wire tuft anchoring holes in the hub.

FIGS. 4A, 5A and 6A illustrate a rotary radial wire brush disc-shaped center hub 80 constructed in accordance with the present invention that is formed of a generally circular metal disc or plate 82 preferably made of hot rolled steel having a suitably high toughness, a desirably durable surface finish, and a hardness of at least 50 Rockwell B. As depicted in FIGS. 4A and 6A, the hub 80 has at least a plurality of pairs of, i.e., at least three, circumferentially spaced apart and radially offset brush wire tuft holding apertures 86*a* and 86*b* with respective brush wire tuft anchors 84*a* and 84*b* disposed radially outwardly thereof. The circular metal disc or plate 82 of the hub 80 includes or is formed of an annular body or platter 114 with annular webbing 116 extending radially inwardly from the apertures 86*a* and 86*b* to a radially inner peripheral edge 120 of the hub 80 that can and preferably does define at least part of a mount 122 that preferably is in the form of a generally hexagonal rotary prime mover or tool coupling 124 of a rotary radial wire brush 85 (FIG. 6A) constructed with the hub 80 that can be a generally centrally disposed arbor hole 126 or the like.

A rotary radial wire brush 85 (FIG. 6A) of the present invention made with such a hub 80 constructed in accordance with the present invention can have or be configured with a different type of mounting or coupling arrangement, such as one employing a coupling nut, a coupling ring, a twist-lock coupling, a spindle lock coupling, or another type of coupling arrangement for removably fixing the brush 85 and/or hub 80 to an electrically or pneumatically powered rotary prime mover that can be a rotary power tool, such as a grinder, drill, drill press, or another type of rotary drive. Such a brush 85 made with a hub 80 constructed in accordance with the present invention is capable of being rotated by such a rotary prime mover or rotary drive at rotational speeds of at least 500 revolutions per minute (RPM), preferably at least 5000 RPM, and more preferably at least 10000 RPM or even faster. A preferred rotary radial wire brush 85 configured in accordance with the present invention has a maximum safe free speed of at least 15000 RPM and more preferably at least 20000 RPM and can therefore be rotated at typical maximum grinder speeds of between 10000-15000 RPM. In at least one preferred embodiment, a rotary radial wire brush 85, e.g., wheel brush or power brush, constructed with such a hub 80 in accordance with the present invention has a maximum safe rotational brush speed of no less than 15000 RPM and no greater than 25000 RPM and preferably has a maximum safe rotational speed of about 20000 RPM. In at least one preferred embodiment, a rotary radial wire brush 85, e.g., wheel brush or power brush, constructed with such a hub 80 in accordance with the present invention can be rotated at rotational speeds of greater than 25000 RPM, more preferably at rotational speeds of greater than 35000 RPM and more preferably at rotational speeds of greater than 50000 RPM.

With reference once again to FIGS. 4A and 6A, each one of the apertures 86*a* and 86*b* preferably is a circular or round brush wire tuft seating through-hole 96*a* and 96*b* that each extends generally in an axial direction completely through oppositely outwardly facing surfaces 88, 90 and a body or platter 114 of the hub 80. As also shown in FIGS. 4A and 6A, each one of the brush wire tuft holding apertures 86*a* and 86*b*, preferably circular or round brush wire tuft seating holes 96*a* and 96*b*, are generally equiangularly circumferentially spaced apart about substantially the entirety of the circular body or platter 114 of the hub 80 with each one of the apertures 86*a*, preferably holes 96*a*, radially staggered relative to each adjacent one of the apertures 86*b*, preferably holes 96*b* producing a hub 80 of the present invention used in the manufacture of a rotary radial wire brush 85, preferably a wheel wire brush, e.g., a power brush, constructed in accordance with the present invention as discussed in more detail below.

With continued reference to FIGS. 4A and 6A, a preferred hub 80 constructed in accordance with the present invention is of an offset hole configuration having at least 32 wire-tuft anchoring apertures 86*a* and 86*b*, preferably circular or round holes 96*a* and 96*b*, generally equiangularly spaced apart about a circumference of the hub 80 and which are alternatingly spaced at least a plurality of different radial distances from a center 92 of the hub 80 that preferably also is substantially coincident with a center axis of rotation of a brush 85 of the present invention made with the hub 80. One particularly preferred hub 80 of the present invention has exactly 32 apertures 86*a* and 86*b* each of which preferably respectively are generally circular or round holes 96*a* and 96*b* that are equiangularly spaced apart two different radial distances from the hub center 92 or brush rotational axis 94 producing a hub 80 of 32-hole radially offset hole construction or configuration. As best shown in FIG. 4A, the 32 apertures 86*a* and 86*b*, preferably 32 holes 96*a* and 96*b*, of hub 80 are equiangularly circumferentially spaced apart and arranged in such a radially staggered offset configuration where every other aperture 86*a*, preferably hole 96*a*, is radially offset from every aperture 86*b*, preferably hole 96*b*, adjacent thereto. Such a 32-hole offset hole configured hub 80 thereby has two different sets 98, 100 of the apertures 86*a* and 86*b* or holes 96*a* and 96*b* with two different radial spacings from the hub center 92 and/or rotational brush axis 94 with one set 98 of the apertures 86*a* or holes 96*a* being radially outermost disposed from or relative to the hub center 92 or brush rotation axis 94 and the other set 100 of the apertures 86*b* or holes 96*b* being radially innermost disposed from or relative to the hub center 92 or rotational axis 94.

As best shown in FIG. 4A, the first set 98 of the circular holes 96*a* formed in hub 80 are spaced a first distance from the hub center 92 or rotational axis 94 that is greater than a second set 100 of the round holes 96*b* that are radially spaced a second lesser radial distance from hub center 92 or axis 94. As depicted in FIG. 4A, apertures 86*a*, and/or holes 96*a* of the first or radially outermost spaced set 98 are equiangularly and circumferentially spaced an equal distance apart from each other having centers 102 and radial circumferentially extending center lines 104 lying along a first common circle 106 having a first radially outermost disposed radius from hub center 92 or brush rotational axis 94. With continued reference to FIG. 4A, the apertures 86*b*, and/or holes 96*b* of the second or radially innermost spaced set 100 are also equiangularly and circumferentially spaced an equal distance apart from each other having centers 108 and radial circumferentially extending center lines 110 lying along a second common circle 112 having a second radially innermost disposed radius from hub center 92 or brush rotational axis 94 that is less than the first radius of circle 106. As is also depicted in FIG. 4A, the first and second sets 98, 100 are substantially coaxial as are circles 106, 112.

With reference to FIGS. 4A and 5A, the brush tuft anchors 84*a* and 84*b* are respectively formed by corresponding aperture 86*a* and 86*b*, preferably by corresponding hole 96*a* and 96*b*, and includes a respective portion of the body or platter 114 of the hub 80 that is or includes a corresponding margin 146*a* and 146*b* extending radially outwardly from at or adjacent aperture 86*a* and 86*b*, preferably hole 96*a* and 96*b*, to at or adjacent the radially outermost edge 118 of the hub 80. As with the apertures 86*a* and 86*b* and/or holes 96*a* and 96*b*, brush tuft anchors 84*a* and 84*b* are equiangularly circumferentially spaced apart about the hub 80 with each one of the brush tuft anchors 84*a* and 84*b* disposed radially outwardly of respective apertures 86*a* and 86*b* and/or holes 96*a* and 96*b*. Brush tuft anchors 84*a* and 84*b* respectively provide a corresponding portion of the disc-shaped body or platter 114 of the hub 80, including margin 146*a* and 146*b* extending radially outwardly to the outer hub edge 118, for a brush wire tuft 138 received in each aperture 86*a* and 86*b* or seated in each hole 96*a* and 96*b* to wrap around, loop around, and/or be twisted around, such as via a twisted knot 148, or another suitable brush wire anchoring arrangement, configuration or method used to anchor brush wire tufts 138 to hub 80. As apparent from FIG. 4A, hub 80 has the same number of brush anchors 84*a* and 84*b* as apertures 86*a* and 86*b* or holes 96*a* and 96*b*. Where hub 80 is configured with 32 radially offset apertures 86*a* and 86*b* or holes 96*a* and 96*b*, the hub 80 also has 32 brush anchors 84*a* and 84*b* spaced apart about the outer periphery of the hub 80 with anchors 84*a* having a shorter radial extent or smaller margin 146*a* than the larger radial extent or greater margin 146*b* of anchors 84*b*.

As discussed in more detail below, such a hub 80 is constructed with at least 32 brush wire tuft anchors 84*a* and 84*b* which preferably respectively include at least 32 apertures 86*a* and 86*b* arranged in an offset aperture configuration that enables a greater number of apertures 86*a* and 86*b* to be employed for a hub 80 of a given diameter as compared to a conventional hub of the same diameter. A preferred rotary radial brush 85 constructed with such a hub 80 of offset aperture construction preferably is configured or formed with exactly 32 brush wire tuft anchors 84*a* and 84*b* that operably cooperate with 32 respective brush wire tuft holding apertures 86*a* and 86*b* arranged in a radially offset configuration to advantageously enable a radial brush 85 of the present invention to be produced with brush wire tufts 138 each having at least a plurality of pairs of, i.e., at least three, elongate folded and/or twisted brush wire filaments 145 that form at least 29 brush wires 140, preferably at least 30 wires 140, extending radially outwardly from each aperture 86*a* and 86*b* and which are anchored to hub 80 by respective anchor 84*a* and 84*b*.

As discussed in more detail below, a rotary radial wire brush 85, e.g., wheel wire brush or power brush, produced with such a hub 80 having a radially offset 32-hole configuration with 32 apertures 86*a* and 86*b*, each of which preferably are circular or round holes 96*a* and 96*b* radially offset in the manner depicted in FIGS. 4A, 5A and 6A that each have an elongate radial brush wire tuft 138 of multiwire construction with at least 29 brush wires 140 per tuft 138 and which has about 30 wires 140 per wire tuft 138 (30±1 bristles per tuft). In one preferred brush and hub embodiment, each brush wire tuft 138 is formed of enough filaments 145 to produce a wire tuft 138 having at least 29 wires 140 per wire tuft 138 and which preferably has at least about 30 wires 140 per tuft 138. In one such preferred brush and hub embodiment, each brush wire tuft 138 is formed of at least 15 elongate brush wire filaments 145 that extend through each hole 96*a* and 96*b* in the hub 80 and which are anchored, such as via a twisted knot 148, to corresponding anchor 84*a* and 84*b*, such that each wire tuft 138 has at least 30 wires 140 extending radially beyond the outer peripheral edge 118 of the hub 80. In another such preferred brush and hub embodiment, each one of the 32 holes 96*a* and 96*b* of the hub 80 arranged in a radially offset configuration has an elongate brush wire tuft 138 extending radially outwardly therefrom that is formed of exactly 15 wire filaments 145 such that each brush wire tuft 138 has exactly 30 bristles or wires 140 that extend radially outwardly beyond the outer peripheral hub edge 118.

With reference once again to FIG. 6A, such an assembly 150 of a 32-hole radially offset hub 80 and brush wire tufts 138 advantageously produces a rotary wire brush 85 constructed in accordance with the present invention having a higher material removal rate and which preferably advantageously also maintains such a high or higher material removal rate for a longer period of time as compared to conventional prior art brushes made with a conventional prior art hub of the same diameter equipped either with a 32 hole circumferentially aligned hole pattern or a 30 hole radially offset hole pattern. As such, the performance of such a rotary radial wire brush 85 of the present invention made of such a hub and wire assembly 150 of a radially offset 32-hole hub 80 constructed in accordance with the present invention with each hole 96*a* and 96*b* having a 30-bristle or 30-wire brush wire tuft 138 extending radially outwardly therefrom radially outwardly beyond the outer peripheral hub edge 118 is unexpectedly significantly better than expected.

FIG. 5A depicts a cross section of the hub 80 taken along line 5A-5A of the hub 80 shown in FIG. 4A that extends (a) through one of the radially outermost apertures 86*a* or holes 96*a* and corresponding brush anchor 84*a*, and (b) through one of the radially innermost apertures 86*b* or holes 96*b* and corresponding brush anchor 84*b*. As is also shown in FIG. 5A, where the brush anchors 84*a* and 84*b* operatively cooperate with apertures 86*a* and 86*b* that are round or circular holes 96*a* and 96*b* in receiving and retaining a brush wire tuft 138 anchored thereto, at least one and preferably both hole corner edges 134 and/or 136 is configured with a brush wire contact surface area increasing stress relief 128 formed of or by a diametrically enlarging bevel 130 produced by a chamfer 132 extending about at least one of the top or bottom peripheral hole edges 134 and/or 136. While only the top or upper peripheral hole edge 134 of each one of the holes 96*a* and 96*b* of the hub 80 of FIG. 5A is shown as being configured with such a brush wire contact surface area increasing stress relief 128 formed of a hole entrance diameter enlarging bevel 130, such as produced by a chamfer 132, a preferred embodiment of such a hub 80 constructed in accordance with the present invention can and preferably does have both hole edges, i.e., top and bottom edges 134 and 136, of each hole 96*a* and 96*b* so configured. As discussed in more detail below, such a stress-relieving and/or brush wire contact surface area increasing hole arrangement can advantageously extending brush life as well as facilitate including one or more additional brush wires 140 in each brush wire bundle or tuft 138 of a rotary radial brush constructed with such a hub 80 configured in accordance with the present invention.

With continued reference to FIG. 6A, the hub 80 depicted in FIGS. 4A and 5A has a brush wire tuft 138 extending outwardly from every hole 96*a* and 96*b* and which is anchored to the hub 80 via corresponding brush anchor 84*a* and 84*b*, such as via twist knot anchoring. Where anchored to each brush anchor 84*a* and 84*b* using a twisted knot 148 or the like, portions of the elongate filaments 145 that form the wires 140 of each wire tuft 138 extend radially outwardly beyond the outer hub radial peripheral edge 118 with the tips 142 at the free ends of the wires 140 defining an abrasive brush wire face 144. Each brush wire tuft 138 preferably is of metal or metallic construction with each wire tuft 138 made of filaments 145 preferably composed of steel, such as a high carbon steel, stainless steel, or another steel suitable for use in wire brushes as known in the industry.

During surface finishing operation, the abrasive face 144 formed of the tips 142 of the wires 140 of each wire tuft 138 of the rotating brush 85 depicted in FIG. 6A contacts and abrades a surface to be finished abrasively by abrasively removing material therefrom. A preferred rotary radial wire brush embodiment constructed in accordance with the present invention has at least 29 wires 140, preferably has about 30 wires 140 (30±1 wires per wire tuft 138), and more preferably has exactly 30 bristles or wires 140 per wire tuft 138 attached or otherwise anchored to the hub 80 via a corresponding one of the brush anchoring holes 96*a* and 96*b* and/or brush anchors 84*a* and 84*b*. The filaments 145 of each wire tuft 138 extend through each one of the holes 96*a* and 96*b* in the hub 80 and are anchored by wrapping and/or twisting the filaments 145 around a respective brush-wire anchor forming margin 146*a* and 146*b* of the hub 80 that extends radially outwardly between corresponding hole 96*a* and 96*b* and radially outermost peripheral edge of the hub 80 and defines respective brush anchors 84*a* and 84*b* of the hub 80. The filaments 145 of each brush wire tuft 138 extend through each respective one of the holes 96*a* and 96*b* in the hub 80 and are wrapped around the corresponding margin 146*a* and 146*b* of a respective one of the brush anchors 84*a* and 84*b*, such as using a conventional twisted knot 148, such that the portions of the filaments 145 of each wire tuft 138 that extend radially outwardly of the outer peripheral hub edge 118 define a radially outwardly extending twisted wire tuft 139 of wires 140 that are twisted in the manner depicted in FIG. 6A.

With continued reference to FIG. 6A, a preferred rotary radial brush 85 constructed with a hub 80 of the present invention is depicted in FIGS. 4A, 5A, and 6A having 32 round or circular brush-anchoring holes 96*a* and 96*b* of a radially offset configuration each with a brush wire tuft 138 having 30 bristles or wires 140 formed respectively of 15 elongate filaments 145 attached or anchored thereto using a conventional twisted knot 148 that twisted or otherwise secured about the corresponding margin 146*a* and 146*b* of respective brush anchor 84*a* and 84*b* with the 30 wires 140 of each wire tuft 138 extending radially outwardly beyond the outer peripheral edge 118 of the hub 80. Such a hub 80 having an increased number of holes 96*a* and 96*b*, namely 32 of the holes 96*a* and 96*b*, of a staggered radially offset configuration advantageously enables a portion of the longer wires 140 and/or filaments 145 of wire tufts 138 extending from the radially inwardly offset holes 96*b* to be supported on either side by the brush anchor knot 148 and/or the wires 140 or filaments 145 of the wire tuft 138 extending from adjacent pairs of radially outwardly offset holes 96*a* thereby helping produce an abrasive wire face 144' that can be and preferably is larger in size or contact surface area. Such a hub 80 having an increased number of holes 96*a* and 96*b*, namely 32 holes 96*a* and 96*b*, of a staggered radially offset configuration advantageously enables the shorter wires 140 of the bundles or tufts 138 extending from the radially outwardly offset holes 96*a* to remain more tightly bundled together, preferably more tightly twisted together, maintaining a more tightly bundled and smaller abrasive wire face 144" that more aggressively removes material during brush rotation during surface finishing use and operation of the brush. Where this is the case, brush wire bundles 138 of the radially inwardly offset holes 96*b* equipped with longer brush wires 140 that produce a larger abrasive brush face 144' removes material over a wider swath or area of the surface being finished, and the brush wire bundles 138 of the radially outwardly offset holes 96*a* equipped with shorter brush wires 140 and a smaller abrasive brush face 144" removes material more aggressively advantageously producing a rotary brush in accordance with the present invention having an optimal blend of aggressive surface removal and surface area coverage. FIG. 6A shows that the abrasive wire face 144' of such longer brush wire tufts 138 that extend radially outwardly from radially inwardly offset holes 96*b* have a larger abrasive wire face 144' than the abrasive wire face 144" of each shorter wire extending radially outwardly from radially outwardly offset holes 96*a*.

A rotary brush, e.g., brush 85, constructed in accordance with the present invention having such a hub 80 with 32 radially offset holes 96*a* and 96*b* each anchoring a radially outwardly brush wire tuft 138 having about or exactly 30 elongate brush wires 140 formed of about or exactly 15 brush wire filaments 145 advantageously outperforms the aforementioned prior art rotary brushes with the aforementioned conventional prior art hubs by removing more material per minute of abrasive surface finishing time, by possessing a greater brush life all while also having good to excellent cutting material removal per minute of rotary brush operation. Such a rotary brush, e.g., brush 85, constructed in accordance with the present invention having such a hub 80 with 32 radially offset holes 96*a* and 96*b* each anchoring a radially outwardly brush wire tuft 138 having exactly 30 elongate brush wires 140 formed of or from exactly 15 brush wire filaments 145 advantageously possesses an optimum combination of long life and abrasive material rate characteristics compared to the prior art.

TABLE 1 below provides comparative test data for (a) a rotary radial wire brush, e.g., brush 85 shown in FIG. 6A, of the claimed invention having a hub 80 with 32 holes 96*a* and 96*b* of an offset hole configuration having a brush wire tuft 138 formed of 30 bristles or wires 140, (b) applicant's prior art rotary radial wire brush with a hub with 30 holes of an offset configuration with each hole having a brush wire with 30 bristles or wires 140, (c) applicant's prior art rotary radial wire brush with a hub with 32 holes of a circumferentially aligned slotted configuration with each hole having a brush wire with 30 bristles or wires 140, (d) a competitor's prior art rotary radial wire brush with a hub with 32 holes of a circumferentially aligned slotted configuration with each hole having a brush wire with 28 bristles or wires 140, and (e) applicant's prior art rotary radial wire brush with a hub with 30 holes of an offset configuration with each hole having a brush wire with 23 bristles or wires 140.

TABLE 1

| Radial Brush Configuration | Removal (grams) @ 60% Wire Loss | Life (minutes) @ 60% Wire Loss | Cut (mg) g - ratio per minute @ 60% Wire Loss |
|---|---|---|---|
| Invention 32/30 32 Hole Offset w 30 Wires per Hole (INVENTION A) | 5.68 grams | 1,290.00 minutes | 109.44 mg/min. |
| Osborn 30/30 30 Hole Offset w 30 Wires per Hole (PRIOR ART B) | 4.27 grams | 980.00 minutes | 113.06 mg/min. |
| Osborn 32/30 32 Hole Slotted w 30 Wires per Hole (PRIOR ART C) | 4.58 grams | 880.00 minutes | 106.50 mg/min. |
| Competitor 32/28 32 Hole Slotted w 28 Wires per Hole (PRIOR ART D) | 5.51 grams | 726.67 minutes | 84.29 mg/min. |
| Osborn 30/23 30 Hole Offset w 23 Wires per Hole (PRIOR ART E) | 5.61 grams | 356.67 minutes | 141.82 mg/min. |

As shown in TABLE 1 above, a rotary steel wire brush, e.g., brush 85 of FIG. 6A, in accordance with the present invention made with a hub 80 with a 32-offset hole configuration and a conventional twisted knot wire tuft 138 having at least 30 wires 140 per hole 96*a* and 96*b* has the highest amount of material removal of 5.68 grams before reaching 60% brush wire loss, has a very good rate of abrasive material removal of 109.44 milligrams per minute of rotary brush operation at 60% brush wire loss, and possesses the longest brush life of about 21.5 hours before reaching 60% brush wire loss. In fact, a rotary steel wire brush in accordance with the present invention made with a hub 80 with a 32-offset hole configuration and at least 30 wires 140 or 30 bristles per hole 96*a* and 96*b* possesses at least 30% greater brush life than the next longest-lived prior art brush, PRIOR ART B, removes at least 30% more material before reaching 60% wire loss than the next longest-lived prior art brush, PRIOR ART B, while having nearly the same material removal rate at 60% wire loss as the next longest lived prior art brush, PRIOR ART B.

While a rotary radial wire brush constructed with such a hub 80 having a 32 hole offset hole configuration with each twisted knot wire bundle or tuft 138 being formed with at least 29 wires 140 per wire tuft 138 and preferably having at least 30 wires 140 or 30 bristles per wire tuft 138 radially extending from each one of its holes 96*a* and 96*b* has an optimal combination of long brush life and material removal, a rotary radial wire brush constructed in accordance with the present invention can be and preferably is further configured or additionally constructed with one or more of the additional novel and inventive features and improvements discussed in more detail below.

Figure 4B:
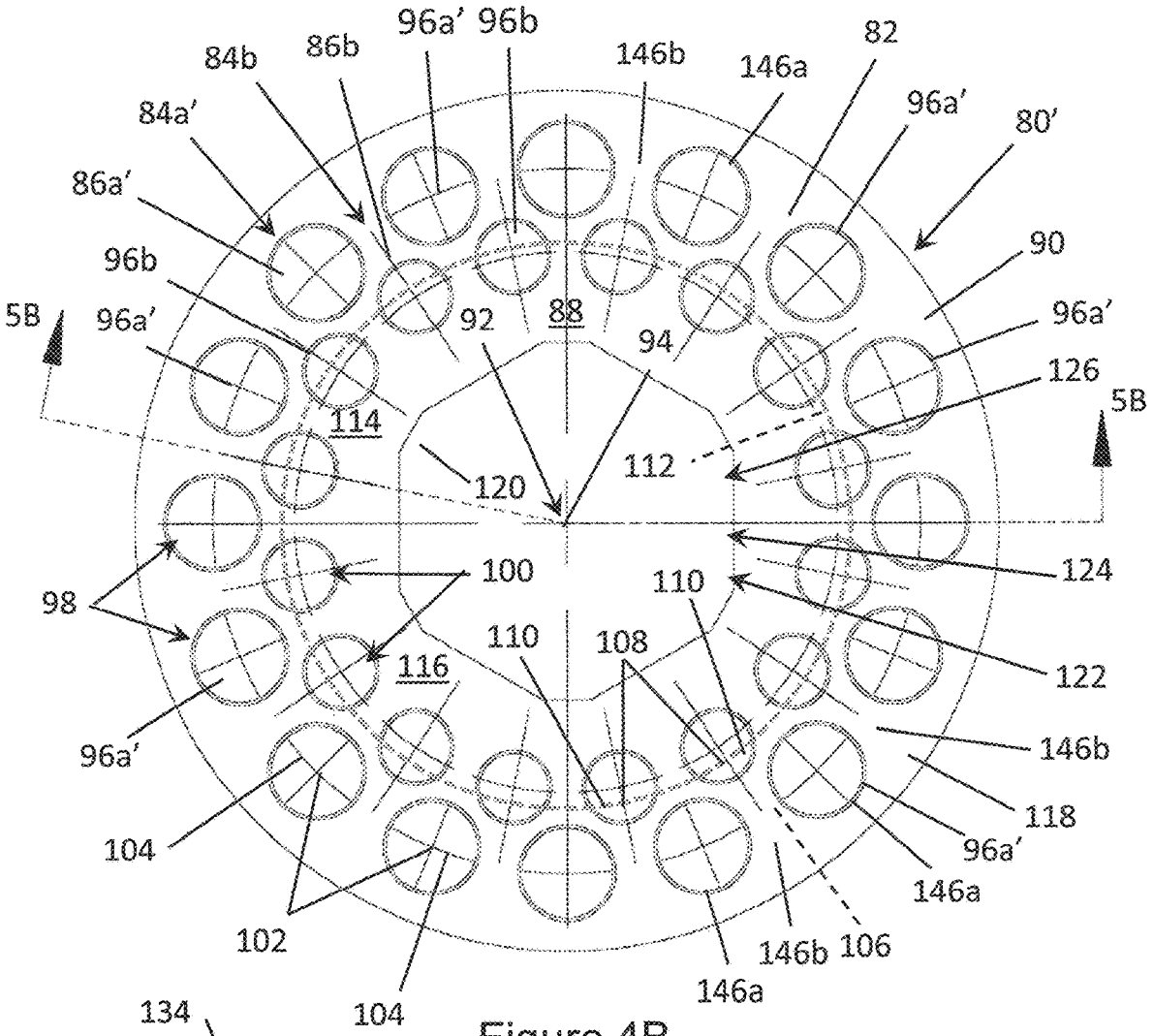
FIG. 4B is a plan view of a rotary radial brush center disc hub of the present invention having 32-holes of an offset hole configuration where the brush wire tuft anchoring holes are alternatingly staggered two different radial distances from the center of the hub with the radially outermost anchoring holes larger than the radially innermost anchoring holes.
Figure 5B:
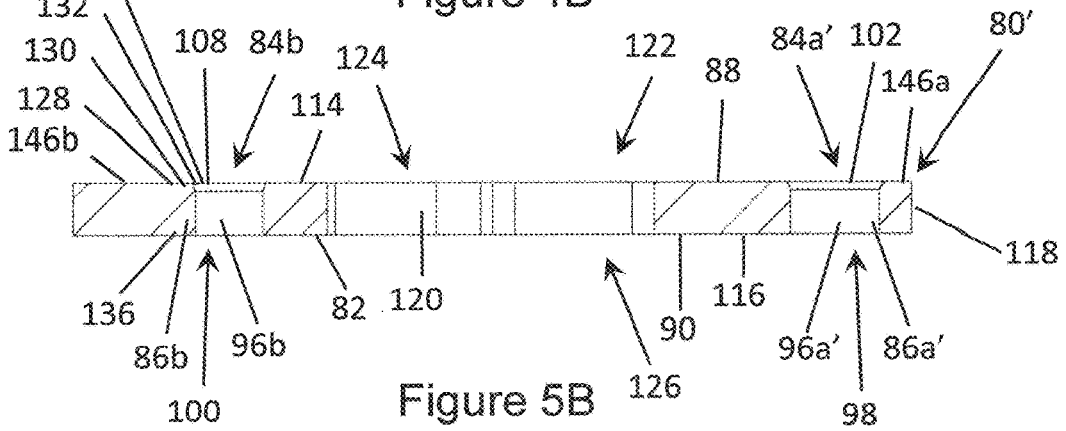
FIG. 5B is a cross-sectional view of the hub of FIG. 4B taken through line 5B-5B of FIG. 4B.

The rotary brush center hub 80' depicted in FIGS. 4B and 5B are similar in construction to the hub 80 shown in FIGS. 4A and 5A except for the radially outermost brush wire tuft anchoring holes 96*a*' being larger in size than the radially innermost brush wire tuft anchoring holes 96*b*. In the preferred hub embodiment depicted in FIGS. 4B and 5B, radially outermost tuft anchoring holes 96*a*' are larger in width and/or diameter than radially innermost tuft anchoring holes 96*b*. The use of such larger tuft anchoring holes 96*a*' increase the flexibility of brush wire tufts 138 extending outwardly therefrom increasing workpiece surface finishing quality, preferably by increasing polishing of a workpiece surface engaged by a rotating rotary brush made with such a hub 80'.

A wheel brush or rotary radial wire brush 85 constructed in accordance with the present invention can be constructed having a four inch brush size or diameter, a five inch brush size or diameter, or a seven inch brush size or diameter with the hub 80 preferably having 32 brush wire tuft anchoring holes 96*a* and 96*b*, but which can be configured with between twenty-eight and seventy-two holes 96*a* and 96*b* with each one of the brush wire tufts 138 composed of between twenty and forty stainless steel and/or carbon steel brush wires 140 per tuft 138 having brush wire diameters ranging between 0.008 inches and 0.035 inches. A four-inch diameter size wheel brush or rotary radial brush of the invention has a center disc or hub 80 with between 22 and 42 alternating radially offset or staggered tuft anchoring or mounting holes 96*a* and 96*b* formed therein having a brush wire tuft 138 extending radially outwardly from each one of the holes 96*a* and 96*b* arranged with a plurality of different trim lengths providing a four-inch brush with between 22 and 42 radially offset holes 96*a* and 96*b* and between 22 and 42 radially offset trim brush wire tufts 138.

Figure 6B:
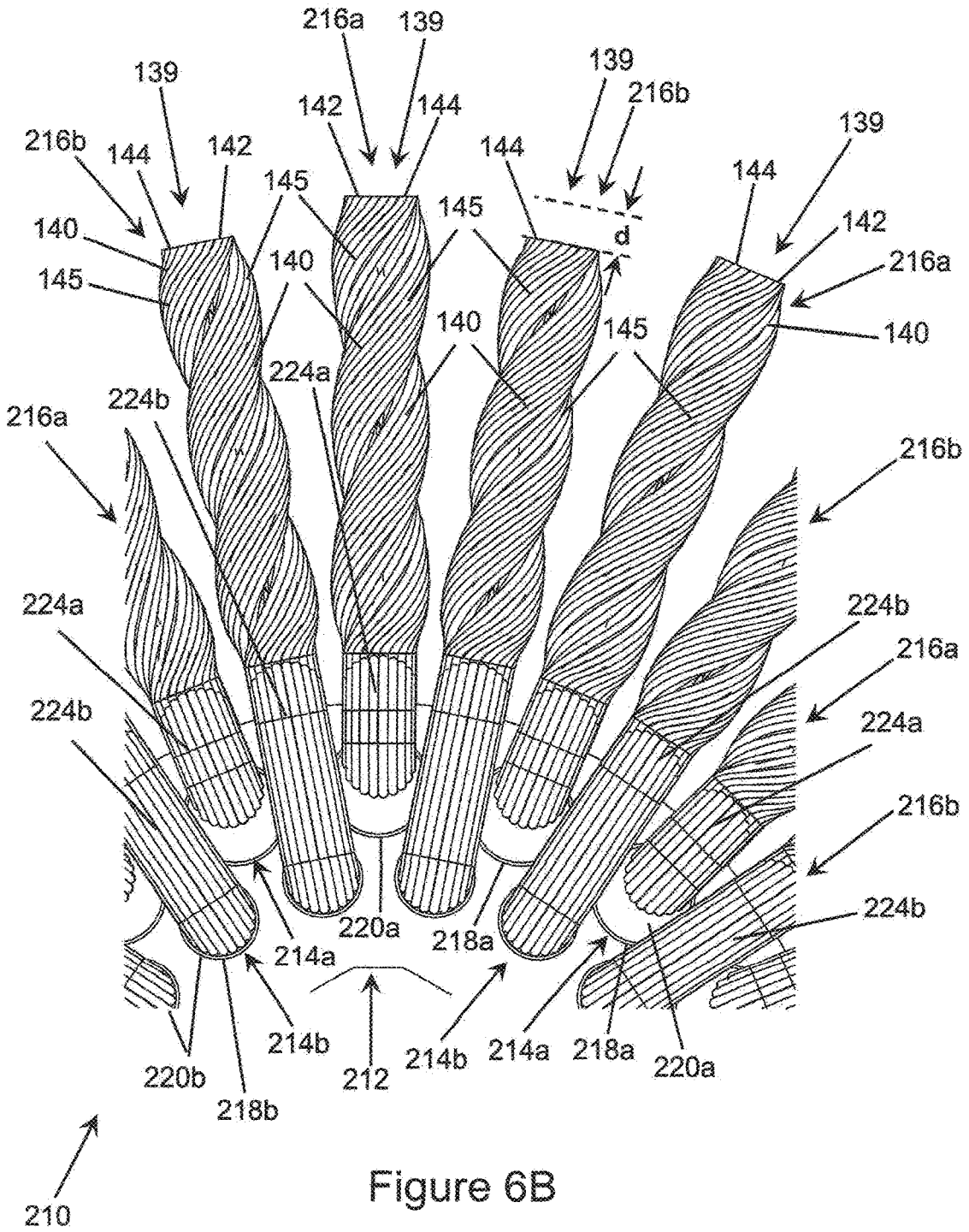
FIG. 6B is an enlarged fragmentary view of a portion of another rotary brush center hub constructed in accordance with the present invention having a set of radially outer brush-wire tuft anchoring holes larger in size than a set of radially inner brush wire tuft anchoring holes with elongate wire brush tufts arranged in a staggered trim configuration extending radially outwardly therefrom.
Figure 21:
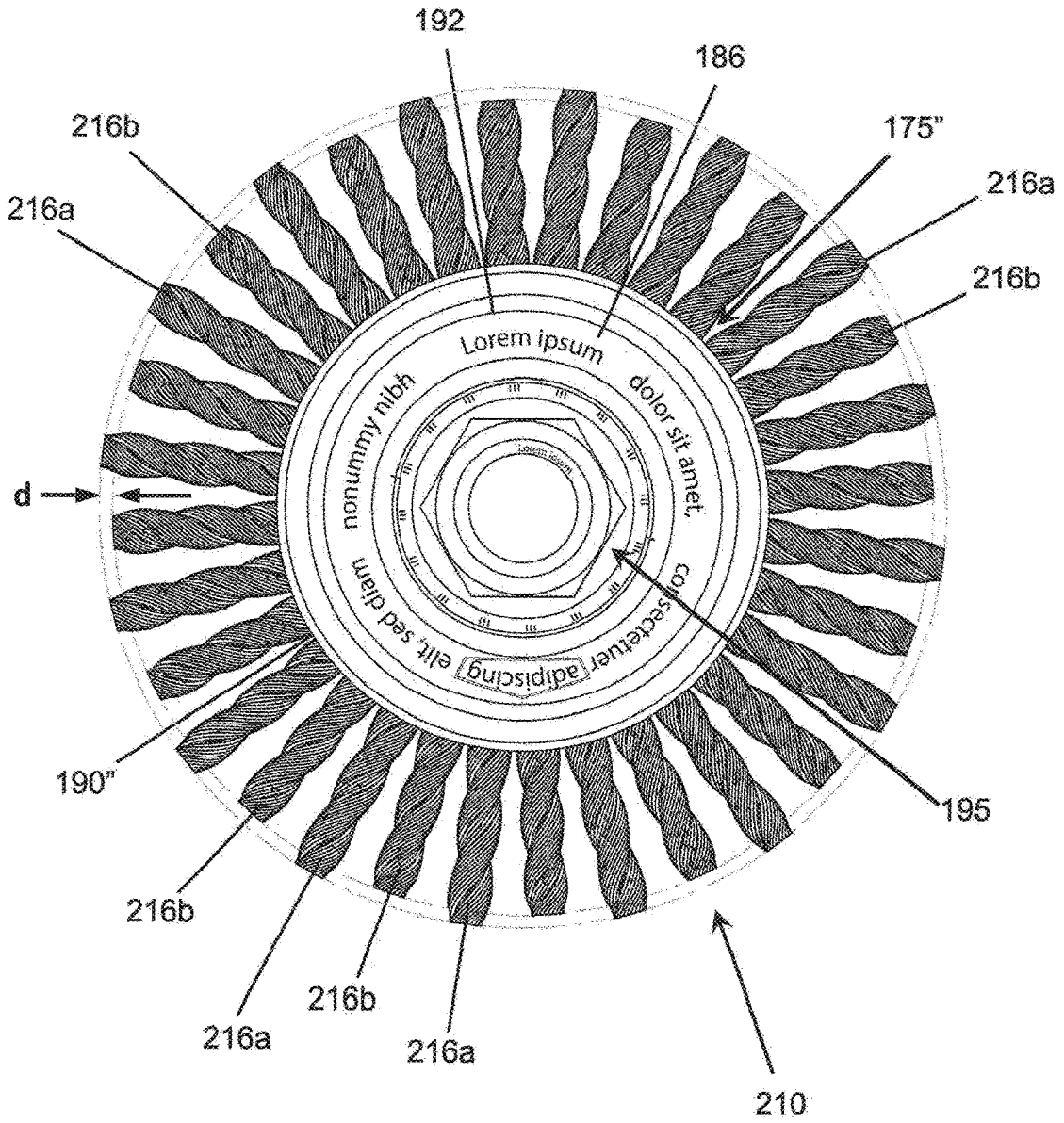
FIG. 21 is a top plan view of a preferred embodiment of a rotary radial wire brush of the present invention made with the central disc hub shown in FIG. 6B producing alternating brush wires that extend radially outwardly from the hub different lengths having different trim lengths as depicted in FIG. 21.

A preferred four-inch wheel or rotary radial brush is configured with between twenty-eight and thirty-four holes 96*a* and 96*b* with each hole 96*a* and 96*b* having a brush wire tuft 138 extending radially outwardly from it such that the brush has the same number of tufts 138 as the number of holes 96*a* and 96*b*. In a preferred embodiment, each tuft 138 is composed of between 20 and 40 stainless or carbon steel wires 140 having wire diameters of between 0.008 inches and 0.035 inches and each tuft 138 can be formed of (a) a plurality of wires 140 twisted, braided, or twisted and braided to form the tuft 138, and/or (b) a plurality of strands each formed of a plurality of wires 140 twisted, braided, or twisted and braided to form a strand of the tuft 138. The shape of the holes 96*a* and/or 96*b* can be circular or oblong, such as by being oval or elliptical, e.g., an ellipse, in shape. The holes 96*a* and 96*b* of the center hub 80 of the brush have a pair of sets of holes 96*a* arranged so the holes 96*a* of one set are alternatingly radially offset or radially staggered relative to the holes 96*b* of the other set and can be configured such that the holes 96*a* one of the sets of holes, preferably the radially outermost holes 96*a*, are larger in size, e.g., longer, larger in width, and/or larger in diameter, than the holes 96*b* of the other one of the sets of holes 96*b*. Each brush preferably is configured with at least one, preferably at least a plurality, more preferably at least a plurality of pairs, i.e., at least three, of its brush wire tufts 138 having an offset trim with a preferred brush embodiment configured with every other tuft having a trim length shorter than the trim length of an adjacent tuft, such as depicted in FIGS. 6B and 21. In a preferred brush embodiment, the alternatingly staggered brush wire tuft anchoring holes 96*a* and 96*b* can impart or help impart corresponding alternating brush wire tufts 138 with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

A five-inch diameter size wheel brush or rotary radial brush of the invention has between 25 and 65 alternating radially staggered or offset tuft mounting holes 96*a* and 96*b* formed in its center hub 80 with a brush wire tuft 138 extending radially from each hole 96*a* and 96*b* with a preferred five-inch diameter brush having between 56 and 60 alternating radially staggered or offset holes 96*a* and 96*b* and the same amount of tufts 138 with a tuft 138 extending radially from each hole 96*a* and 96*b*. In one preferred five-inch brush, the brush has a center hub 80 configured with about 56 tuft mounting holes 96*a* and 96*b* in an alternating radially staggered or offset arrangement forming a pair of sets of holes with one set of holes spaced the same distance away from but radially closer to a center of the hub 80 than the other one of the sets of holes with the brush having about 56 tufts 138 as the brush has the same number of tufts as holes with a tuft 138 extending radially from each one of the holes 96*a* and 96*b*. In a preferred embodiment, each tuft 138 is composed of between 20 and 40 stainless or carbon steel wires 140 having wire diameters of between 0.008 inches and 0.035 inches and each tuft 138 can be formed of a plurality of pairs, i.e., at least three, of twisted strands, braided strands, or twisted and braided strands each composed of at least a plurality of pairs, i.e., at least three, of the wires 140. The shape of the holes 96*a* and 96*b* can be circular or oblong such as by being oval or elliptical, e.g., an ellipse, in shape. The holes 96*a* and 96*b* of the center hub 80 of the brush have a pair of sets of holes arranged so the holes of one set are alternatingly radially offset or radially staggered relative to the holes of the other set and can be configured such that the holes of one of the sets of holes is larger in size, e.g., longer, larger in width, or larger in diameter, than the holes of the other one of the sets of holes. Each brush preferably is configured with at least one, preferably at least a plurality, more preferably at least a plurality of pairs, i.e., at least three, of its brush wire tufts 138 having an offset trim, like the offset trim wire tufts depicted in FIGS. 6B and 21 and in the double-stringer brush depicted in FIGS. 22-24 with a preferred brush embodiment configured with every other tuft having a trim length shorter than the trim length of an adjacent tuft. In a preferred brush embodiment, the alternatingly staggered brush wire tuft anchoring holes can impart or help impart corresponding alternating brush wire tufts with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

A seven-inch diameter size wheel brush or rotary radial brush of the invention has between 45 and 65 alternating radially staggered or offset tuft mounting holes 96*a* and 96*b* formed in its center hub 80 with a brush wire tuft 138 extending radially from each hole 96*a* and 96*b* with a preferred five-inch diameter brush having between 52 and 60 alternating radially staggered or offset holes 96*a* and 96*b* and the same amount of tufts 138 with a tuft 138 extending radially outwardly from each hole 96*a* and 96*b*. In one preferred seven-inch brush, the brush has a center hub 80 configured with about 56 tuft mounting holes 96*a* and 96*b* in an alternating radially staggered or offset arrangement forming a pair of sets of holes with one set of holes spaced the same distance away from but radially closer to a center of the disc or hub than the other one of the sets of holes with the brush having about 56 tufts 138 and having the same number of tufts 138 as holes 96*a* and 96*b* with a tuft 138 extending radially from each one of the holes 96*a* and 96*b*. In a preferred embodiment, each tuft 138 is composed of between 20 and 40 stainless or carbon steel wires 140 having wire diameters of between 0.008 inches and 0.035 inches and each tuft 138 can be formed of a plurality of pairs, i.e., at least three, of twisted strands, braided strands, or twisted and braided strands each composed of at least a plurality of pairs, i.e., at least three, of the wires 140. The shape of the holes 96*a* and/or 96*b* can be circular or oblong such as by being oval or elliptical, e.g., an ellipse, in shape. The holes of the hub 80 of the brush have a pair of sets of holes arranged so the holes of one set are alternatingly radially offset or radially staggered relative to the holes of the other set and can be configured such that the holes of one of the sets of holes is larger in size, e.g., longer, larger in width, or larger in diameter, than the holes of the other one of the sets of holes. Each brush preferably is configured with at least one, preferably at least a plurality, more preferably at least a plurality of pairs, i.e., at least three, of its brush wire tufts 138 having an offset trim, such as the offset trim brush wire tufts shown in FIGS. 6B and 21 and in the double-stringer brush depicted in FIGS. 22-24, with a preferred brush embodiment configured with every other tuft 138 having a trim length shorter than the trim length of an adjacent tuft 138. In a preferred brush embodiment, the alternatingly staggered brush wire tuft anchoring holes 96*a* and 96*b* can impart or help impart corresponding alternating brush wire tufts 138 with a radial offset trim thereby configuring the rotary brush such that the trim length of adjacent tufts alternates between shorter and longer trim lengths. In a preferred embodiment, the shorter trim length tufts are shorter and stiffer than the longer trim length tufts with the stiffer shorter trim length tufts providing more aggressive contact with the workpiece that increases material removal rates while the longer more flexible trim length tufts provide greater polishing that improves surface finishing quality.

With reference once again to the cross section of hub 80 of FIG. 4A shown in FIG. 5A, such a hub 80 with at least one and preferably both ends, openings or mouths of each brush-anchoring hole 96 being of diametrically enlarged construction having at least one beveled outer edge 130 formed by a chamfer 132 of each hole 96*a* and 96*b* that defines or serves as a brush wire and/or filament supporting contact surface area increasing stress relief 128 advantageously increases rotary brush life by better and more uniformly supporting the brush wire filaments 145 of each wire tuft 138 anchored to the hub 80 as well as the wires 140 or bristles 145 of each wire tuft 138 during abrasive material removal during surface finishing. While only one of the edges 134 of each hole 96*a* and 96*b* is so configured in the hub 80 depicted in FIGS. 4A and 5A, a preferred embodiment of such a hub 80 can be configured with the other edge 136 of each hole 96*a* and 96*b* also being configured with such a brush wire filament supporting contact surface area increasing stress relief 128. While each such stress relief 128 can be in the form of a diametrically hole enlarging bevel 130 along one or both hole edges 134 or 136, such as provided by a chamfer 132 of one or both hole edges 134, other stress relieving configurations that also increases the surface area of contact with the filaments 145 and/or wires 140 of the brush wire tuft 138 and/or which also diametrically enlarge a mouth or entranceway of each hole 96*a* and 96*b* are contemplated and discussed in more detail below.

With continued reference to FIG. 5A, such a bevel 130 formed by a chamfer 132 of one or both outer edges 134 or 136 of each hole 96*a* and 96*b* of hub 80 preferably not only diametrically enlarges a portion of each hole 96*a* and 96*b* at or near the mouth or entranceway of each hole 96*a* and 96*b*, but also reduces and preferably substantially eliminates sharp corners and/or rough portions along substantially the entire periphery of one or both hole edges 134 and/or 136 of each hole 96*a* and 96*b*. Reduction and preferably substantial elimination of sharp corners or rough portions at or along one or both edges 134 and 136 of each hole 96*a* and 96*b* of the hub 80 advantageously reduces brush wire wear and/or individual filament and/or bristle fracture, e.g., wire fracture, during rotary brush surface finishing operation using a rotary brush, e.g., brush 85, of the present invention made therewith. In addition to the at least one beveled hole edge 134 of each hole 96*a* and 96*b* reducing brush wire, filament and/or bristle stress, wear and breakage during abrasive surface finishing use and operation, the at least one beveled hole edge 134 advantageously also diametrically enlarges the hole 96*a* and 96*b* along each edge 134 thereby enabling each brush wire tuft 138 to be formed of more filaments 145 and wires 140 which preferably can be and also have a larger width or diameter as compared to any of the aforementioned conventional prior art radial brushes made with the aforementioned conventional prior art hub having holes of the same diameter that lack any such stress relieving diametrically enlarged hole construction.

A rotary radial brush of the present invention made with such a hub 80 having holes 96*a* and 96*b* with such a diametrically enlarged brush wire stress reducing hole edge or hole corner configuration being able to accommodate brush wire tufts 138 having more filaments 145 or wires 140 in each brush wire tuft 138 extending radially outwardly from each hole 96*a* and 96*b* advantageously has a relatively high and preferably greater rate of material removal for a given period of time of brush abrasive surface finishing operation as compared to the aforementioned conventional prior art brushes made with convention prior art hubs having brush wire tufts 138 made with a lesser number of bristles 145 or wires 140 per tuft. Such a rotary radial brush of the invention made with such a hub 80 constructed in accordance with the present invention having such holes 96*a* and 96*b* of diametrically enlarged brush wire stress reducing hole edge or hole corner configuration that accommodates a greater number of filaments 145 and wires 140 in each wire tuft 138 advantageously has a greater rate of material removal during surface finishing operation as compared to conventional prior art brushes made with such convention prior art hubs having holes of the same diameter that are limited to brush wire tufts 138 with a lesser number of wires 140 or bristles 145 of the same bristle or wire diameter per brush wire tuft. Such a rotary radial brush made with such a hub 80 having holes 96*a* and 96*b* of such a diametrically enlarged brush wire stress reducing hole edge or hole entrance configuration that accommodates brush wire tufts 138 each having a greater number of brush bristles 145 and wires 140 not only achieves a higher rate of material removal but advantageously maintains a higher rate of material removal for a longer time period as compared to conventional prior art brushes made with convention prior art hubs having brush wires which have or are limited to a lesser number of filaments or bristles per wire. Finally, such a rotary radial brush made with such a hub 80 having holes 96*a* and 96*b* of such a diametrically enlarged brush wire stress reducing hole edge or hole entrance configuration that advantageously accommodates brush wire tufts 138 having a greater number of brush wire wires 140 and brush bristles 145 in each wire tuft 138 not only achieves a higher rate of material removal and maintains a higher rate of material removal for a longer time period as compared to conventional prior art brushes made with convention prior art hubs having brush wires which have or are limited to a lesser number of bristles or filaments per brush wire, but which also produces a rotary radial brush of the present that is longer lasting and which has a longer life.

If desired, each edge 134 and/or 136 of each hole 96*a* and 96*b* can be smoothed or rounded even more than the beveled or chamfered top or upper edge 134 of each hole 96*a* and 96*b* of the cross section of the hub 80 shown in FIG. 5A to even further extend brush life by further reducing brush wire tuft, bristle, and wire breakage or fracturing due to bristles 145 and/or wires 140 rubbing on or along corner edge(s) 134 and/or 136 during surface finishing or material removal during rotary brush operation. Although not shown, at least one of the top and bottom hole edges 134 and/or 136 can be rounded, such as by a metal finishing operation, an abrasive material removal operation, an annealing operation, or another type of procedure, to substantially completely eliminate any sharp edges or sharp corners, preferably producing a substantially smooth rounded bend along which each bristle 145 and wire 140 of each brush wire tuft 138 contacts as a result of being twist knot anchored. In a preferred method and implementation of such a rounded or smoothed hole edge or hole corner configuration, smoothing or rounding of the hole edge or corner 134 and/or 136 produces a rounded and smooth edge or corner with an increased radius of curvature that advantageously reduces the bend and corresponding resultant stress each bristle 145 and/or wire 140 of the brush wire tuft 138 thereat. Such a substantially smooth and rounded hole corner or edge construction advantageously not only reduces brush wire, brush wire filament and/or brush wire bristle stress during surface finishing operation, but it also reduces rubbing of bristles 145 or wires 140 of the wire tuft 138 in contact with such smoothed rounded hole corners or edges during abrasive material removal thereby advantageously extending brush wire life.

Such a substantially smooth and rounded hole corner or edge construction advantageously also facilitates the use of brush wire tufts 138 extending radially from each hole 96*a* and 96*b* that have a greater number of filaments 145 and wires 140 per wire tuft 138 for a given hole diameter. Use of a greater number of brush wire filaments 145 and hence wires 140 per wire tuft 138 not only advantageously increases the rate of material removal during rotary radial brush operation, but also advantageously extends rotary brush life and can and preferably also does extend the length of time of increased rate of material removal. Such a substantially smooth and rounded hole corner or edge construction not only enables use of brush wire tufts 138 having a greater number of brush wire filaments 145 and wires 140 per brush wire tuft 138 for a given hole diameter, but advantageously enables such a rotary brush to be equipped with at least a plurality of brush wire tufts 138 having filaments 145 and/or wires 140 of a larger diameter. Use of a greater number of brush wire filaments 145 and brush wires 140 per wire tuft 138 where at least a plurality, preferably at least a plurality of pairs, i.e. at least three, of the filaments 145 and/or wires 140 have a larger diameter can and preferably does further increase the rate of material removal, can and preferably does further increase the length of time the increased material removal rate can be achieved and maintained, and can and preferably also does increase rotary brush life. In a preferred embodiment of a rotary brush made with such a hub 80 with such a smoothed and rounded brush anchoring hole construction, each one of the 32 radially staggered or offset holes 96*a* and 96*b* accommodates a brush wire tuft 138 having a greater number of brush wire filaments 145 and wires 140 per wire tuft 138 for a given hub and hole diameter, all of which preferably possess a larger diameter than previously used in brush wires of conventional prior art rotary brushes of the same given hub and hole diameter. Use of a greater number of brush wire filaments 145 and wires 140 per wire tuft 138 where each wire tuft 138 has a larger wire width or diameter and where each filament 145 and wire 140 also has a larger width or diameter not only increases the rate of material removal even more during rotary radial brush operation, but also can and preferably does extend the length of time of the increased rate of material removal while preferably even further extending brush life. Such a rotary brush of the invention having such a hub 80 constructed in accordance with the present invention with 32 staggered or radially offset holes 96*a* and 96*b* of having such substantially rounded and/or substantially smooth top and/or bottom edges 134 and/or 136 accommodates brush wire tufts 138 each made with a greater number of filaments 145 and wires 140, preferably about or exactly 30 brush wires 140 per wire tuft 138, and which have a greater brush wire diameter, a greater brush wire diameter and/or a greater brush bristle diameter, not only possesses at least a plurality of such advantages or benefits discussed hereinabove but advantageously does so while enabling an operator of the rotary brush to urge the brush wires 140 of the brush wire tufts 138 of the brush against the surface to be abrasively finished with a greater amount of force or pressure such as to facilitate greater or deeper material removal.

A rotary radial wire brush constructed with hub 80 in accordance with the present invention having such brush wire stress-relieved wire holes 96*a* and 96*b* configured with such stress relieved hole edges 134 and/or 136 can and preferably does possess an even longer brush life than that listed above in Table 1 for invention A. Such a rotary radial brush made with a hub 80 configured with such a stress-relieved brush anchoring hole construction can and preferably also does have an even greater material removal rate than that listed above in Table 1 for invention A.

Where a rotary radial wire brush of the present invention is constructed with a hub 80 having holes 96*a* and 96*b* configured with one or both hole edges 134 and/or 136 being of a diametrically enlarged construction, e.g., beveled, countersunk, diametrically tapered, and/or smoothed, rounded and/or polished, e.g., stress relieved construction, thereby facilitating accommodation of brush wire tufts 138 having a greater number of filaments 145 or wires 140 per wire tuft 138 of at least 29 wires 140 per wire tuft 138 (i.e., at least 29 wires 140 per hole 96*a* and 96*b*), which is about 30 bristles or wires 140 per wire tuft 138 (i.e., about 30 bristles or wires±1 bristle(s) per hole 96*a* and 96*b*) or about 15 filaments 145 per wire tuft 138 (i.e., about 15 filaments±1 filament(s) per hole 96*a* and 96*b*), and which preferably is exactly 30 wires 140 per wire tuft 138 (i.e., 30 wires 140 per hole 96*a* and 96*b*) and exactly 15 filaments 145 per wire tuft 138 (i.e., 15 filaments 140 per hole 96*a* and 96*b*) advantageously can and preferably also does perform at least as well or better than the rotary radial wire brush of invention A in Table 1. In one preferred embodiment, the brush has a hub 80 with holes 96*a* and 96*b* having one or both hole edges 134 and/or 136 being of a diametrically enlarged construction, e.g., beveled, countersunk, diametrically tapered, and/or smoothed, rounded and polished, enabling wire brush wires 138 with greater than 30 wires 140 per wire tuft 138 per hole 96*a* and 96*b* to be used with such a brush of the invention performing better than the brush of invention A in Table 1 above in at least one performance test category listed in Table 1. In one such preferred embodiment, such a brush of the invention having brush wire tufts 138 with more than 30 wires 140 and/or more than 15 filaments 145 per wire tuft 138 per hole 96*a* and 96*b* of hub 80 of offset hole configuration preferably performs better than the brush of invention A in at least a plurality of the performance categories listed above in Table 1. In one such preferred embodiment, each wire tuft 138 of such a brush of the present invention has 31 or 32 bristles or wires 140 per wire tuft 138 and/or has at least 16 filaments per wire tuft 138 producing a brush of the invention that performs at least as well as the brush of invention A with respect to at least one and preferably at least a plurality of the performance test categories listed in Table 1.

FIGS. 4B and 21 and FIGS. 22-24 illustrate additional preferred embodiments of an abrasive rotary brush 210 constructed in accordance with the present invention that employs a center disc hub 212 with radially outermost brush mounts 214*a* that are larger than radially innermost brush mounts 214*b* from which brush wire tufts 216*a*, 216*b* radially outwardly extend that are formed of at least a plurality of pairs of brush wire filaments 145 that are both twisted and braided producing brush wire tufts 216*a*, 216*b* having narrow tufts 139 with bristle tips 142 constrained to define relatively small sized abrasive contacting working faces 144 that more efficiently abrasively remove material for a longer period of time resulting in increased brush operating life. Such an abrasive rotary brush 210 of the present invention has operating characteristics, parameters and life at least as good as that of INVENTION A in TABLE 1 above.

With continued reference to FIG. 6B, the center disc hub 212 is similar in construction to the hub 80 shown in FIG. 6A discussed above but differs in that its radially outermost brush mounts 214*a* are larger than its radially innermost brush mounts 214*b*. As with hub 80, radially outermost brush mounts 214*a* are uniformly circumferentially spaced apart and are all spaced the same radial distance from the center of the hub 212 and radially innermost brush mounts 214*b* are uniformly circumferentially spaced apart and are all spaced the same radial distance from the center of the hub 212 that is less than the radial distance the radially outermost brush mounts 214*a* are spaced from the hub center.

Figure 23:
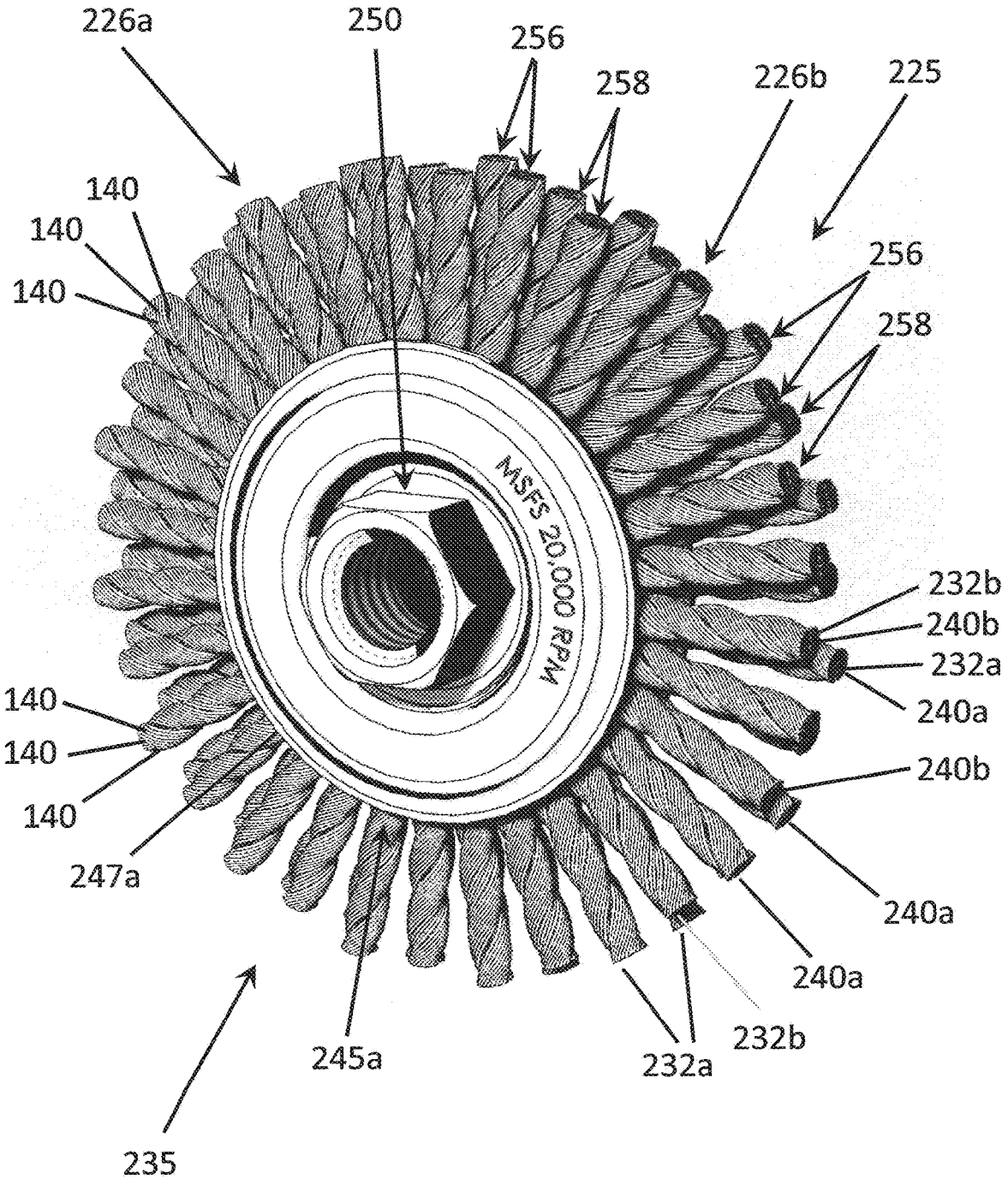
FIG. 23 is a top front perspective view of the double-stringer rotary brush assembly of FIG. 22.
Figure 24:
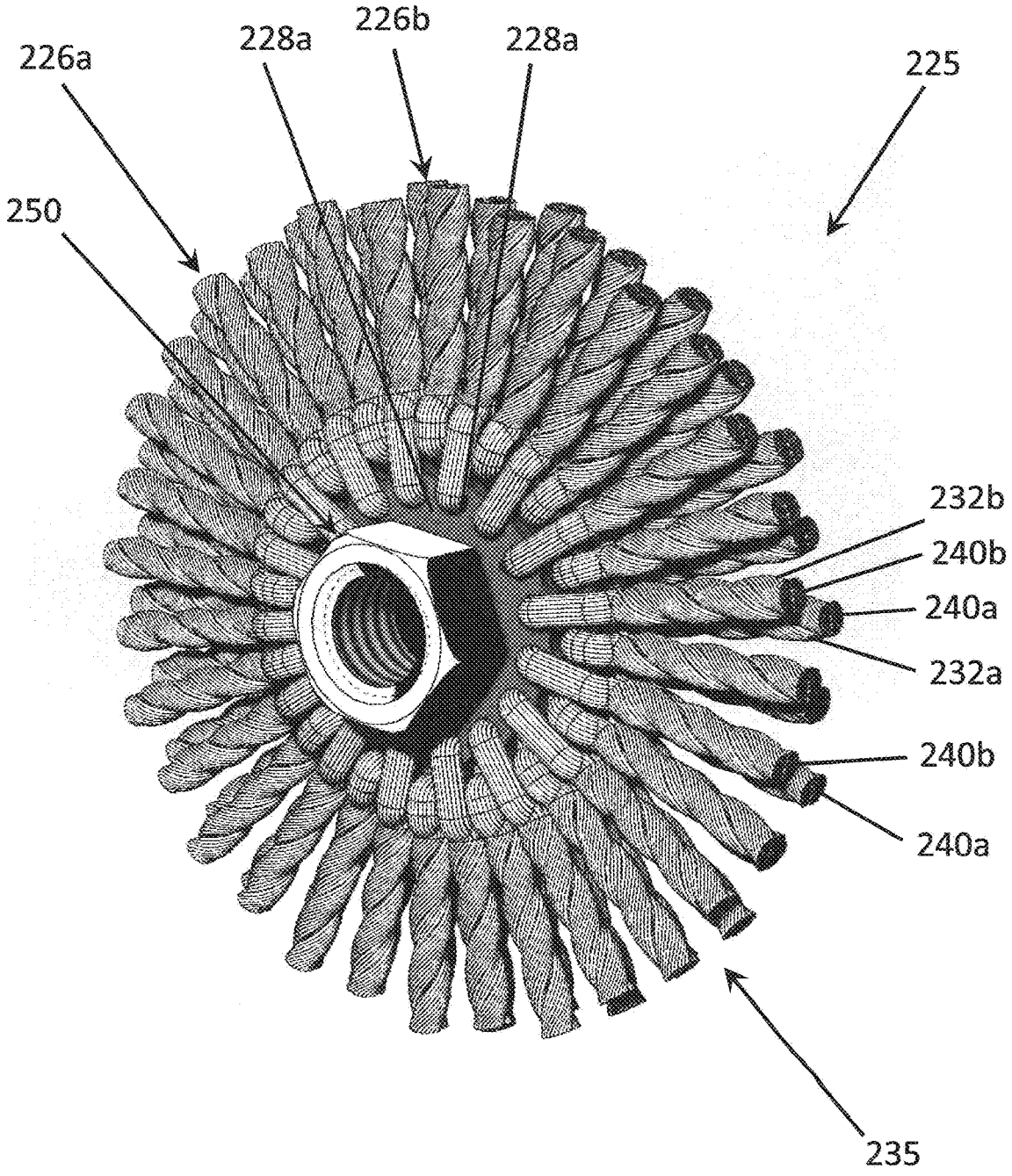
FIG. 24 is a top front perspective view of the double-stringer rotary brush assembly of FIG. 22 with an outer cover plate of the brush assembly removed.
Figure 25:
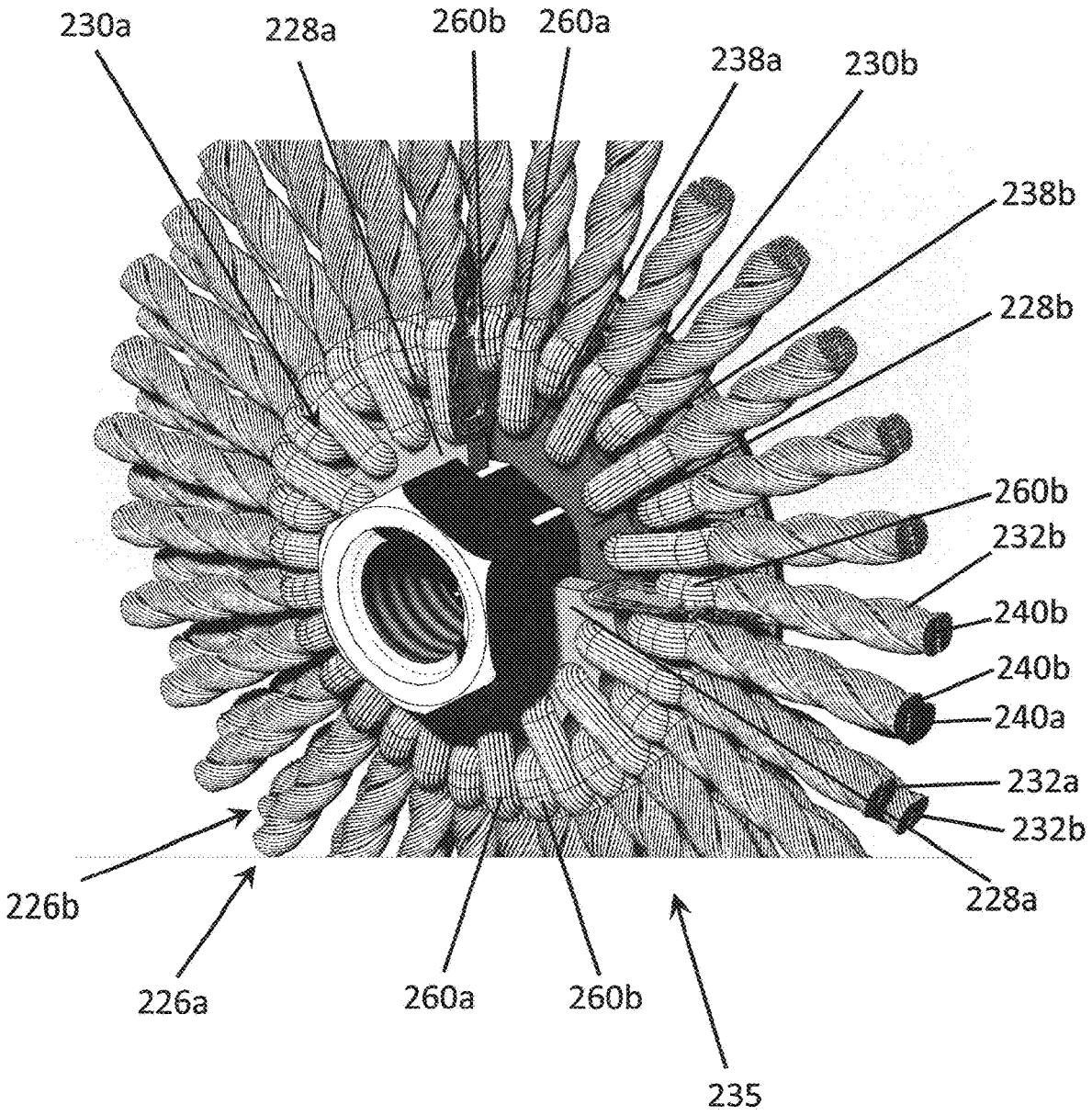
FIG. 25 is a partial top front perspective view of the double-stringer rotary brush assembly of FIG. 22 with a quarter section of one of the radial wire brushes taken to show details of the construction of the other one of the radial wire brushes.

In the preferred center hub embodiment depicted in FIG. 6B and FIG. 23, each radially outermost brush mount 214*a* is defined by an aperture 218*a* that preferably is an opening 220*a*, more preferably a round or circular opening 220*a*, which is larger than the aperture 218*b* that preferably is an opening, more preferably also a round or circular opening 220*b*, which defines radially innermost brush mount 214*b*. In the preferred hub embodiment shown in FIG. 6B and FIG. 23, each radially outermost opening 220*a* preferably radially overlaps the radially innermost opening 220*b* circumferentially staggered to either or both sides of opening 220*a* thereby enabling the twisted knot 224*a* used to anchor the brush wire tuft 216*a* to the hub 212 as depicted in FIG. 6B (and in the double-stringer brush of FIG. 23) to more freely pivot or move during abrasive material removal. Imparting the ability of the twisted knot 224*a* of the wire tufts 216*a* that extend farthest radially outwardly from the hub 212 and brush 210 helps ensure greater surface area of contact between the working face 144 and surface being abrasively treated. It also causes the working face 144 of each such brush wire tuft 216*a* to less aggressively abrade the surface being treated thereby treating the surface in a manner that provides or imparts a better surface finish than such a brush having such aggressive material removal rates would ordinarily possess.

Each radially outermost opening 220*a* of brush mount 214*a* is at least 50% larger in size, preferably at least 50% larger in diameter, than radially innermost opening 220*b* of brush mount 214*b*. In the preferred embodiment shown in FIG. 6B (and FIG. 23), each radially outermost opening 220*a* of brush mount 214*a* is about at least twice as large in size, preferably is about at least twice as larger in diameter, than radially innermost opening 220*b* of brush mount 214*b*. Each brush wire tuft 216*b* extending radially outwardly from smaller radially innermost opening 220*b* of radially innermost brush mount 214*b* has a twisted knot 224*b* that is greater in length than the twisted knot 224*a* of each brush wire tuft 216*a* that extends radially outwardly from radially outermost opening 220*a* of radially outermost brush mount 214*a* thereby imparting greater stiffness to each brush wire tuft 216*b*. Such greater stiffness imparted to each such brush wire tuft 216*b* advantageously causes it to more aggressively abrade the surface being treated during rotation of brush 210 by a rotary power tool (not shown). The twisted knot 224*b* of brush wire tuft 216*b* anchored to radially innermost opening 220*b* of radially innermost brush mount 214*b* is at least 50% greater in length than the length of the twisted knot 224*a* of brush wire tuft 216*a* anchored to radially outermost opening 220*a* of radially outermost brush mount 214*a* thereby producing brush wire tufts 216*b* having at least 10% greater stiffness than brush wire tufts 216*a*. In the preferred embodiment shown in FIG. 6B, the twisted knot 224*b* of brush wire tuft 216*b* anchored to radially innermost opening 220*b* of radially innermost brush mount 214*b* is at least twice as great in length than the length of the twisted knot 224*a* of brush wire tuft 216*a* anchored to radially outermost opening 220*a* of radially outermost brush mount 214*a* thereby producing brush wire tufts 216*b* having at least 12% greater stiffness than brush wire tufts 216*a*. With continued reference to FIG. 6B, the twisted knot 224*b* of brush wire tuft 216*b* anchored to radially innermost opening 220*b* of radially innermost brush mount 214*b* is at least two and half times as great in length than the length of the twisted knot 224*a* of brush wire tuft 216*a* anchored to radially outermost opening 220*a* of radially outermost brush mount 214*a* thereby producing brush wire tufts 216*b* having at least 15% greater stiffness than brush wire tufts 216*a*.

The result is a brush 210 as depicted in FIG. 6B constructed in accordance with the present invention having more flexible brush wire tufts 216*a* anchored by shorter twist knots 224*a* to radially outermost openings 220*a* of radially outermost brush mounts 214*a* that extend radially outwardly a greater distance, d, than the less flexible more aggressive brush wire tufts 216*b* anchored by longer twist knots 224*b* to radially innermost openings 220*b* of radially innermost brush mounts 214*b* producing a brush 210 of the present invention of hybrid construction. Such hybrid construction comes from the fact that its radially longer brush wire tufts 216*a* are more flexible and less aggressive thereby advantageously imparting a better surface finish to the surface being abrasively treated while the radially shorter brush wire tufts 216*b* are stiffer and more aggressive advantageously increasing material removal rates. FIG. 21 depicts such a brush 210 of the present invention in its fully assembled form. In a preferred embodiment, d, is an offset trim between adjacent pairs of the tufts 216*a*, 216*b* that is at least a plurality of millimeters and preferably at least a plurality of pairs, i.e., at least three, millimeters.

Figure 7:
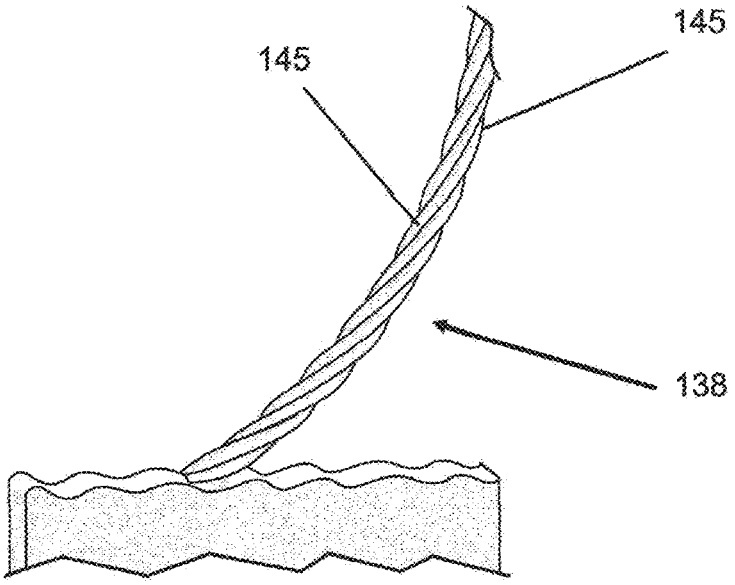
FIG. 7 is a fragmentary elevation view of a twisted wire arrangement configured for use as a brush wire tuft or strand of a brush wire tuft in a rotary brush of the present invention.

With reference to FIGS. 7-10, a rotary brush, e.g., brush 85, constructed in accordance with the present invention having such a hub 80 with 32 radially offset brush-seating holes 96*a* and 96*b* is not only well suited for use with a conventional wire tuft 138 like the wire tuft 138 depicted in FIG. 7 that is composed of at least 30 wires 140 formed from at least 15 filaments 145 that make up the wire tuft 138. Such a brush wire tuft 138 of multifilament construction that is formed of at least about 15 filaments 145 but typically not more than about 20 filaments 145 producing a rotary brush of the invention having such a 32-hole radially offset hole configured hub 80 with such multifilament brush wire tufts 138 anchored thereto extending radially from each hole 96*a* and 96*b* that preferably possesses long life and excellent abrasive material removal characteristics as indicated by the test results of INVENTION A in TABLE 1 above. While each one of the brush wire tufts 138 of the embodiment of the brush 85 depicted in FIG. 6A is of twisted wire construction where the filaments 145 of each brush wire tuft 138 are looped through a corresponding one of the holes 96*a* and 96*b* and overlapped before being twisted around respective margin 146*a* and 146*b* of corresponding brush anchor 84*a* and 84*b* producing a wire tuft 138 that can be of standard twist knot construction but which preferably is of cable twist knot construction and which more preferably is of stringer bead twisted knot construction. In one preferred embodiment, such a brush, e.g., brush 85, having wire tufts 138 of one of a standard twisted knot or cable twisted knot configuration.

Figure 8:
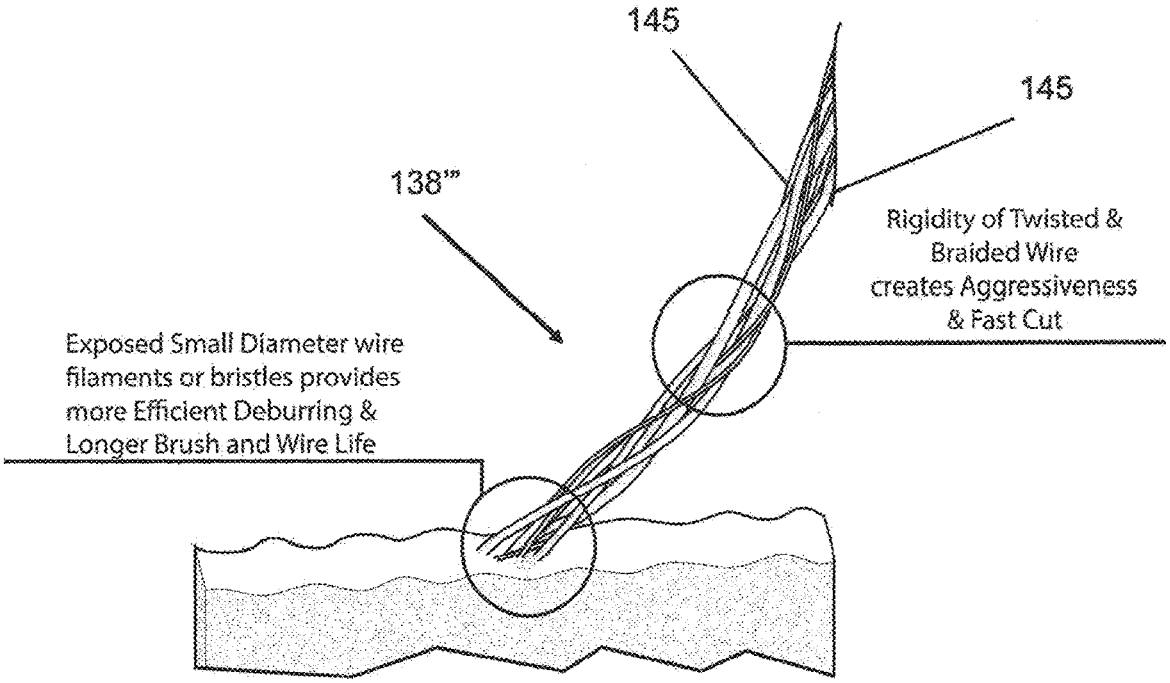
FIG. 8 is a fragmentary elevation view of a twisted and braided wire arrangement configured for use as a brush wire tuft or strand of a brush wire tuft in a rotary brush of the present invention.
Figure 9:
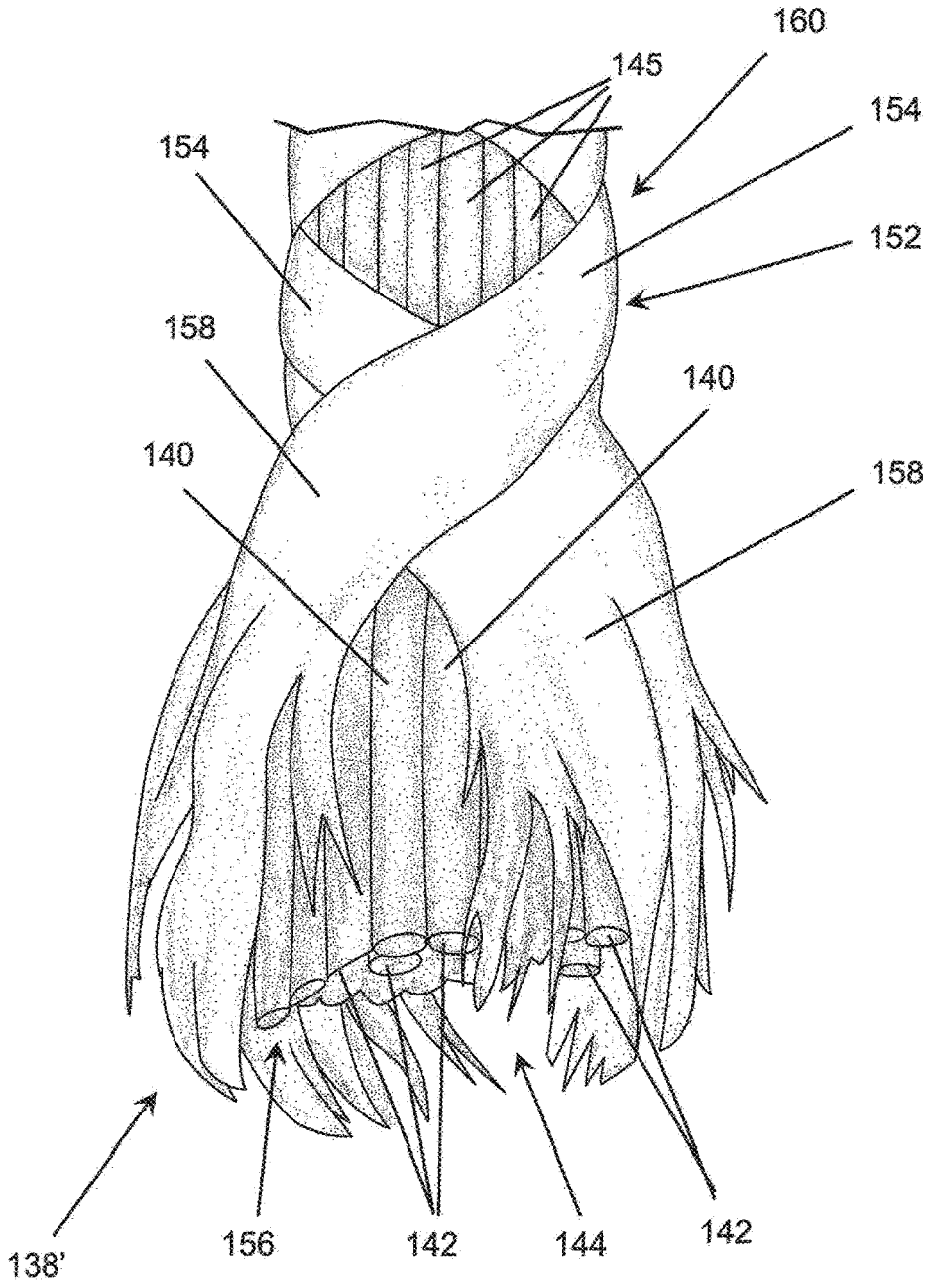
FIG. 9 is a fragmentary elevation view depicting a preferred arrangement of a brush wire tuft composed of a plurality of elongate wires surrounded by an outer wire supporting latticework configured for use in a rotary brush of the present invention.
Figure 10:
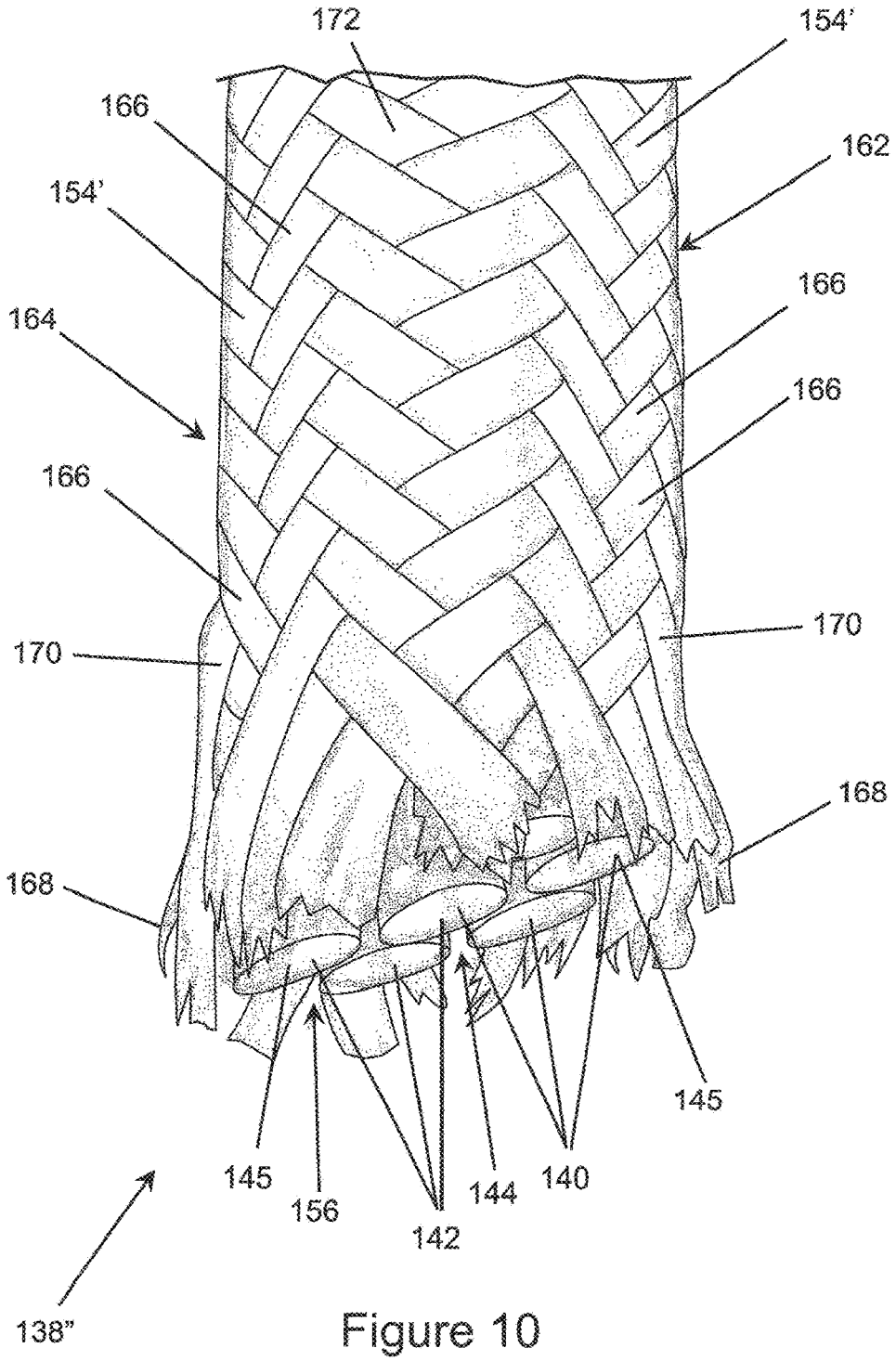
FIG. 10 is a fragmentary elevation view illustrating another preferred arrangement of a brush wire tuft configured like that depicted in FIG. 9 that employs a braided outer wire supporting latticework.

While a rotary radial wire brush, e.g., wheel wire brush or power brush, of the present invention made with such a 32-hole radial offset hole configured hub 80 equipped with a brush wire tuft 138 extending radially from each hole 96*a* and 96*b* having at least 30 wires 140 per wire tuft 138 formed of or from at least 15 elongate filaments 15 per wire tuft 138 that are longer than wires 140 has outstanding performance as evidenced by the test results of INVENTION A in Table 1, such a brush made with such a hub 80 constructed in accordance with the present invention can employ novel and inventive twisted brush wire tufts 138' and/or braided brush wire tufts 138" in accordance with that discussed in more detail below and shown in one or more of FIGS. 8-10.

In one preferred embodiment, a rotary radial brush constructed with a 32-hole radially offset configured hub 80 is equipped with at least one of a twisted brush wire tuft 138', such as depicted in FIG. 9, and a braided brush wire tuft 138", such as depicted in FIG. 10, seated in at least a plurality of pairs of the holes 96*a* and 96*b* and anchored via a twisted knot 148 or the like to brush anchor(s) 84*a* and 84*b*. In another preferred embodiment, the brush wire tuft 138' is a hybrid twisted and braided brush wire tuft 138' like that depicted in FIG. 8 that is of both twisted wire construction and braided wire construction as discussed in more detail below. Such a hybrid wire tuft 138' preferably has at least a plurality of pairs of filaments 145 that are both twisted and braided producing a wire tuft 138'" well suited for substitution for wire tuft 138 in the brush 85 of the present invention shown in FIGS. 4-6A and even the brush 210 shown in FIGS. 6B and 21. The use of such an improved twisted and/or braided brush wire of the type shown in FIGS. 7-10 advantageously further improves the performance characteristics of a brush of the invention made such wire tufts 138', 138" and/or 138' over that of the brush of INVENTION 1.

In a preferred embodiment, the hub 80 of a rotary radial wire brush of the invention has twisted brush wire tuft 138', braided brush wire tuft 138" or hybrid twisted and braided wire tuft 138' extending radially outwardly from the holes 96*a* and 96*b* radially beyond the outer peripheral hub edge 118. In another such preferred embodiment, the hub 80 of a rotary radial wire brush of the invention has at least a plurality of pairs of holes 96*a* and/or 96*b* with twisted brush wire tufts 138' extending radially outwardly therefrom, has at least a plurality of pairs of holes 96*a* and/or 96*b* with braided brush wire tufts 138" extending radially outwardly therefrom, and/or has at least a plurality of pairs of holes 96*a* and/or 96*b* with twisted and braided brush wire tufts 138'" extending radially outwardly therefrom with each one of the holes 96*a* and 96*b* having at least one of the twisted wire tufts 138', at least one of the braided wire tufts 138" and/or at least one of the hybrid twisted and braided wire tufts 138'.

In one preferred embodiment, the hub 80 of one such a brush of the invention has either twisted brush wire tufts 138' or braided brush wire tufts 138" extending radially outwardly from each one of the set 98 of radially outermost disposed holes 96*a* and which are anchored via a twisted knot 148 or the like to corresponding brush anchors 84*a*, and has the opposite one of either braided brush wire tufts 138" or twisted brush wire tufts 138' extending radially outwardly from each one of the set 100 of radially innermost disposed holes 96*b* and which are anchored via a twisted knot 148 or the like to corresponding brush anchors 84*b*. In one such preferred embodiment, the hub 80 of one such brush of the invention has twisted brush wire tufts 138' extending radially outwardly from each one of the set 98 of radially outermost disposed holes 96*a* and which are anchored via a twisted knot 148 or the like to corresponding brush anchors 84*a*, and has braided brush wire tufts 138" extending radially outwardly from each one of the set 100 of radially innermost disposed holes 96*b* and which are anchored via a twisted knot 148 or the like to corresponding brush anchors 84*b*. In another such preferred embodiment, the hub 80 of another such brush of the invention has braided brush wire tufts 138" extending radially outwardly from each one of the set 98 of radially outermost disposed holes 96*a* and which are anchored via a twisted knot 148 or the like to corresponding brush anchors 84*a*, and has twisted brush wire tufts 138' extending radially outwardly from each one of the set 100 of radially innermost disposed holes 96*b* and which are anchored via a twisted knot 148 or the like to corresponding brush anchors 84*b*.

The brush wire tuft 138' of the present invention shown in FIG. 9 can also be of a twisted knot construction but differs from that of convention standard twisted knot wire construction, cable twisted knot wire construction or stringer bead twisted knot wire construction in a manner that makes it more durable, maintains a smaller abrasive wire face over a longer period of time or brush wear, keeps the filaments or bristles of each wire constrained preventing them from splaying thereby helping to maintain a smaller abrasive wire face for a longer period of time, and lasts longer producing a brush that has a longer life. One preferred embodiment of such a twisted brush wire tuft 138' depicted in FIG. 9 has an outer support layer 152 formed of at least a plurality of elongate outer brush wire filament or bristle supporting bindings 154, preferably a plurality of pairs, i.e., at least three, bindings 154, extending substantially the length of the wire tuft 138' and which are twisted about a longitudinally extending twist axis disposed at or along a centerline of the wire tuft 138' in one direction relative to the twist axis around an inner core 156 of the wire tuft 138' formed of the brush filaments 145 and/or wires 140. Each brush wire core support binding 154 is elongate and of generally circular or rectangular, e.g., square, cross-section and preferably is formed of one or more filaments like or substantially the same as the filaments 145 or wires 140 of the brush wire inner core 156. As also is shown in FIG. 9, the bindings 154 are arranged to form an elongate tubular brush wire supporting latticework 160 that can and preferably does extend at least the length of the tuft portion of the wire tuft 138' preferably to or adjacent the abrasive brush wire face 144 formed by the filament or bristle tips 142 of the wire tuft 138'.

In a preferred embodiment, each one of the bindings 154 is formed of an elongate wire core strengthening ribbon 158 with the brush wire core supporting latticework 160 formed of a plurality, preferably a plurality of pairs, of the ribbons 158 arranged relative to one another in a manner that produces such a latticework 160 that wraps around and is substantially coaxial with the brush wire core 156. Each ribbon 158 can be and preferably is formed of at least a plurality, preferably at least a plurality of pairs, of elongate filaments or the like which are braided, woven or otherwise arranged or formed into an elongate generally flat ribbon 158 like that shown in FIG. 9 that each can and preferably does helically wrap around the exterior of the core 156. Where each brush wire core supporting binding 154 is a ribbon 158, at least a plurality, preferably at least a plurality of pairs, of the ribbons 158 can be helically wrapped around the core 156 with a flat side of each ribbon 158 facing towards or disposed against the outer surface of the core 156 in a manner depicted in FIG. 9 with the ribbons 158 preferably twisted with and/or crossing one another in the manner also shown in FIG. 9 producing brush wire core enshrouding latticework 160.

Where the brush wire core support bindings 154 are of generally circular or rectangular, e.g., square, cross section, bindings 154 can be formed of any one of a number of the same relatively strong, tough, flexible and resilient brush wire materials as the filaments 145, such as steel, including medium and high carbon steel, stainless steel, or the like. While bindings 154 of such generally circular or rectangular construction can have the same or a smaller width or diameter as that of the filaments 145 and/or wires 140 of the inner core 156, the bindings 154 preferably have a width or diameter greater than that of the filaments 145 or wires 140 of the inner core 156, such where desired to provide greater structural support thereto. Where the bindings 154 are formed of ribbons 158, each one of the ribbons 158 can also be of metallic construction such as by being made of woven or braided steel or aluminum construction. Where ribbons 158 are employed, the ribbons 158 can and preferably do have a thickness less than the diameter or width of the filaments 145 and/or wires 140 of the inner core 156.

The inner core 156 of the wire tuft 138' is formed of at least a plurality, preferably at least a plurality of pairs, i.e., at least three, elongate brush wire filaments 145, which preferably also define or form abrasive material removing wires 140, which can be substantially straight and generally parallel with one another such as by being arranged side-by-side and/or in contact with one another substantially the length of the core 156 covered by bindings 154, ribbons 158, and/or latticework 160. The filaments 145 or wires 140 are preferably of metallic construction, such as by being made of a steel, such as a medium or high carbon steel, stainless steel, or another steel or metal alloy and can be coated or encapsulated, such as with or by an elastomer, plastic, epoxy, a resin, or the like, if desired.

In one embodiment, the core 156 is formed of elongate wires 140 or filaments 145 twisted together at least along the portion of the core 156 extending radially outwardly from the hub 80 forming a single elongate twisted strand preferably having a plurality, more preferably a plurality of pairs, of twists therealong with the twist direction being the same as or opposite that of the direction of twist of bindings 154 and/or the same as or opposite that of the direction of helical wrap of ribbons 158. In another embodiment, wires 140 and/or filaments 145 of the core 156 are arranged into at least a plurality, preferably at least a plurality of pairs, of strands with each strand formed of at least a plurality, preferably at least a plurality of pairs, of bristles or filaments twisted at least a plurality, preferably at least a plurality of times along the length of each strand. In still another embodiment, wires 140 and/or filaments 145 of the core 156 can be formed into a plurality, preferably a plurality of pairs, of strands each formed of a plurality, preferably a plurality of pairs, of wires 140 and/or filaments 145 braided together. Where core 156 is formed of multiple strands, at least a plurality, preferably at least a plurality of pairs of the strands are twisted and/or braided together along their length preferably twisted at least a plurality, preferably at least a plurality of pairs, of times where twisted.

Where wires 140, filaments 145 or strands are twisted, including as described elsewhere herein, they preferably are twisted at least a plurality, preferably at least a plurality of times along their length, and are twisted along substantially the length of the wire tuft 138', core 156 or at least the portion of the core 156 forming the tuft of the brush wire tuft 138' and/or extending radially of or from hub 80. Where twisted, the filaments 145 and/or wires 140 of each strand preferably are twisted together at least a plurality, preferably at least a plurality of pairs, of times along the length of the strand, wire tuft 138' or tuft with the filaments 145 and/or wires 140 of a preferred strand twisted at least a plurality, preferably at least a plurality of pairs, of times per inch or centimeter of length of the wire tuft 138, filaments 145, wires 140, strand, or tuft.

The inner core 156 of such a wire tuft 138' coaxially supported by latticework 160 is formed of at least 28 elongate wires 140 and/or 28 elongate filaments 145. Where the wire tuft 138' and/or core 156 of the wire tuft 138' is attached to hub 80 by a twisted knot 148, the core 156 preferably is formed of at least 14 elongate filaments 145 which overlap, can be twisted, and/or braided forming at least 28 wires 140. In another embodiment, the core 156 is formed of at least 29 elongate wires 140 and/or 29 elongate bristles 145 each of which extends at or adjacent to the brush wire face 144 at the head or free end of the wire tuft 138'. In still another embodiment, the core 156 is formed of at least 30 elongate wires 140 and/or 30 elongate bristles 145 each of which extends at or adjacent to the brush wire face 144 at the head or free end of the wire tuft 138'. Where the wire tuft 138' and/or core 156 of the wire tuft 138' is attached to hub 80 by a twisted knot 148, the core 156 preferably is formed of at least 15 elongate filaments 145 which overlap, can be twisted, and/or braided forming at least 30 wires 140 that each extend to or adjacent the face 144 at the head or free end of the wire tuft 138'. In one such preferred embodiment of such a binding, ribbon or latticework supported wire tuft 138' of the present invention, the core 156 has exactly 30 wires 140 and/or exactly 30 filaments 145 with one such preferred core 156 having exactly 15 filaments 145 and exactly 30 wires 140 where the filaments 145 are overlapped such as where the wire tuft 138' or core 156 is of twisted knot construction.

One preferred rotary radial wire brush of the invention has a hub 80 with 32 holes 96*a* and 96*b* of offset configuration is equipped with 32 wire tufts 138' of the configuration depicted in FIG. 9, with each wire having such an outer brush bristle or brush wire supporting latticework 160 wrapped around, enshrouding, or covering the inner wire core 156 that is formed of between 29 and 35 wires 140 and/or filaments 145, preferably is composed of between 29 and 32 wires 140 and/or filaments 145, more preferably has at least about 30 wires 140 and/or filaments 145, and even more preferably has exactly 30 wires 140 and/or bristles 145. Where each brush wire tuft 138' has such a multi-bristle or multifilament inner wire core or tuft 138' of twisted knot construction, each wire tuft 138' has an inner core 156 formed of at least 14 filaments 145 and at least 28 wires 140, preferably is formed of at least 15 filaments 145 and at least 30 wires 140, and more preferably is formed of exactly 15 filaments 145 and exactly 30 wires 140.

The bindings 154, including where formed of ribbons 158, twisted, wrapped, braided and/or woven about the inner core 156 of brush wires 140 and/or filaments 145 provide greater structural support to the filaments 145 and wires 140 defined by the filaments 140 producing a stronger, stiffer brush wire tuft 138' of the invention holding them together better during abrasive material removal thereby advantageously imparting to a rotary radial wire brush, e.g., wheel brush or power brush, of the present invention made with such wire tufts 138' significantly improved abrasive material removal characteristics, preferably doing so without a reduction in brush wire life. Such a brush wire tuft 138' advantageously increases the aggressiveness and preferably also increases the speed of the cut or area of the surface being abrasively finished or treated along which surface material is abrasively removed thereby during rotary brush operation.

The resultant twisted binding or twisted ribbon brush wire supporting latticework 160 possesses flexibility which also helps dampen and/or absorb shock loads encountered by the wires 140 or filaments 145 of the wire tuft 138' during abrasive material removal when contacting surfaces being treated or finished that are rougher, have upraised projections, or otherwise result in the wire tuft 138' impacting thereagainst during brush rotation during abrasive material removal during surface finishing or treatment therewith. In doing so, the tips of the wire advantageously more continuously remain in contact with the surface being finished or treatment thereby producing a brush of the invention equipped with such wire tufts 138' that abrasively remove a greater amount of surface material during a given amount of time or brush wear while advantageously producing a more uniform surface finish preferably while maintaining, if not increasing, brush life. In addition, by the outer layer of twisted bindings or ribbons providing support to the core wires or bristles substantially along their length including to adjacent or at the tips of the abrasive face, filament or bristle breakage is reduced thereby increasing wire and brush life.

The brush wire tuft 138" of the present invention shown in FIG. 10 is of braided construction having an outer layer 162 formed of at least a plurality of elongate flexible outer tuft wire or bristle supporting bindings 154', preferably a plurality of pairs, i.e., at least three, bindings 154', extending substantially the length of the wire tuft 138" which are braided together forming an elongate tubular flexible braided or woven outer wire sleeve 164 that substantially covers or encloses the filaments 145 and/or wires 140 of the inner core 156 of the wire tuft 138" constraining and structurally supporting the filaments 145 and/or wires 140 within the sleeve 164. Each brush wire core support binding 154' is elongate and of generally circular or rectangular, e.g., square, cross-section and preferably is formed of one or more filaments like or substantially the same as the filaments 145 or wires 140 of the brush wire inner core 156. In the preferred embodiment of the wire tuft 138" shown in FIG. 10, the brush wire core constraining and supporting sleeve 164 is formed of at least a plurality, preferably at least a plurality of pairs, of elongate flexible and generally flat or rectangular cross-sectioned bindings 154' each of which preferably is a generally flat, elongate and flexible band 166 of generally rectangular cross-section.

While the filaments 145 and/or wires 140 of the core 156 of a brush wire tuft 138" constructed in accordance with the present invention can be substantially straight and generally parallel lying side by side one another, including in contact with one another, filaments 145 and/or wires 140 of the core 156 of another embodiment of the wire tuft 138" can also be of a twisted or braided configuration if desired. Where filaments 145 and/or wires 140 are twisted, at least a plurality or plurality of pairs of the filaments 145 and/or wires 140 of the core 156 are twisted forming at least a plurality of elongate flexible strands, such as in the manner described hereinabove with respect to the twisted wire tuft 138' of FIG. 9. Where two or more filaments 145 and/or wires 140 of core 156 are twisted together forming two or more elongate flexible strands within the sleeve 164, a plurality or more of the strands can instead be twisted or braided together. In one preferred embodiment of the wire tuft 138", all of the filaments 145 and/or wires 140 are twisted together such that the wire core 156 is formed of a single elongate flexible strand of twisted filaments 145 and/or wires 140 which is covered or enclosed in or by the elongate tubular core supporting and stiffening sleeve 164. In another preferred embodiment of the wire tuft 138", filaments 145 and/or wires 140 of core 156 are twisted together forming at least a plurality, preferably at least a plurality of pairs, of twisted wire or twisted bristle strands which are in turn twisted together forming a wire core 156 of multiple twisted strand construction. In still another preferred embodiment of the wire tuft 138", at least a plurality, preferably at least a plurality of pairs, of the filaments 145 and/or wires 140 of the brush wire core 156 are braided together forming at least a plurality, preferably at least a plurality of pairs, of braided wire strands or braided bristle strands, which are in turn braided together forming a wire core 156 of braided strand construction. In a further preferred embodiment of the wire tuft 138", at least a plurality, preferably at least a plurality of pairs, of the filaments 145 and/or wires 140 of the brush wire core 156 are braided together forming at least a plurality, preferably at least a plurality of pairs, of braided wire or braided bristle strands which are in turn twisted together along the longitudinal center axis, e.g., twist axis, of the brush wire tuft 138" thereby forming a wire core 156 of braided wire or braided bristle twisted strand construction. In still another preferred embodiment of the wire tuft 138", at least a plurality, preferably at least a plurality of pairs, of the bristles 145 and/or wires 140 of the brush wire core 156 are twisted together forming at least a plurality, preferably at least a plurality of pairs, of twisted wire strands or twisted bristle strands which are in turn braided together forming a wire core 156 of twisted wire or twisted bristle braided strand construction.

As depicted in FIG. 10, the sleeve 164 is formed of elongate flat or generally rectangular cross-sectioned bands 166 each of which are helically wrapped around a core 156 of a brush wire tuft 138" of the present invention in a plurality of different directions or orientations with the bands 166 braided together as shown in FIG. 10. In one preferred embodiment, each one of the bands 166 is of multifilament construction formed of at least a plurality, preferably at least a plurality of pairs, of relatively thin or fine filaments 168, which are each smaller in width or diameter than brush wire filaments 145 or wires 140, which can in turn be braided or woven to form the band 166 with the sleeve 164 preferably being of braided multifilament construction. If desired, the outer brush wire core supporting sleeve 164 that holds the wires 140 and/or filaments 145 of the brush wire core 156 together can also be of braided monofilament construction with each binding 154' or band 166 formed of a single elongate filament 170 with each such filament 170 being of circular or rectangular cross section having a width or diameter larger than filament(s) 168 but larger than wires 140 or filaments 145. In another preferred embodiment, the sleeve 164 can be of a woven construction, such as a biaxial braided or biaxial woven construction formed of at least a plurality, preferably at least a plurality of pairs of filaments 168 biaxially braided or biaxially woven together to form tubular sleeve 164 that substantially completely encapsulates and coaxially telescopes over the wires 140 and/or filaments 145 of the inner wire core 156.

Such a sleeve 164 preferably is an elongate generally cylindrical tube 172 of elongate, generally stiff but having some flex, and resilient brush wire core stiffening construction that substantially completely enshrouds or encapsulates all of the wires 140 and/or filaments 145 of the core 156 of a brush wire tuft 138" constructed in accordance with the present invention that forms a radial rotary wire brush, e.g., brush 85, which can be a wheel wire brush or a power brush, which possesses increased aggressiveness, a greater rate of material removal, and has a longer brush life than the brush of INVENTION 1 of Table 1. Such a sleeve 164 preferably generally coaxially covers substantially the length of at least the portion of the wire tuft 138" or core 156 of the wire tuft 138" that forms at least part of the tuft of the wire tuft 138" or core 156 disposed at or adjacent the free end or face 144 of the core 156 formed by tips 142. In a preferred embodiment, sleeve 164 extends from at or adjacent the free end or face 144 of the core 156 toward and preferably to, at or adjacent where the core 156 of the wire tuft 138" is attached or otherwise anchored to the hub 80 of a rotary radial brush, e.g., brush 85, made with such brush wire tufts 138".

Such brush wire tuft 138" of the invention having such a multifilament or multi-bristle abrasive brush wire core 156 generally coaxially and substantially completely enshrouded or encapsulated by elongate and tubular brush wire core stiffening and supporting sleeve 164 produces a rotary radial wire brush of the present invention that removes a greater amount of material more quickly and does so while having a longer brush life than the brush of invention 1 of Table 1. Such a brush wire tuft 138" advantageously increases the aggressiveness and speed of the cut or area of the surface being finished or treated along which surface material is abrasively removed thereby during rotary brush operation. The resultant flexible twisted binding or twisted ribbon brush wire supporting sleeve 164 also helps dampen and/or absorb shock loads encountered by the wires 140 or filaments 145 of the core 156 of wire tuft 138" during abrasive material removal when contacting surfaces being treated or finished that are rougher, have upraised projections, or otherwise result in the wire tuft 138" impacting thereagainst during brush rotation during abrasive material removal during surface finishing or treatment therewith. In doing so, the tips 142 of the wires 140 of the core 156 of the wire tuft 138" advantageously more continuously remain in contact with the surface being finished or treatment thereby producing a brush, e.g., brush 85, of the invention equipped with such wire tufts 138" that abrasively remove a greater amount of surface material during a given amount of time or brush wire wear while advantageously producing a more uniform surface finish preferably while maintaining, if not extending, brush life. In addition, by the sleeve 164 providing support to the core bristles 145 or wires 140 substantially along their length including to adjacent or at the tips 142 of the abrasive face 144, wire or bristle breakage is significantly reduced thereby increasing wire and brush life.

Figure 11A:
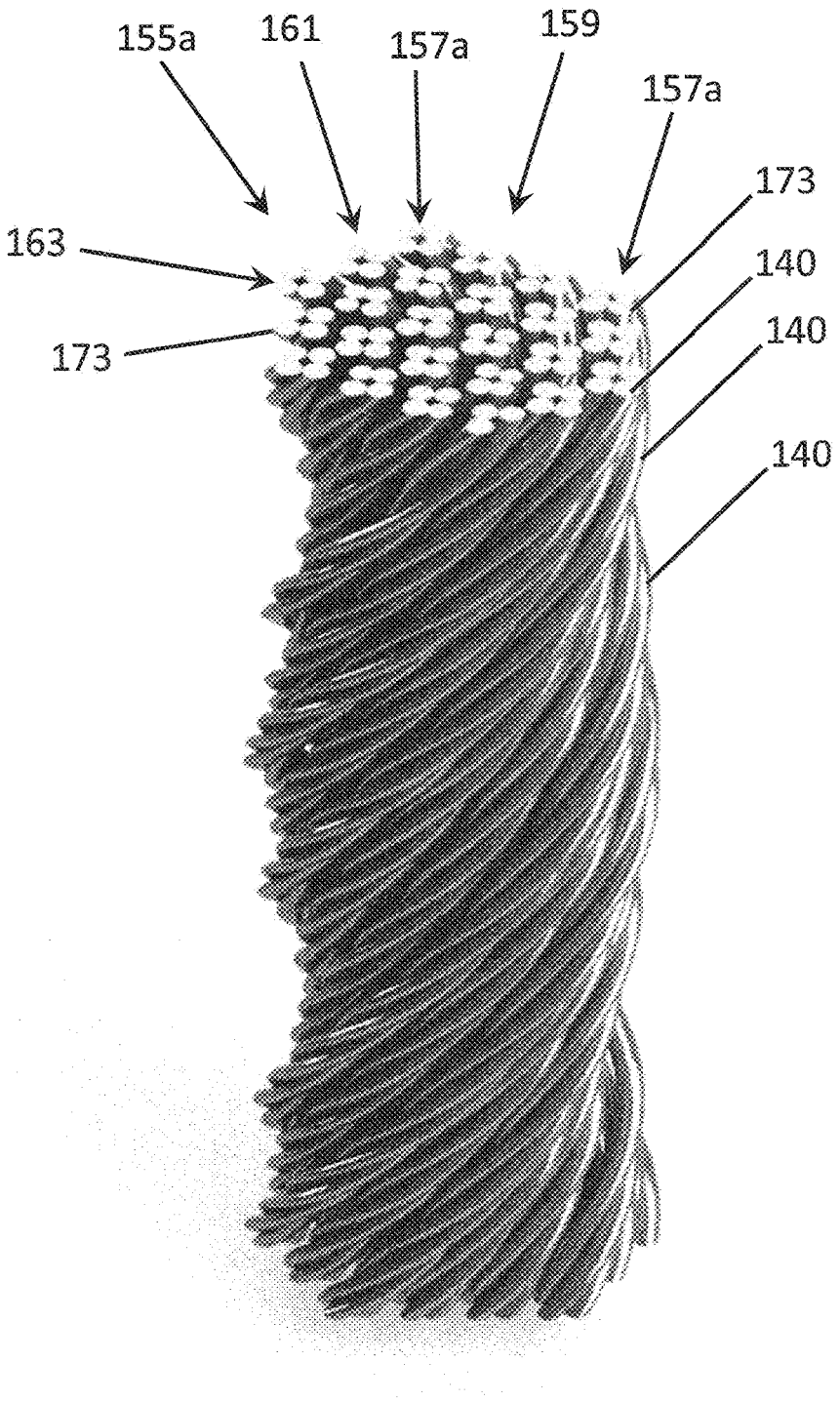
FIG. 11A is a fragmentary elevation view showing still another preferred configuration of a brush wire tuft of the present invention composed of twisted wire strands each formed of twisted wires.
Figure 11B:
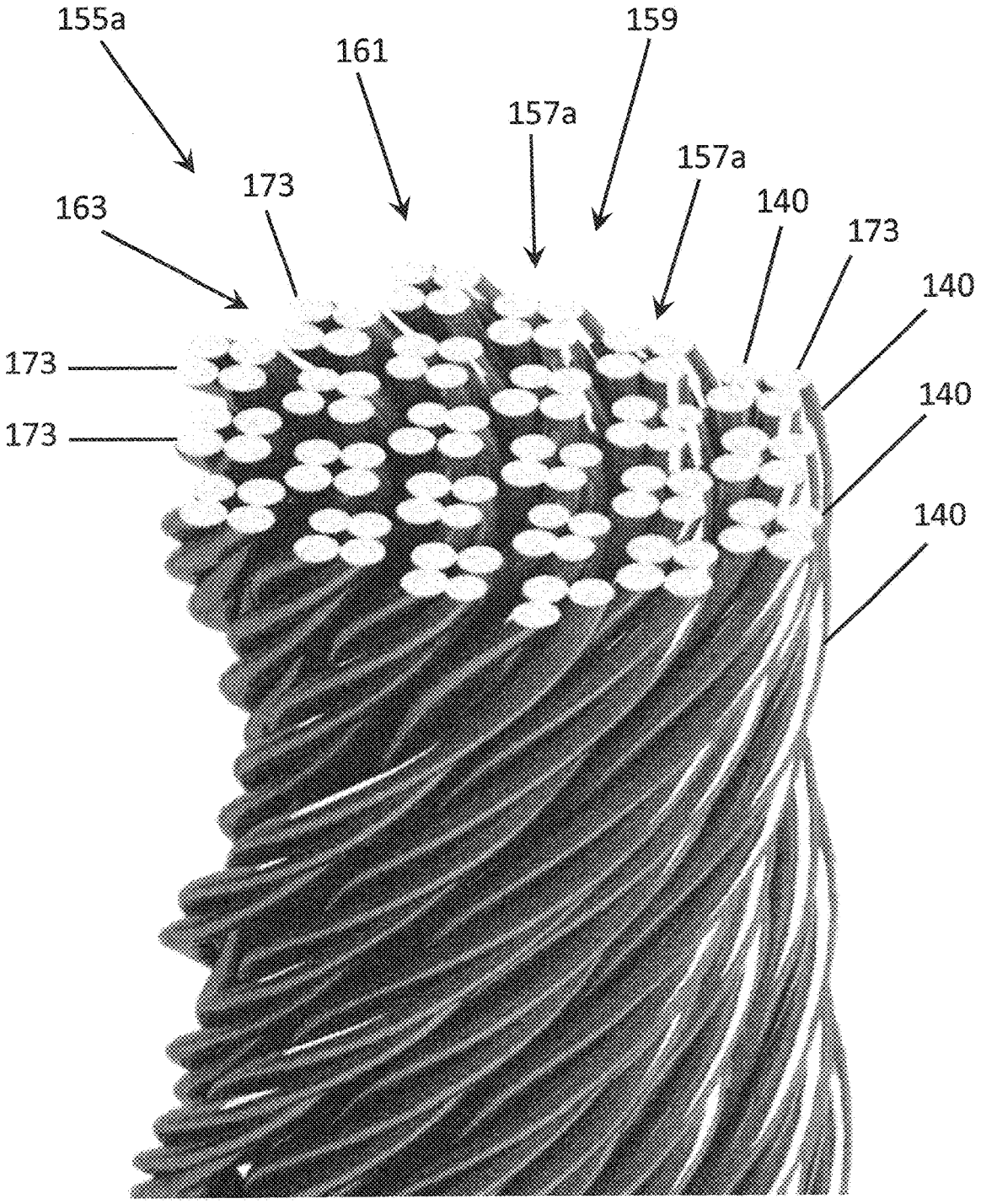
FIG. 11B is an enlarged fragmentary elevation view of the brush wire tuft of FIG. 11A showing more clearly an abrasive brush face of tuft disposed at the free end thereof formed by cut ends of the wires of the strands that make up the tuft.
Figure 11C:
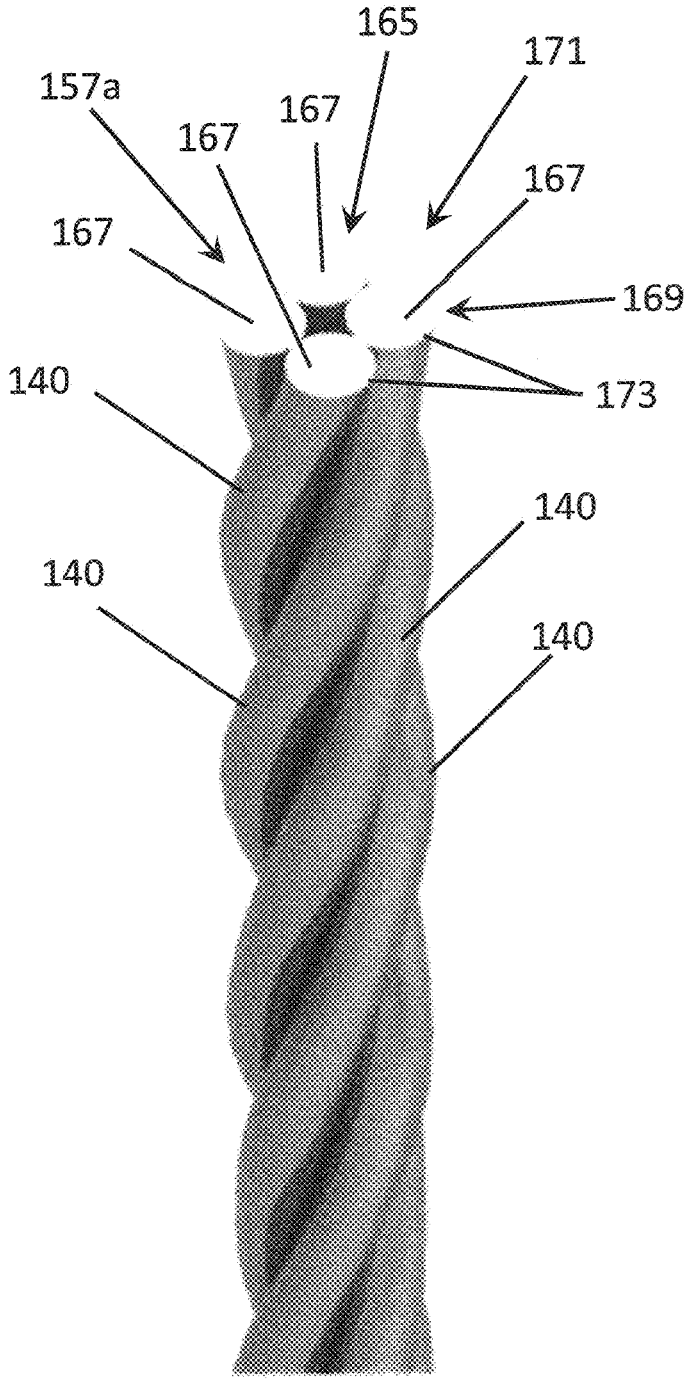
FIG. 11C is a fragmentary elevation view of a preferred configuration of a twisted wire strand used in the brush wire tuft depicted in FIGS. 11A and 11B and formed of at least a plurality of pairs, i.e., at least three, wires twisted together.
Figure 20:
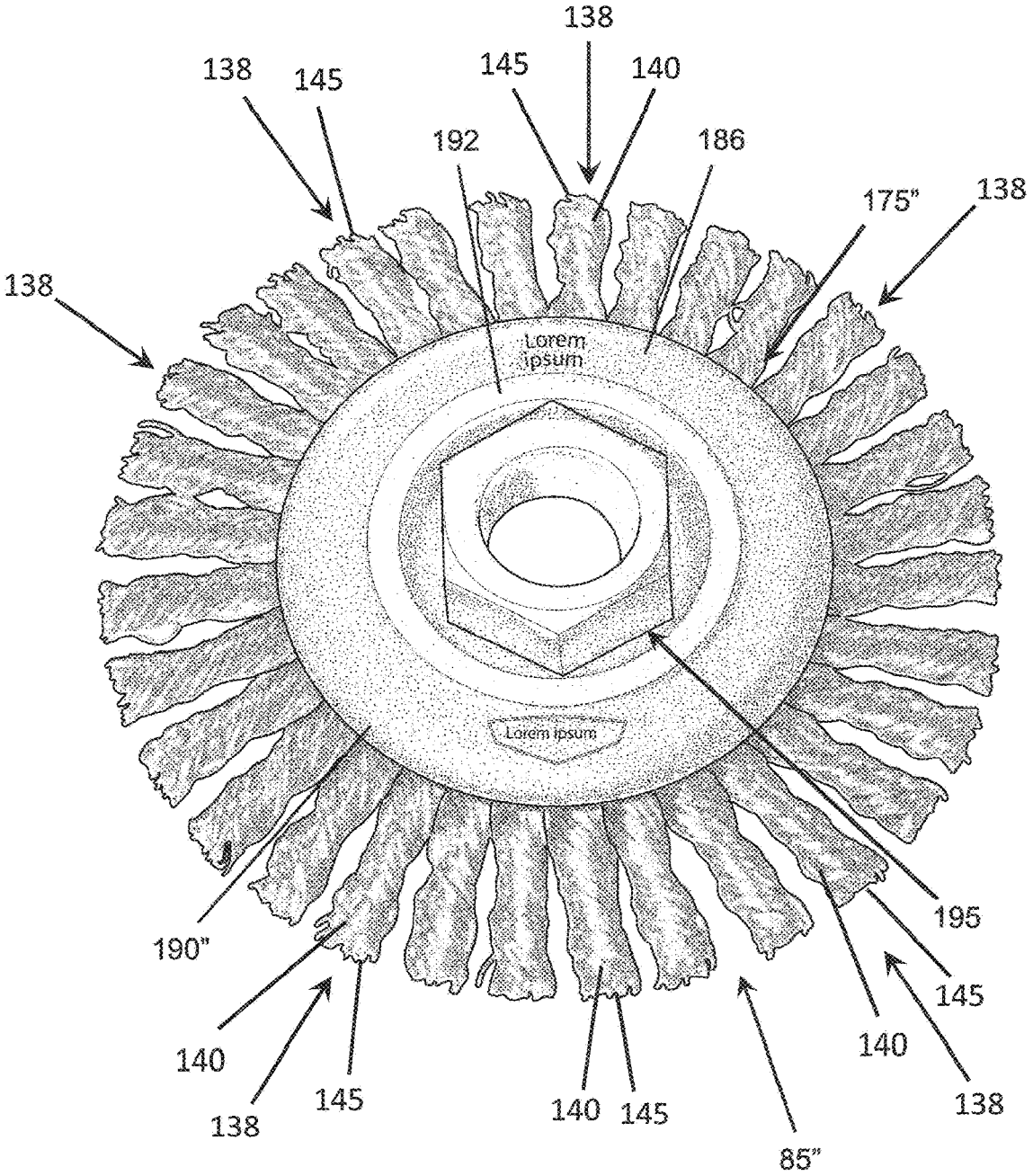
FIG. 20 is a top plan view of a preferred embodiment of a rotary radial wire brush of the invention made with an outer cover plate of having at least one upraised circumferentially extending ridge formed in the plate.

FIGS. 11A-11C illustrate a preferred embodiment of a rotary brush wire tuft 155*a* of twisted wire twisted strand construction that is constructed in accordance with another aspect of the present invention for use in a rotary brush, such as the rotary brush 85 of FIG. 6A, the rotary brush 85' of FIG. 20, the rotary brush 210 of FIG. 6B, or the rotary brush 210 of FIG. 21, having a central brush wire tuft anchor, such as a hub 80, cup, or other disc-shaped and/or annular brush wire tuft support, which is configured for removable attachment to a rotary power tool, such as a grinder, e.g., angle grinder, rotary drill, or the like portion, from which at least a plurality of pairs, i.e., at least three, of the tufts 155*a* outwardly extend. Where used with a rotary brush that is a radial brush or wheel brush, like the wire wheel rotary brushes 85, 85' and 210 respectively depicted in FIGS. 6A, 6B, 20 and 21, a tuft 155*a* constructed in accordance the invention as depicted in FIGS. 11A-11C is substituted in place of at least a plurality, preferably at least a plurality of pairs, i.e. at least three, of the tufts 138 and/or 139, and can be substituted for all of the tufts 138 and/or 139, of these brushes 85, 85' and/or 210.

The brush wire tuft 155*a* shown in FIGS. 11A-11C preferably is a twist knot or twisted knot tuft that is formed of at least a plurality, preferably at least a plurality of pairs, i.e. at least three, of twisted elongate brush wire strands 157*a*, with each strand 157*a* composed of at least a plurality, preferably at least a plurality of pairs, i.e., at least three, of twisted elongate wires 140, with each wire 140 preferably made of a stainless steel or a carbon steel. Tuft 155*a* is formed of twisted strands 157*a* with preferably at least a plurality of pairs, i.e. at least three, and preferably all of the strands 157*a* of the tuft 155*a* twisted together along substantially the entire length of the tuft 155*a*. The strands 157*a* of the tuft 155*a* preferably are twisted together in a helical arrangement, e.g., a twisted interlocking helical arrangement, with a plurality, preferably a plurality of pairs, i.e. at least three, and more preferably all of the strands 157*a* arranged in a helix or helical pattern, when twisted together in the manner depicted in FIGS. 11A and 11B. As also shown in FIGS. 11A and 11B, the wires 140 of the strands 157*a* of the tuft 155*a* are also arranged in a helix or helical pattern as a result of the helically twisted configuration of the strands 157*a*. In a preferred embodiment, tuft 155*a* is configured with its wires 140 that form its strands 157*a* twisted substantially along the length of each strands 157*a*, and configured with its strands 157*a* twisted together substantially along the length of the tuft 155*a* preferably configuring the tuft 155*a* with one of a cable knot, e.g., configures tuft 155*a* into a cable knot tuft, and a stringer bead knot, e.g., configures tuft 155*a* into a stringer bead knot tuft, with tuft 155*a* advantageously possessing increased stiffness, aggressiveness, resilience, toughness, durability and brush wire tuft life while also providing good surface finishing, e.g., polishing, action. Tuft 155*a* is configured with its free end 159 forming a workpiece-engaging tuft face 161 that preferably is generally flat or substantially planar with the workpiece-engaging tuft face 161, preferably a plane 163 of the face 161, generally perpendicular or inclined, e.g., oriented, at an acute angle of less than fifteen degrees relative to an axial direction or lengthwise extent of the substantially straight elongate tuft 155*a* for producing a tuft 155*a* in accordance with the invention that advantageously possesses balanced cutting and surface finishing, e.g., polishing, action.

With continued reference to FIGS. 11A and 11B, a preferred embodiment of the tuft 155*a* is formed of between ten strands 157*a* and forty strands 157*a*, preferably is formed of at least twenty strands 157*a*, and more preferably is formed with about twenty-five strands 157*a*, e.g., formed of 25 strands 157*a*±5 strands 157*a*, with the strands 157*a* twisted together, preferably helically twisted together, substantially the length of the tuft 155*a*, preferably in a manner that configures the tuft 155*a* with or into one of a cable knot, e.g., configures tuft 155*a* into a cable knot tuft, and a stringer bead knot, e.g., configures tuft 155*a* into a stringer bead knot tuft. In a preferred embodiment, tuft 155*a* is formed such that it has at least a plurality, preferably at least a plurality of pairs, i.e., at least three, of twists along its length, e.g., formed such that its strands 157*a* are twisted at least a plurality, preferably at least a plurality of pairs, i.e., at least three, of times along the length of the tuft 155*a*. In one preferred embodiment, tuft 155*a* is formed such that it has at least a plurality, preferably at least a plurality of pairs, i.e., at least three, of twists per inch of length of the tuft 155*a*, e.g., formed such that its strands 157*a* are twisted at least a plurality, preferably at least a plurality of pairs, i.e., at least three, of times per inch of length of the tuft 155*a*. In a preferred tuft embodiment, tuft 155*a* is configured with at least a plurality, preferably at least a plurality of pairs, i.e., at least three, twists per inch with a preferred tuft 155*a* formed with at least five twists along the length of the tuft 155*a*. As is also shown in FIGS. 11A and 11B, the tuft 155*a* has a free end 159 with a generally planar or substantially flat workpiece engaging face 161 that engages the workpiece during rotary brush surface finishing use and operation. This produces a novel tuft 155*a* of the invention with increased performance but which also is better able to dampen shocks and absorb vibration advantageously enabling more continuous contact with the workpiece when the tuft 155*a* is used on a rotary brush.

FIG. 11C illustrates a preferred embodiment of an elongate brush wire tuft strand 157*a* of tuft 155*a* that is composed of a plurality of elongate wires 140, preferably composed of at least a plurality of pairs wires, i.e., at least three, wires twisted together substantially along the length of the strand 157*a*. Each wire 140 of the strand 157*a* is made of stainless or carbon steel and has a common diameter, e.g., same diameter, which can range between 0.008 inches and 0.035 inches, depending on the surface finishing application. As also depicted in FIG. 11C, each strand 157*a* of tuft 155*a* preferably has at least a plurality of pairs of, i.e., at least three, twists along the length of the strand 157*a* and preferably also along the length of the tuft 155*a*. In a preferred tuft embodiment, strand 157*a* is configured with at least a plurality, preferably at least a plurality of pairs, i.e., at least three, twists per inch with a preferred strand 157*a* preferably formed with at least five twists along the length of the strand 157*a*.

With continued reference to FIG. 11C, a preferred strand 157*a* has at least three elongate wires 140 and preferably has four elongate wires 140 twisted substantially the entire length of the strand 157*a*. Each wire 140 twisted together to form the strand 157*a* has a free end 165 that is generally flat or preferably substantially planar forming a workpiece-engaging face 167 with the workpiece-engaging face 167 of all of the wires 140 that form the strand 157*a* disposed along a common plane 169. The angle of each workpiece-engaging face 167 of all of the wires 140 that form the strand 157*a* collectively form a workpiece engaging face 171 of the strand 157*a* that preferably is generally perpendicular or transverse to an axial direction or lengthwise extent of the strand 157*a* in a substantially straight or straightened form before being twisted with other strands 157*a* to form tuft 155*a*. Such a twisted strand 157*a* advantageously possesses a balance of good cutting and surface finishing action while also being durable, resilient and helping to keep the other strands 157*a* and wires 140 of the tuft 155*a* more tightly twisted together for a longer period of time during rotary brush use and operation advantageously increasing brush life. In one preferred strand embodiment, the angle of the workpiece-engaging faces 167 of the wires 140 that form the strand 157*a* and which collectively form the workpiece-engaging face 167 of the strand 157*a* is acutely obliquely angled relative to the axial direction or lengthwise extent of the strand 157*a* in its substantially straight form before being twisted with other strands 157*a* to form tuft 155*a*. Such a twisted strand 157*a* advantageously imparts increased cutting action to the tuft 155*a* while also being durable, resilient and helping to keep the other strands 157*a* and wires 140 of the tuft 155*a* more tightly twisted together for a longer period of time during rotary brush use and operation thereby advantageously increasing brush life.

In the preferred single knot twisted knot brush wire tuft configuration shown in FIGS. 11A and 11B, each multi-stranded brush wire tuft 155*a* is twisted substantially the length of the tuft 155*a* preferably twisted in forming a cable knot or stringer bead knot used to anchor the tuft 155*a* to a disk or hub of a rotary brush. In the preferred multi-stranded brush wire tuft embodiment shown in FIGS. 11A and 11B, each strand 157*a* of the tuft 155*a* is composed of four wires 140 twisted together along the entire length of the strand 157*a* and preferably the tuft 155*a* producing a multi-stranded brush wire tuft 155*a* that is stiffer, yet more springy and resilient, such that it is able to better absorb shocks and vibration during contact with the workpiece during rotary brush use.

With continued reference to FIGS. 11A and 11B, each twisted multi-stranded wire tuft 155*a* is twisted along the entire length of the tuft 155*a* during twist knot attachment or anchoring of the tuft 155*a* to a disk or hub of a rotary brush. The twisted multi-wire strands 157*a*, which in turn are twisted together to form the tuft 155*a* advantageously produce a tuft 155*a* of the invention that is exceptionally stiff, tight and narrow abrasive-faced construction having an abrasive face 161 at its free end 159 with a width or diameter about the same as the combined thickness, width or diameter of the common-diameter wires 140 that form the strands 157*a* which in turn make up the tuft 155*a*. Such a tuft 155*a* formed of twisted multi-strand construction formed of twisted wire strands 157*a* possesses greater stiffness and greater resistance to fraying over time during abrasive material removal use of a rotary brush made with the tufts 155*a* thereby maintaining a greater material removal rate for a longer period of time. A twisted single knot brush wire tuft configured according to the tuft 155*a* shown in FIGS. 11A-11C possesses greater resilience, which not only helps resists, absorb and/or dampen vibration, but which also advantageously helps an operator to keep the abrasive face at the free end of the tufts of a rotary brush made with tufts 155*a* more continuously and uniformly in contact with the workpiece being abrasively treated using the brush.

Another feature of a preferred single twisted knot twisted multi-stranded twisted wire brush wire tuft configured in accordance with the tuft 155*a* shown in FIGS. 11A-11C, is that the abrasive face 161 at the free end 159 of the tuft 155*a* is formed of twisted-wire strands 157*a* whose wires 140 have their free ends cut off in a manner that forms angled flat ends, such as depicted in FIG. 11C, that produce sharp edges 173, e.g., sharp tips, which more aggressively remove material from the workpiece during rotary brush use and operation. The same-diameter twisted wire strands 157*a* formed of wires 140 all having the same diameter as shown in FIGS. 11A-11C, which are in turn twisted together to form the tuft 155*a* better holds the sharp tips or sharp edges 173 of the wires 140 and/or strands 157*a* of the tuft 155*a* for a longer period of time thereby advantageously maintaining higher material removal rates of a rotary brush made with the tufts 155*a* for a longer period of time. Such a twisted multi-wire strand and twisted strand knotted brush wire tuft 155*a* of the present invention has wires 140 relatively tightly twisted together in the configuration shown in FIG. 11C and disclosed above to form stands 157*a*, which are in turn relatively tightly twisted together in the configuration shown in FIGS. 11A and 11B and disclosed above to form tuft 155*a*, the resultant tightly twisted tuft 155*a* is more resilient thereby maintaining the relatively small narrow abrasive face 161 for a longer period of time orienting the cut ends of the twisted wires 140 of the twisted strands 157*a* in a manner that maximizes contact of the sharp tips and/or sharp edges 173 of the wires 140 of the tuft 155*a* with the workpiece during brush use, not only increasing and maximizing material removal rates, but also doing it for a longer period of time as a result of the longer life of the these brush wire tufts In one preferred rotary brush embodiment, all of the tufts 138 and/or 139 of the brushes 85, 85' and/or 210 are replaced with a tuft 155*a* constructed in accordance with that shown in FIGS. 11A-11C and described above. In another preferred rotary brush embodiment, the brushes 85, 85' and/or 210 are configured or constructed with a tuft 155*a* constructed as depicted in FIGS. 11A-11C and described above that extends radially outwardly from one of or both of (a) each one of the radially outermost located brush wire tuft mounting holes, such as the radially outermost located holes 96*a* formed in the hub 80 of the rotary brush 85 or 85' depicted in FIGS. 4A, 4B and 6A, or the radially outermost located holes 220*a* formed in the hub 212 of the brush 210 depicted in FIG. 6B, and/or (b) each one of the radially innermost located brush wire tuft mounting holes, such as the radially innermost located holes 96*b* formed in the hub 80 of the brush 85 or 85' depicted in FIGS. 4A, 4B and 6A, or the radially innermost located holes 220*b* formed in the hub 212 of the rotary brush 210 depicted in FIG. 6B. While such a tuft 155*a* configured in accordance with the present invention is particularly well suited for use in or with radial brushes and wheel brushes, such as of the type generally shown in FIGS. 6A, 6B, 17, 20 and 21, the tuft 155*a* can also be used in or with other types of brushes, including cup brushes, e.g., knotted wire or knotted tuft cup brushes, bevel brushes or beveled brushes, e.g., knotted bevel brushes and/or knotted beveled brushes, and end brushes, e.g., knotted end brushes.

Figure 12A:
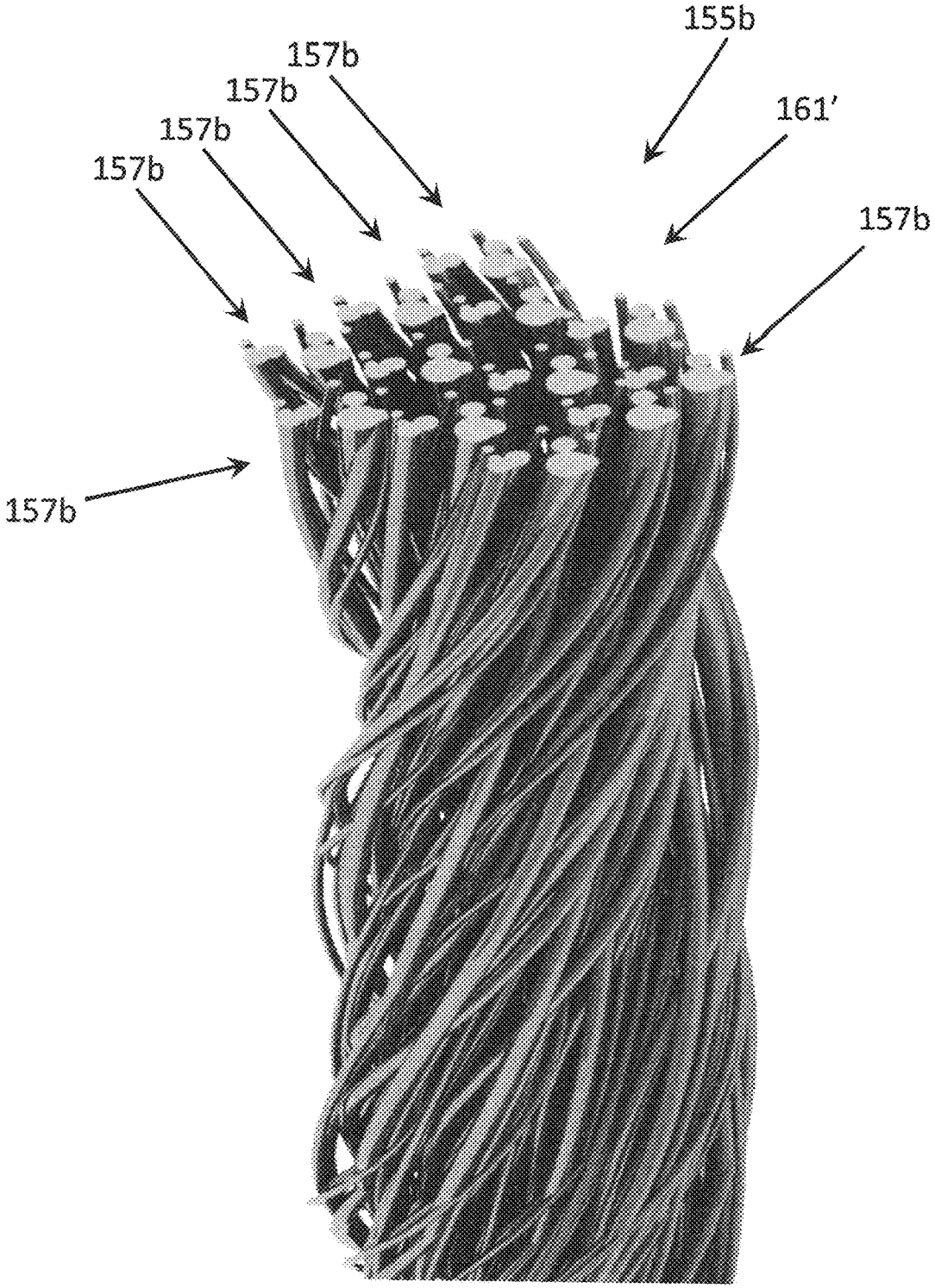
FIG. 12A is a fragmentary elevation view depicting still another preferred configuration of a brush wire tuft of the present invention composed of twisted strands with each strand formed of twisted and braided wires.

FIG. 12A illustrates another preferred embodiment of a rotary brush wire tuft 155*b*, which is of twisted and braided construction, which is constructed in accordance with still another aspect of the present invention for use in a rotary brush, such as the rotary brush 85 of FIG. 6A, the rotary brush 85' of FIG. 20, the rotary brush 210 of FIG. 6B, or the rotary brush 210 of FIG. 21, having a central brush wire tuft anchor, such as a hub 80, cup, or other disc-shaped and/or annular brush wire tuft support, which is configured for removable attachment to a rotary power tool, such as a grinder, e.g., angle grinder, rotary drill, or the like portion, from which at least a plurality of pairs, i.e., at least three, of the tufts 155*a* outwardly extend. Where used with a rotary brush that is a radial brush or wheel brush, like the wire wheel rotary brushes 85, 85' and 210 respectively depicted in FIGS. 6A, 6B, 20 and 21, a tuft 155*b* constructed in accordance the invention as depicted in FIGS. 12A and 12B is substituted in place of at least a plurality, preferably at least a plurality of pairs, i.e. at least three, of the tufts 138 and/or 139, and can be substituted for all of the tufts 138 and/or 139 of these brushes 85, 85' and/or 210.

The brush wire tuft 155*b* shown in FIG. 12A is of a twisted and braided configuration formed of at least a plurality of, preferably at least a plurality of pairs of, i.e., at least three, elongate braided wire strands 157*b* twisted together substantially the length of the tuft 155*b*. Each strand 157*b* is of a braided configuration formed of at least a plurality of, preferably at least a plurality of pairs of, i.e. at least three, elongate stainless and/or carbon wires 140, 140', and 140" of at least a plurality, preferably at least a plurality of pairs of, i.e. at least three, wire diameters ranging between 0.008 inches and 0.035 inches woven, preferably braided, together, such as in the manner depicted in FIG. 12B. A tuft 155*b* formed of twisted together strands 157*b* made of at least a plurality of pairs of, i.e., at least three, wires 140, 140' and 140" woven together, preferably braided together, produces a brush wire tuft 155*b* in accordance with the present invention having a workpiece-contacting tuft face 161' formed of ends of wires 140, 140' and 140" spaced apart from one another forming a tuft face 161' that engages a larger surface area than that of the collective diameters of the wires 140, 140' and 140" that form the strands 157*b* that make up the tuft 155*b*.

Figure 12B:
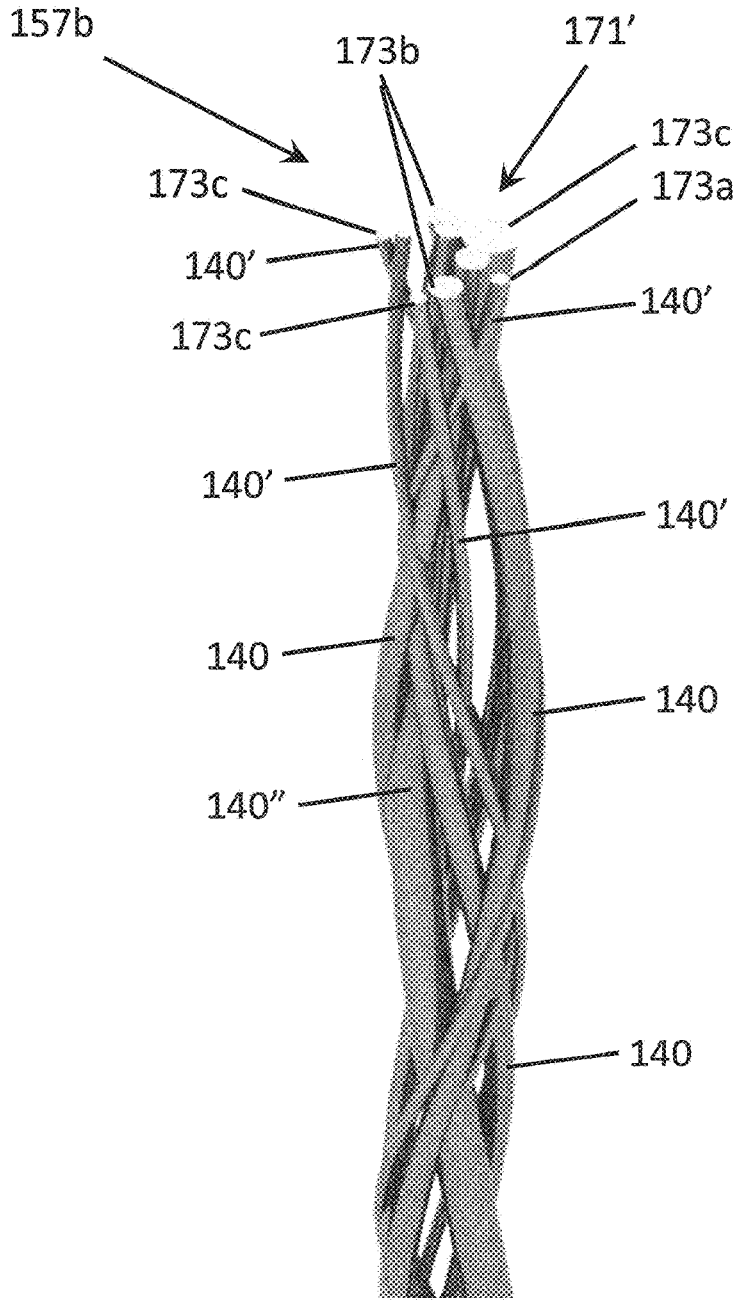
FIG. 12B is a fragmentary elevation view of a preferred configuration of a twisted and braided wire strand used in the brush wire tuft depicted in FIG. 12A and formed of wires having different diameters braided and twisted together.

FIG. 12B illustrates a segment of a preferred embodiment of an elongate twisted and braided strand 157*b* configured for use in a preferred embodiment of the tuft 155*b* shown in FIG. 12A where the strand 157*b* employs at least a plurality of pairs of, i.e., at least three, elongate wires 140, 140' and 140" having at least a plurality, preferably at least a plurality of pairs, i.e., at least three, of different diameters woven together, preferably braided together, in the manner depicted in FIG. 12B to form strand 157*b*. In a preferred embodiment of a braided strand 157*b* of a tuft 155*b* of the present invention, strand 157*b* is composed of at least three wires 140, 140' and 140" having at least three different wire diameters that are woven together, preferably loosely braided together, in a loose round braid configuration. Strand 157*b* preferably is composed of at least three wires 140, 140' and 140" respectively of at least three different diameters where each wire 140 of a first wire diameter, preferably smallest wire diameter, is formed into a first helix during braiding into strand 157*b* that has a first pitch or first number of turns, each wire 140' of a second wire diameter, preferably diameter larger than wire 140, is formed into a second helix during braiding into strand 157*b* having a second pitch or second number of turns less than the pitch and number of turns of the helix of wire 140, and each wire 140" of a third wire diameter, preferably diameter greater than the diameter of both of the other wires 140 and 140', is formed into a third helix during braiding into strand 157*b* having a third pitch and third number of turns that is less than the pitch and number of turns of the helixes of both of the other wires 140 and 140'. Use of a woven, preferably braided, configuration, preferably a loose round braid configuration, produces a strand 157*b* with the surfaces at the ends of the woven together, preferably braided together, wires 140, 140' and 140" that form a plurality of pairs of, i.e., at least three, respectively differently sized the sharp workpiece-engaging ends or tips 173*a*, 173*b*, and 173*c* being spaced apart producing an expanded strand workpiece-engaging face 171' that cuts, abrades, finishes or polishes a wider or larger swath, greater width or wider path than if the ends of the wires 140, 140' and 140" were bunched together. As a result, a tuft 155*b* formed of such woven, preferably braided, strands 157*b* twisted together in the twisted strand configuration depicted in FIG. 12A has a workpiece engaging face 161 with an effective workpiece engaging surface area abrasively treated thereby greater, preferably at least one and a half times greater, than the combined diameters of the wires 140, 140' and 140" if bunched together at the free end of the strand 157*b* and with the strands 157*b* forming the tuft bunched together. As a result, a tuft 155*b* of twisted strand braided wire construction abrasively treats or finishes a wider swath and/or greater area of the workpiece during use and operation of a rotary brush made with the twisted and braided tufts 155*b* of the invention.

With continued reference to FIG. 12B, the braided strand 157*b* is formed of an elongate spine wire 140" having the largest diameter around which a plurality, preferably at least a plurality of pairs, i.e., at least three, of wires 140, 140', having at least a plurality of different diameters are wrapped, preferably woven, and more preferably braided. In one preferred braided strand embodiment, strand 157*b* is formed of at least four wires 140, 140' and 140" having at least three different wire diameters that are wrapped around at least one spine wire 140" preferably by weaving, more preferably braiding, the wires 140, 140' and 140" together with the largest diameter spine wire 140" preferably being stiffest thereby providing support to the rest of the wires 140 and 140' of the strand 157*b*. Such a strand configuration with strand 157*b* being configured with a stiffer largest diameter spine wire 140" not only provides structural support to the rest of the wires wrapped around it in a woven or braided configuration but the stiffer spine wire 140" of each strand 157*b* of tuft 155*b* provides more aggressive abrasive material removal with successively narrower, thinner and more flexible wires 140 and 140' of each strand 157*b* of tuft 155*b* providing successively greater polishing or surface finishing of a workpiece during treatment with a rotary brush equipped with tufts 155*b*. The result is a brush wire tuft 155*b* constructed in accordance with the invention that is configured to provide a wider path of engagement with the workpiece and provide a balanced blend of aggressiveness and increase surface finish quality as a result when a rotary brush with tufts 155*b* of this configuration are used in surface finishing treatment of a workpiece.

Strand 157*b* is formed of at least four wires 140, 140' and 140", preferably formed of between six wires and ten wires, more preferably formed of about eight wires having at least a plurality of different diameters, preferably having at least three different diameters ranging between 0.008 inches and 0.035 inches that are woven together, preferably braided together in a round braid configuration. In a preferred embodiment, strand 157*b* is formed of at least largest diameter spine wire 140", a first plurality of wires 140 of a first diameter smaller than the diameter of the spine wire 140", and a second plurality of wires 140' of a second diameter smaller than the spine wire 140" but larger in diameter than the diameter of wires 140. In one such preferred diameter, strand 157*b* is formed of eight wires 140, 140' and 140" of three different diameters ranging between 0.008 inches and 0.035 inches woven, preferably braided together in a loose round braid configuration where portions of the wires 140, 140' and 140" are spaced from each other along the length of the strand 157*b*, there are at least three differently sized sharp workpiece-engaging ends or tips 173*a*, 173*b*, and 173*c* of the wires 140, 140' and 140" of the strand 157*b*, and the sharp workpiece-engaging ends or tips 173*a*, 173*b*, and 173*c* are not coplanar, i.e., not disposed in or along the same plane.

With reference once again to FIG. 12A, a preferred embodiment of tuft 155*b* is formed of between eight and twenty strands 157*b*, preferably between ten and fifteen strands 157*b*, and more preferably about twelve strands 157*b*, twisted together substantially the length of the tuft 155*b* at least a plurality of times, preferably at least a plurality of pairs of, i.e., at least three, times along the length of the tuft 155*b*. In the preferred tuft 155*b* of FIG. 12A, the braided multi-diameter wire strands 157*b* are grouped or arranged after twisting to form tuft 155*b* in a manner where the abrasive tuft face 171' of the tuft 155*b* is generally rectangular, e.g., square, as shown in FIG. 12A. As is also shown by FIG. 12A and FIG. 12B, the sharp workpiece-engaging ends or tips 173*a*, 173*b*, and 173*c* of the wires 140, 140' and 140" of each one of the strands 157*b* of the tuft 155*b* are spaced apart with the respective ends 173*a*, 173*b* and 173*c* of wires 140, 140' and 140" of each strand 157*b* being spaced apart and not coplanar. In one preferred embodiment of tuft 155*b* depicted in FIG. 12A, (a) the ends 173*a* of wires 140 of each one of the strands 157*b* of the tuft 155*b* are obliquely acutely angled and generally coplanar with each other, (b) the ends 173*b* of wires 140' of each one of the strands 157*b* of the tuft 155*b* are obliquely acutely angled and generally coplanar with each other, and (c) the ends 173*c* of wires 140" of each one of the strands 157*b* of the tuft 155*b* are obliquely acutely angled and generally coplanar with each other but the ends 173*a*, 173*b*, and 173*c* of the wires 140, 140' and 140" of the strands 157*b* of the tuft 155*b* are not coplanar. While such a tuft 155*b* shown in FIG. 12A and configured in accordance with the present invention is particularly well suited for use in or with radial brushes and wheel brushes, such as of the type generally shown in FIGS. 6A, 6B, 17, 20 and 21, the tuft 155*a* can also be used in or with other types of brushes, including cup brushes, e.g., knotted wire or knotted tuft cup brushes, bevel brushes or beveled brushes, e.g., knotted bevel brushes and/or knotted beveled brushes, and end brushes, e.g., knotted end brushes.

Figure 13:
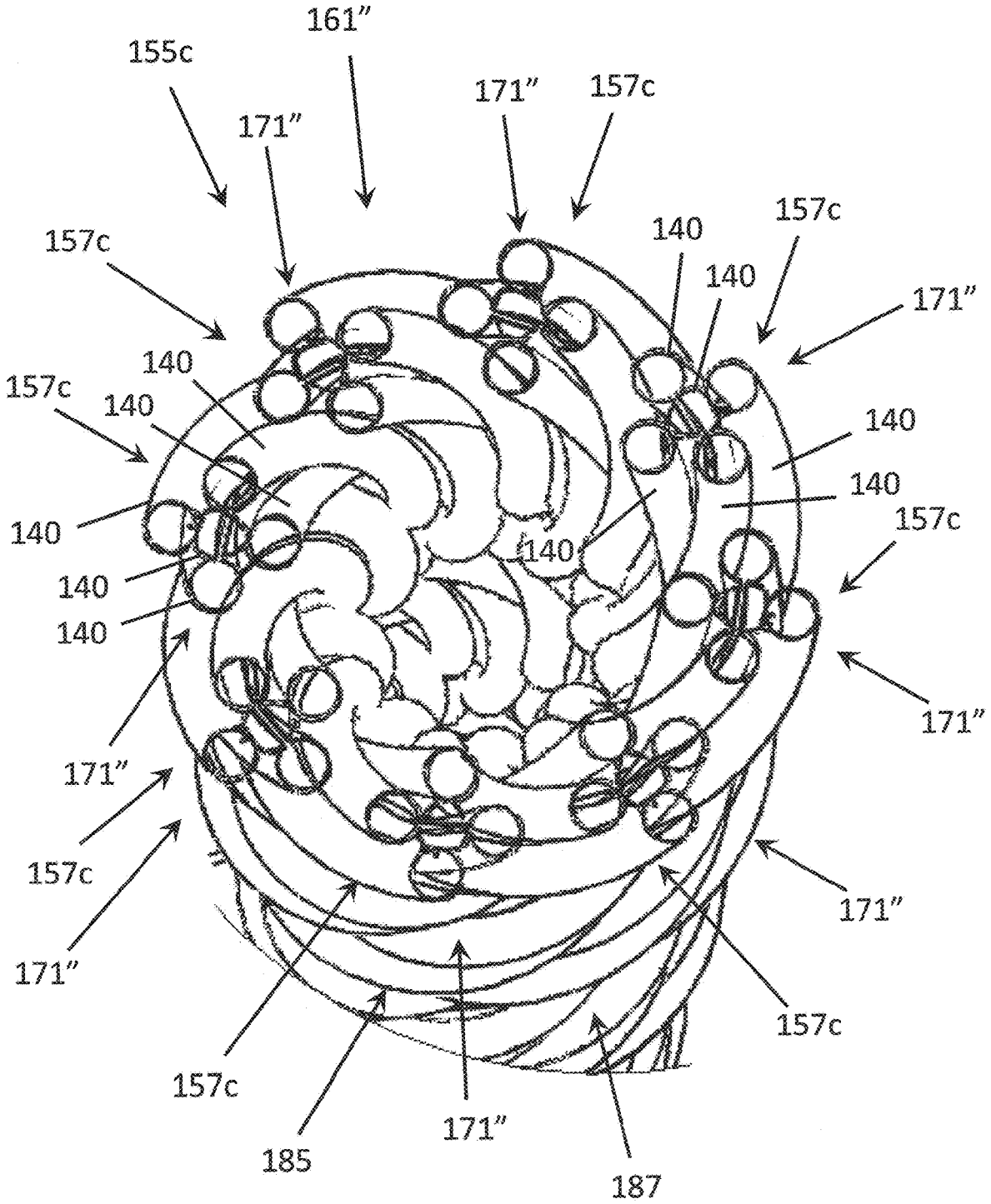
FIG. 13 is a fragmentary perspective end view of a further preferred configuration of a brush wire tuft of the present invention composed of twisted wire strands braided and/or woven together to form a generally cylindrical or tubular tuft.

FIG. 13 illustrates a further preferred embodiment of a rotary brush wire tuft 155*c*, which is of tubular, preferably generally cylindrical, and helical twisted wire strand configuration formed of at least a plurality of pairs of multiwire strands 157*c* having the wires 140 of each strand 157*c* twisted about their length and arranged in a closed helix such that the strands 157*c* of the tuft 155*c* form a generally cylindrical wall of the tuft 155*c*. Such a tubular generally cylindrical tuft 155*c* with an annular sidewall formed of at least a plurality of pairs of, i.e., at least three, helical twisted wire strands 157*c* is constructed in accordance with a further aspect of the present invention for use in a rotary brush, such as the radial or wire wheel rotary brush 85 of FIG. 6A, the rotary brush 85' of FIG. 20, the radial or wheel brush 210 of FIG. 6B, or the radial or wheel brush 210 of FIG. 21, but preferably is particularly well suited for use as a tuft 155*c* in another type of rotary brush that preferably is an end brush having elongate tufts 155*c* extending from a hub axially outwardly generally parallel to an axis of rotation of the brush with the tufts 155*c* arranged in an annular pattern of such an end brush. Where used with a rotary brush that is a radial brush or wheel brush, like the wire wheel rotary brushes 85, 85' and 210 respectively depicted in FIGS. 6A, 6B, 20 and 21, a tuft 155*c* constructed in accordance the invention as depicted in FIGS. 12A and 12B is substituted in place of at least a plurality, preferably at least a plurality of pairs, i.e. at least three, of the tufts 138 and/or 139, and can be substituted for all of the tufts 138 and/or 139 of these brushes 85, 85' and/or 210.

With continued reference to FIG. 13, a preferred embodiment of a rotary brush wire tuft 155*c* constructed in accordance with the present invention is formed of between four and fifteen helically coiled twisted wire strands 157*c*, preferably between five and ten helically coiled twisted wire strands 157*c*, and more preferably about eight helically coiled twisted wire strands 157*c*, e.g., eight helically coiled twisted wire strands 157*c*±one helically coiled twisted wire strand 157*c*. Each strand 157*c* is formed of at least a plurality, preferably at least a plurality of pairs of, i.e., at least three, elongate wires 140 twisted together with the twisted wires 140 helically formed into a cylindrical twisted wire coil 185 with the helical coils 185 of adjacent strands 157*c* helically overlapping one another such that there is at least a plurality of pairs, i.e., at least three helically overlapping helical strands 157*c* in overlapping contact with one another forming an annular generally cylindrical tuft sidewall 187 like the annular sidewall 187 depicted in FIG. 13. Each such tuft 155*c* is more resilient and better absorbs vibration and shocks during use as it is of cylindrical coil-like spring energy absorbing construction that significantly increase the operating life of each tuft 155*c* as well as a rotary brush made with such tufts 155*c*.

In one preferred tuft embodiment, one or more wires 140 of one of the helically coiled overlapping strands 157*c* can be and preferably are interlocked, such as by being braided with one or more wires 140 of an adjacent overlapping one of the helically coiled helical strands 157*c*. In another preferred embodiment, helically overlapping helically coiled strands 157*c* are twisted or braided together with one or more adjacent overlapping helically coiled helical strands 157*c* producing a hybrid energy absorbing torsion spring and coil spring like brush tuft arrangement that is more resilient and better dampens vibration during brush operation.

As is also shown in FIG. 13, each helically formed strand 157*c* is formed of at least a plurality of pairs of, i.e., at least three, elongate stainless or carbon steel wires 140 each having a diameter ranging between 0.008 inches and 0.035 inches with each one of the wires 140 of the each strand 157*c* preferably having the same wire diameter. A preferred strand 157*c* is formed of between four and six wires 140, preferably about five wires 140, arranged in an X configuration like that depicted in FIG. 13 with a center wire 140 surrounded by four outer wires 140 in a rectangular, e.g., square, configuration as also shown in FIG. 13.

With reference to FIG. 13, each tuft 155*c* is formed of multi-wire strands 157*c* each composed of at least a plurality of pairs of wires 140 and preferably formed of at least four and preferably five or about five wires 140 twisted together with a preferred wire configuration having four wires 140 twisted and/or braided around an elongate center wire 140. In a preferred embodiment, the outer wires 140 of each strand 157*c* are helically twisted and/or braided around the center wire 140 with each strands 157*c* in turn twisted and/or braided in a manner that forms an annular abrasive brush face at the free end of a generally cylindrical hollow brush wire tuft 155*c* of FIG. 13. The formation of such a cylindrical hollow brush tuft 155*c* like that depicted in FIG. 13 advantageously reduces brush weight and tuft weight thereby helping to reduce operator fatigue. In addition, the twisted and braided hollow cylindrical brush tuft configuration imparts a torsion-spring energy absorption and/or vibration dampening to the tuft 155*c* that better helps orient the angled or inclined sharp edges or tips at the free end of the wires 140 of each strand 157*c* of each tuft 155*c* relative to the workpiece to provide an increased rate of material removal where material removed during surface finishing is more uniformly removed. Such torsion-spring cylindrical tuft 155*c* constructed in accordance with the present invention also helps better resist vibration and absorbs shocks during brush use while better maintaining the relatively tightly twisted cylindrical shape of each tuft 155*c* of the brush for a longer period of time advantageously increasing brush life.

With continued reference to FIG. 13, tuft 155*c* has a workpiece engaging tuft face 161" formed of a plurality of pairs of, i.e., at least three, of workpiece engaging faces 171" of the strands 157*c* formed by sharp edges or tips 173" of the wires 140 of the respective strands 157*c* that form the tuft 155*c*. As is shown in FIG. 13, the workpiece engaging faces 171" of the strands 157*c* are arranged in a circle, e.g., annularly spaced apart, with the sharp edges or tips 173" of the wires 140 of each strand 157*c* preferably generally coplanar with each one of the workpiece engaging faces 171" of the strands 157*c* of the tuft 155*c* preferably also generally coplanar. Such a tuft 155*c* constructed in accordance with the present invention has good aggressiveness and an extraordinarily long brush life as a result of the energy absorbing vibration dampening torsion spring brush wire tuft configuration of tuft 155*c*. While such a tuft 155*c* shown in FIG. 13 and configured in accordance with the present invention can be adapted for use in or with radial brushes and wheel brushes, such as of the type generally shown in FIGS. 6A, 6B, 17, 20 and 21, the tuft 155*c* is particular well suited for use in end brushes having at least three, and preferably at least four of the tufts 155*c* extending generally axially parallel to an axis of rotation of the end brush. If desired, tufts 155*c* constructed in accordance with the present invention can also be used on or with other types of rotary brushes, including bevel or beveled brushes, and cup brushes.

In a preferred embodiment, any one of the aforementioned rotary brushes disclosed herein, including the four inch, five inch and seven inch rotary wire wheel brushes, can be configured with brush tufts 138 and/or 139 of the following construction: (a) strands 157 each composed of one stainless or carbon steel wire 140 of 0.20 inch diameter and four thinner stainless or carbon steel wires 140 of 0.012 inch diameter twisted together to form the strand 157 with each knot or brush wire tuft 155 of the brush formed of between 6-10 strands twisted together, (b) strands 157 each composed of one stainless or carbon steel wire 140 of 0.12 inch diameter and four thinner stainless or carbon steel wires 140 of 0.008 inch diameter twisted together to form the strand 157 with each knot or brush wire tuft 155 of the brush formed of between 10-14 strands twisted together, (c) strands 157 each composed of one stainless or carbon steel wire 140 of 0.12 inch diameter and four thinner stainless or carbon steel wires 140 of 0.008 inch diameter braided together to form the strand 157 with each knot or brush wire tuft 155 of the brush formed of between 10-14 strands braided together; (d) strands 157 each composed of one stainless or carbon steel wire 140 of 0.12 inch diameter and four thinner stainless or carbon steel wires 140 of 0.008 inch diameter braided together to form the strand 157 with each knot or brush wire tuft 155 of the brush formed of between 8-16 strands braided together; (e) strands 157 each composed of 2-3 stainless or carbon steel wires 140 of 0.20 inch diameter twisted together to form the strand 157 with each knot or brush wire tuft 155 of the brush formed of between 6-16 strands twisted together; (f) strands 157 each composed of 2-3 stainless or carbon steel wires 140 of 0.16 inch diameter twisted together to form the strand 157 with each knot or brush wire tuft 155 of the brush formed of between 6-16 strands twisted together; (g) strands 157 each composed of 2-3 stainless or carbon steel wires 140 of 0.14 inch diameter twisted together to form the strand 157 with each knot or brush wire tuft 155 of the brush formed of between 6-16 strands twisted together; (h) strands 157 each composed of 4-6 stainless or carbon steel wires 140 of 0.12 inch diameter twisted together to form the strand 157 with each knot or brush wire tuft 155 of the brush formed of between 6-16 strands twisted together; (i) strands 157 each composed of 4-6 stainless or carbon steel wires 140 of 0.10 inch diameter twisted together to form the strand 157 with each knot or brush wire tuft 155 of the brush formed of between 6-16 strands twisted together; (j) strands 157 each composed of 5-8 stainless or carbon steel wires 140 of 0.008 inch diameter twisted together to form the strand 157 with each knot or brush wire tuft 155 of the brush formed of between 6-16 strands twisted together; (k) strands 157 each composed of 5-8 stainless or carbon steel wires 140 of 0.008 inch diameter braided together to form the strand 157 with each knot or brush wire tuft 155 of the brush formed of between 6-16 strands braided together; (l) strands 157 each composed of 4-6 stainless or carbon steel wires 140 of 0.010 inch diameter braided together to form the strand 157 with each knot or brush wire tuft 155 of the brush formed of between 6-16 strands braided together; (m) strands 157 each composed of 4-6 stainless or carbon steel wires 140 of 0.012 inch diameter braided together to form the strand 157 with each knot or brush wire tuft 155 of the brush formed of between 6-16 strands braided together; (n) strands 157 each composed of 3-5 stainless or carbon steel wires 140 of 0.014 inch diameter braided together to form the strand 157 with each knot or brush wire tuft 155 of the brush formed of between 6-16 strands braided together; (o) strands 157 each composed of 3-4 stainless or carbon steel wires 140 of 0.016 inch diameter braided together to form the strand 157 with each knot or brush wire tuft 155 of the brush formed of between 6-16 strands braided together; and/or (p) strands 157 each composed of 2-3 stainless or carbon steel wires 140 of 0.020 inch diameter braided together to form the strand 157 with each knot or brush wire tuft 155 of the brush formed of between 6-16 strands braided together.

Figure 14:
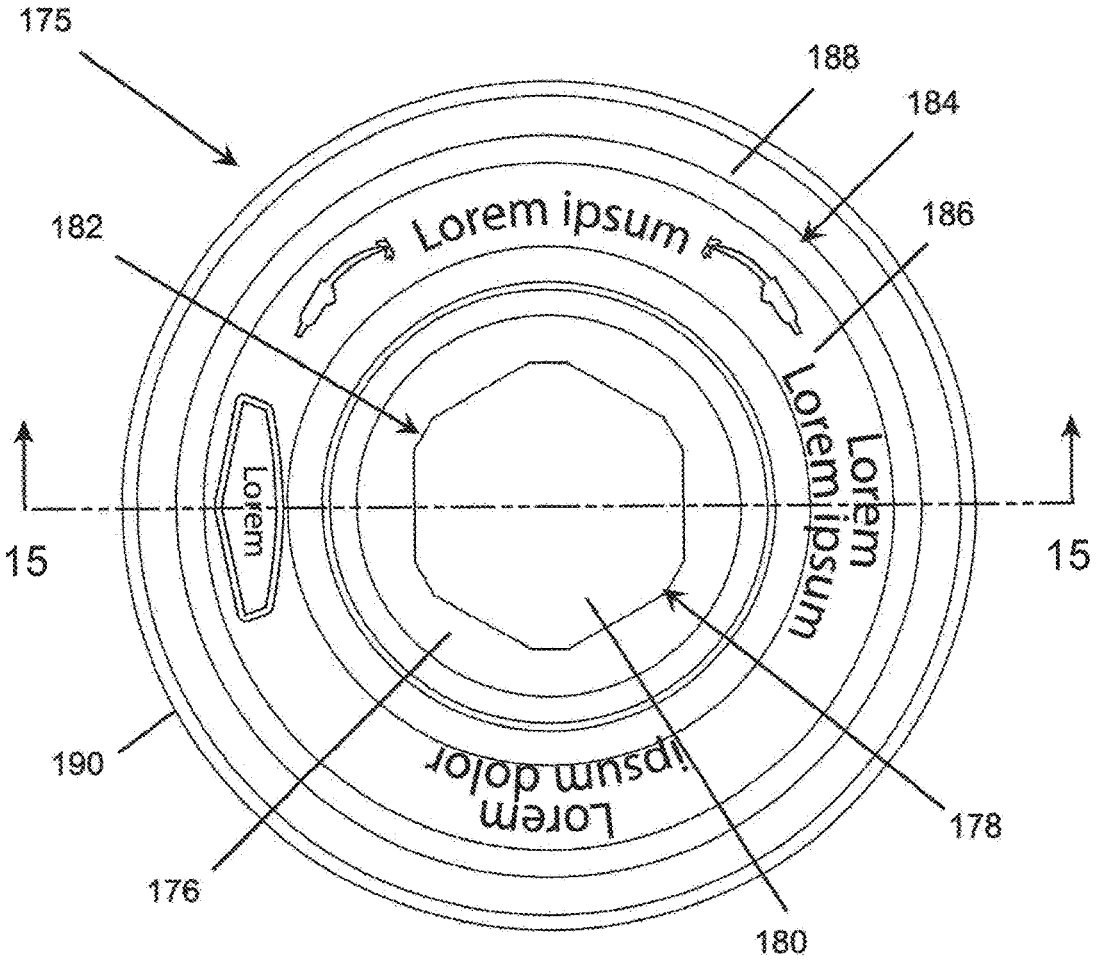
FIG. 14 illustrates an exemplary embodiment of a cover plate configured for use with a rotary brush of the present invention constructed in accordance with the embodiments depicted in FIGS. 4-6B.
Figure 15:
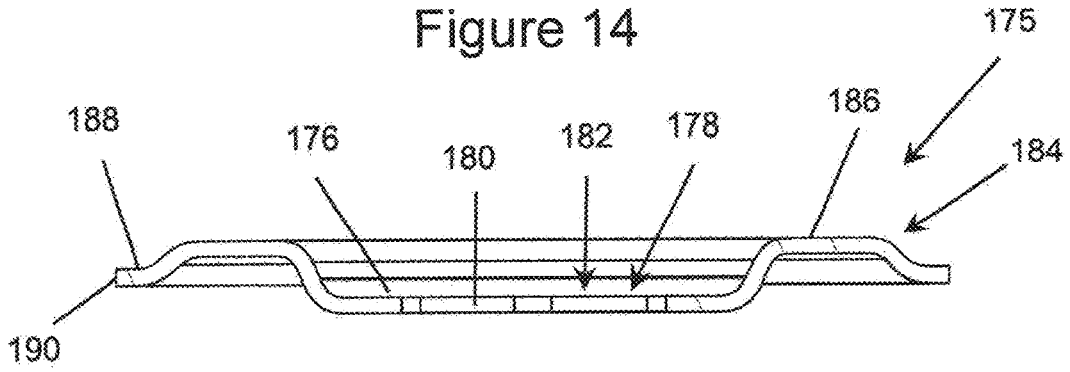
FIG. 15 illustrates a cross-section of the cover plate of FIG. 14 taken through line 15-15 of FIG. 14.
Figure 16:
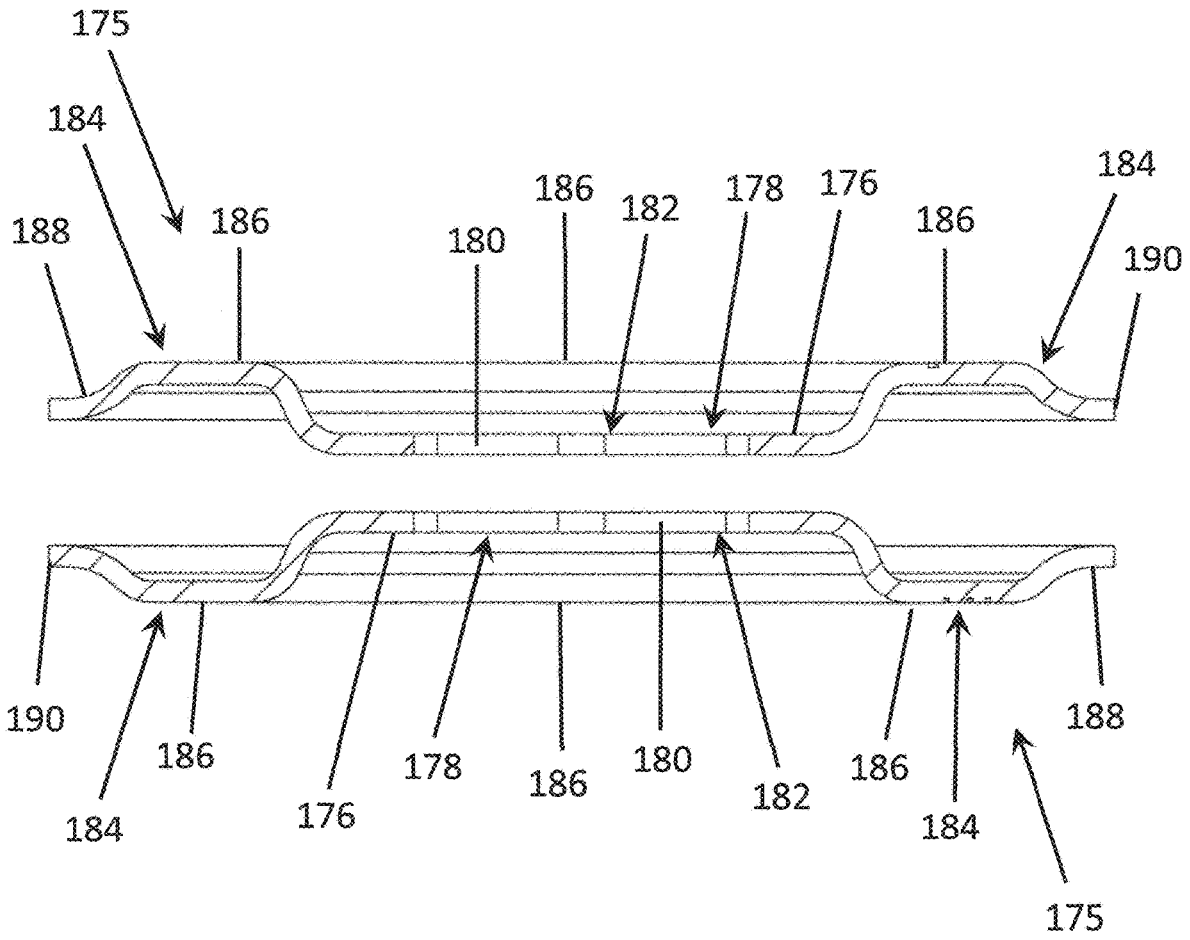
FIG. 16 is a cross-sectional view of a pair of the cover plates of FIG. 14, with the remainder of the components of the rotary brush removed for clarity.

With additional reference to FIGS. 14, 15, and 16 a rotary radial wire brush, e.g., brush 85, constructed in accordance with the present invention can and preferably is constructed with a pair of generally annular or circular cover plates 175, e.g., face plates, which are three dimensionally contoured or three dimensionally formed in a manner that increases the strength, torsional rigidity, torque handling ability, stiffness, reduces flexure or produces a rotary radial wire brush having one or more improved or beneficial characteristics. FIG. 16 shows both cover plates 175 overlying one another with the hub and brush wire tufts of the brush removed for clarity. As shown in FIGS. 14-16, each one of the plates 175 that sandwich the hub 80 (not shown in FIGS. 14-16) in forming a rotary radial brush assembly of the invention has a recessed generally planar annular hub center hub mounting well 176 with a brush mount 178 that can be in the form of an opening 180 such as a generally hexagonal arbor hole 182 for releasable mounting to a rotary power tool or the like, such as by way of using a mounting nut arrangement, e.g., mounting nut assembly 195 (FIG. 17), coupling assembly or the like. At least one and preferably both of the plates 175 have an upraised axially outwardly extending three dimensionally formed annular plate-stiffening hat or crown 184 extending radially outwardly of the centrally located hub mounting well 176 that preferably is circumferentially uninterrupted which also helps minimize and preferably substantially completely prevent wobble during brush rotation. As is best shown in FIG. 15, the hat or crown 184 includes an annular generally planar outer axial face 186 which carries labeling and other indicia, e.g., graphics, such as in the manner depicted in FIG. 14. Each plate 175 can have a generally planar annular flange 188 that extends radially outwardly of or from the hat or crown 184 that can and preferably does abut or seat against a corresponding one of the outer surfaces 88, 90 of the hub 80 when mounted or otherwise coupled thereto during brush assembly. Where each plate 175 is configured with such a radially outer annular flange 188, the flange 188 preferably is bounded by a radially outer peripheral edge 190 that extends completely about the periphery of each plate 175.

Figure 17:
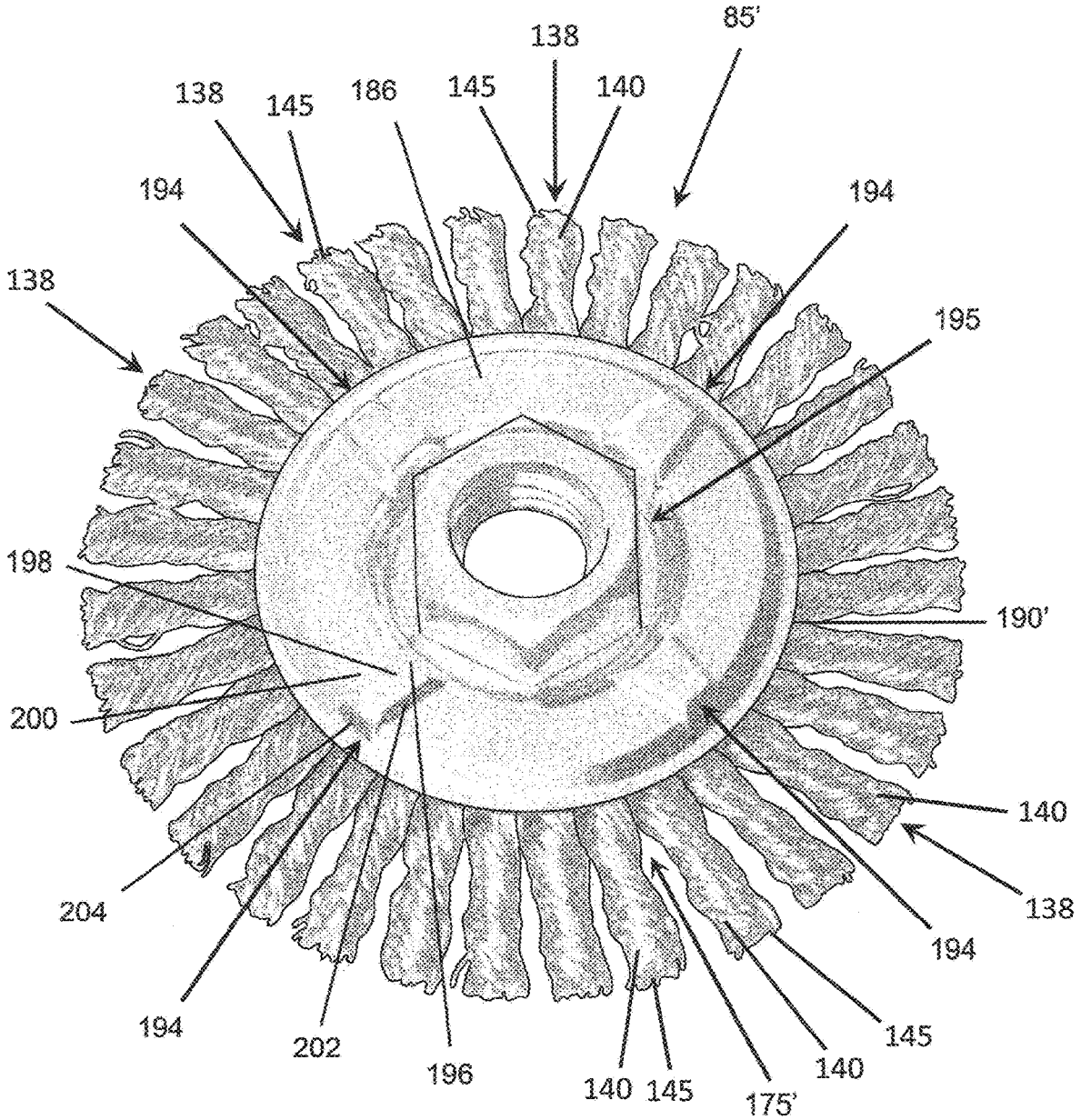
FIG. 17 is a top plan view of a rotary radial wire brush with an outer cover plate of improved strengthened construction having four radially extending upraised ribs formed therein configured to impart increased strength and structural rigidity to a rotary brush made therewith.
Figure 18:
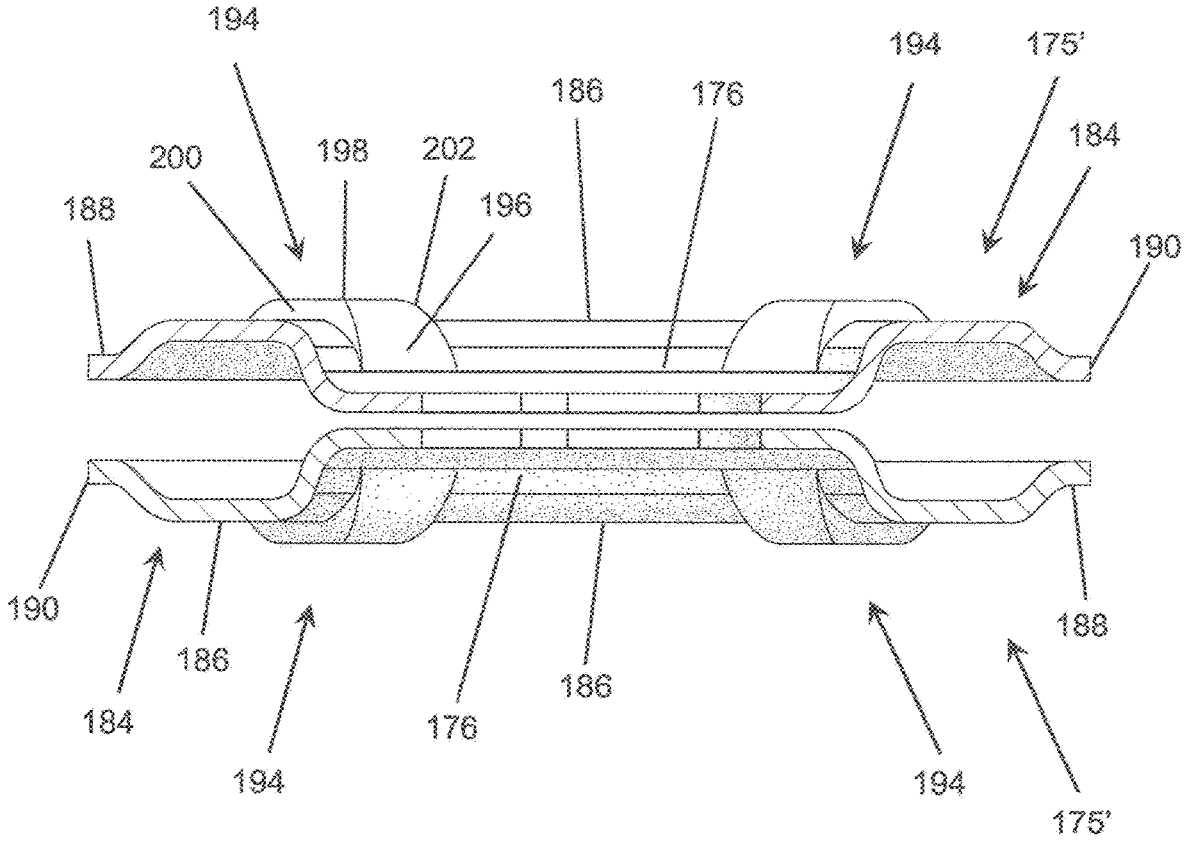
FIG. 18 is a fragmentary view of a rotary radial brush made with a pair of the cover plates of FIG. 17, with the remainder of the rotary brush components removed for clarity.

FIG. 17 illustrates a preferred embodiment of a rotary radial wire brush 85' constructed in accordance with the present invention that is equipped with standard twisted knot steel multifilament brush wire tufts 138 extending radially outwardly from a hub, e.g., hub 80 (not shown in FIG. 17), which is substantially completely covered by and sandwiched between a pair of outer cover plates 175' of the present invention each having a generally equiangularly spaced planar annular outer face 186 with a plurality of pairs, preferably at least four, upraised radially outwardly extending rotary brush and cover plate reinforcing or stiffening ribs 194 that each extend from at or adjacent the center of the plate 175' and/or coupling nut assembly radially outwardly to or adjacent the outer periphery of the plate 175'. FIG. 18 shows both cover plates 175' overlying one another with the hub and brush wire tufts 138 shown in FIG. 17 removed for clarity. As is depicted in FIG. 15, the cover plates 175' can be coupled to one another independently of the hub 80 (not shown), but preferably each cover plate 175' is attached to an adjacent corresponding side of the hub 80 (not shown) which substantially completely covers such as by being fixed thereto.

In a preferred embodiment of the brush 85', the hub, e.g., hub 80, has 32 holes **96*a* and 96*b*, which are of a radially offset configuration, with an elongate brush wire tuft 138 radially outwardly extending from each hole 96*a* and 96*b* that has at least 30 wires 140 or bristles 145 per tuft 138. Where of twisted knot construction, like the twisted knot brush tufts 138 shown in FIG. 17, each wire tuft 138 preferably has at least 30 bristles 145 and/or at least 15 wires 140 where the wires 140 are folded over one another and twisted together during twist knot anchoring of the tuft 138 to the hub 80 (not shown in FIG. 17). If desired, such a brush 85' of the present invention can be equipped with any one or more of the brush wire tufts 138', 138" and/or 138'" shown in FIGS. 8-10**, including any brush wire variants and/or various embodiments thereof described above.

Figure 19:
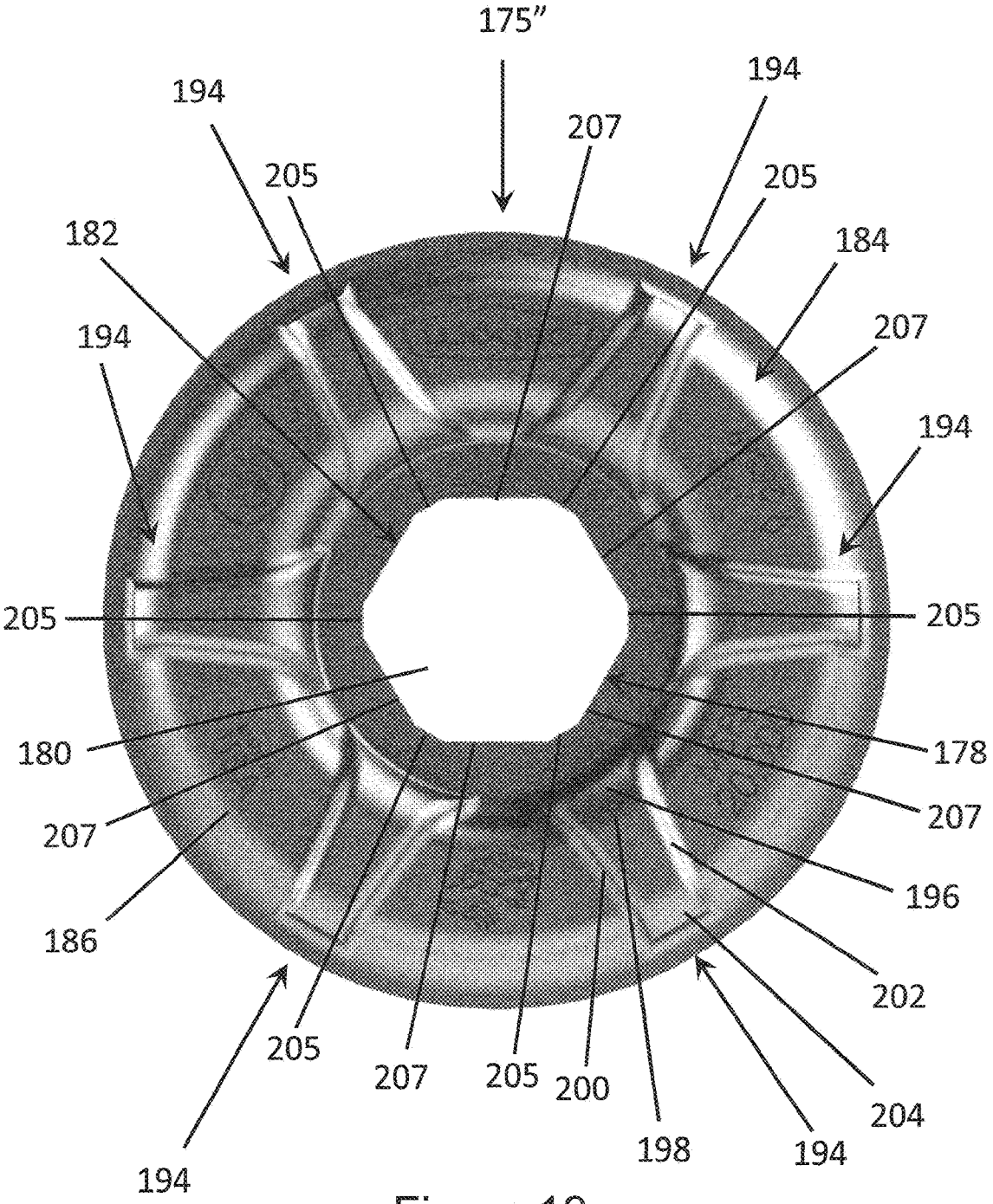
FIG. 19 is a top plan view of an outer cover plate for a rotary wire brush of the present invention that is formed with six equiangularly spaced radially extending upraised ribs configured to impart increased strength and structural rigidity to a rotary brush made therewith.

With continued reference to FIG. 17, each upraised radial rib 194 preferably is integrally formed in or of a generally circular metal blank used to form the plate 175' such as by stamping, forging or using another suitable material forming process in a manner that integrally forms all of the ribs 194 substantially simultaneously. Each rib 194 encompasses an angular extent of at least 3°, preferably at least 4°, and more preferably at least 5°, and has a widened or wider upraised base 196 disposed at or adjacent the center of the plate 175' or mounting nut assembly 195 with an elongate radially extending upraised rib body 198 which preferably is defined by a pair of upraised elongate generally straight spaced apart radially extending rib sides 200, 202 which preferably uniformly and/or symmetrically converges or tapers to a narrowed or narrower generally squared rib end or tip or 204 producing a rib 194 that is integral with the plate 175' that helps to strengthen a brush 85" made with such a radial ribbed face plate or cover plate 175'. In the preferred embodiment shown in FIG. 17, each plate 175' has a plurality of pairs of the ribs 194 with a first pair of the ribs 194 disposed on opposite sides of the center of the plate 175' and inline with each other and a second pair of the ribs 194 is angularly offset relative to the first pair of the inline ribs 194 which also are disposed on opposite sides of the center of the plate 175'. As also depicted in FIG. 17, each one of the four ribs 194 is equiangularly spaced apart about 90° from every adjacent one of the four ribs 194 such that the ribs substantially uniformly strengthen the plate 175', hub 80 and brush 75'. With additional reference to FIG. 19, in another preferred embodiment, each cover plate or face plate 175" has six equiangularly spaced apart radially outwardly extending stiffening or strengthening ribs 194 for increasing the structural rigidity of the cover plate or face plate 175" and any brush 85, 85', 85" and/or 210 made with a pair of the cover plates or face plates 175" sandwiching the center disk or hub 80, 80' or 212 of the corresponding brush 85, 85', 85" or 210. As also shown in FIG. 19, each one of the ribs 194 extends radially outwardly from each one of six equal-length flats 205 that each defines a corner of a hexagonal opening 180 formed in the cover plate or face plate 175" and which each adjoins or extends between respective adjacent pairs of the six equal-length sides 207 of the opening 180. Hexagonal opening 180 preferably receives part of a mounting nut assembly 195, such as depicted in FIG. 17, which is used to sandwich a pair of the cover plates or face plates 175" between a center hub 80, 80', 80" or 212 with the mounting nut assembly 195 internally threaded or otherwise internally configured for removable attachment to an arbor or rotary output shaft of a prime mover, such as a rotary power tool.

Such a radial ribbed cover plate 175' or 175" strengthens at least the plate 175' or 175" and, preferably also the hub 80, by helping minimize and preferably substantially completely prevent flexure of the plate 175' or 175" and/or the hub 80 during surface finishing using the brush 85" as shocks, vibration, and other forces encountered by the radially extending brush wires contacting the surface being finished are more efficiently transmitted radially inwardly via the ribs 194 to the stronger more rigid nut assembly 195 and/or tool spindle at the center of the brush 85". The nut assembly 195 (FIG. 17) not only has an internally threaded nut for removable mounting to a threaded rotary spindle or hub of a hand-held rotary brush drive, preferably a hand-held rotary power tool, e.g., grinder, angle grinder, die grinder, drill, etc., but the nut assembly 195 also is employed in fastening the outer cover plates 175' to the inner hub 80 sandwiching the hub 80 between the plates 175' or 175".

FIG. 20 illustrates another preferred embodiment of a rotary radial wire brush 85" constructed in accordance with the present invention having standard twisted knot multi-filament brush wires extending radially outwardly from a hub 80 which is substantially completely covered by and sandwiched between a pair of outer cover plates 175" of the present invention each having an stiffening and torsion rigidifying annulus 192 axially outwardly extending from the generally planar annular outer face 186 of the upraised axially extending annular hat or crown 184 of the plate 175". If desired, the cover plate 175" can be produced with a plurality of the upraised cover strengthening annulus 192, each generally coaxial with one another and having different diameters. In the brush 85" of FIG. 20, the outer peripheral edge 190" of each cover plate 175" is axially downturned facing generally toward the corresponding outer surface 88, 90 of the inner hub 80 covered by the plate 175". In the embodiment shown in FIG. 15, the downturned peripheral edge 190" of each cover plate 175" is disposed adjacent corresponding hub surface 88, 90 overlying the root portion of each radially extending brush wire and can seat on or against one or more of the wire root and/or hub surface 88, 90 such as by contacting, abutting or bearing against one or both in the manner depicted in FIG. 20. The root portion of each brush wire is that portion of the wire extending from the hole 96*a* and/or 96*b* in which the brush is anchored. Such a brush 85" can also employ any one or more of the brush wire tufts 138', 138" and/or 138"' shown in FIGS. 8-10 as well as any variants and/or embodiments thereof described above.

The present invention is directed to a rotary brush that includes (a) a central disc hub with at least a plurality of pair of brush wire mounts spaced (i) radially from a central axis of rotation of the brush, and (ii) circumferentially apart from one another, and (b) at least a plurality of pairs of brush wire filament bundles carried by the brush wire mounts for rotation in unison with the central disc hub, each one of the brush wire filament bundles extending outwardly from a corresponding one of the brush wire mounts of the central disc hub radially beyond an outer peripheral edge of the central disc hub, and each one of the brush wire filament bundles having free end(s) or tip(s) disposed radially outwardly of the outer peripheral edge of the central disc hub forming an abrasive face thereof that abrasively removes material from a surface to be finished during contact therewith during rotation of the central disc hub rotation of the rotary brush by a hand-held rotary power tool.

The central disc hub of such a rotary brush has brush wire mounts, preferably in the form of through-bores, spaced circumferentially about the central disc hub and arranged in an alternating radially offset brush wire mount configuration wherein a first plurality of the brush wire mounts are circumferentially spaced apart a first radial distance from a center or central axis of the central disc hub, a second plurality of the brush wire mounts are circumferentially spaced apart a second radial distance from the center or central axis of the central disc hub, and wherein the brush wire mounts of the first and second plurality of pairs alternate circumferentially about the central disc hub. Each brush wire extends radially outwardly from a corresponding one of the brush mounts with each brush wire being elongate and formed of a brush wire bundle having between twenty-two and thirty-four brush bristles or brush wire bristles. Each one of the brush wire tufts 138 preferably is formed of at least one brush wire and/or at least one brush wire strand. Each brush wire tuft 138 is anchored to a brush wire mount via a twisted knot where the brush wire tuft is arranged into a twisted knot that fixes the brush wire tuft to the central disc-shaped hub 80 of the brush.

Figure 28:
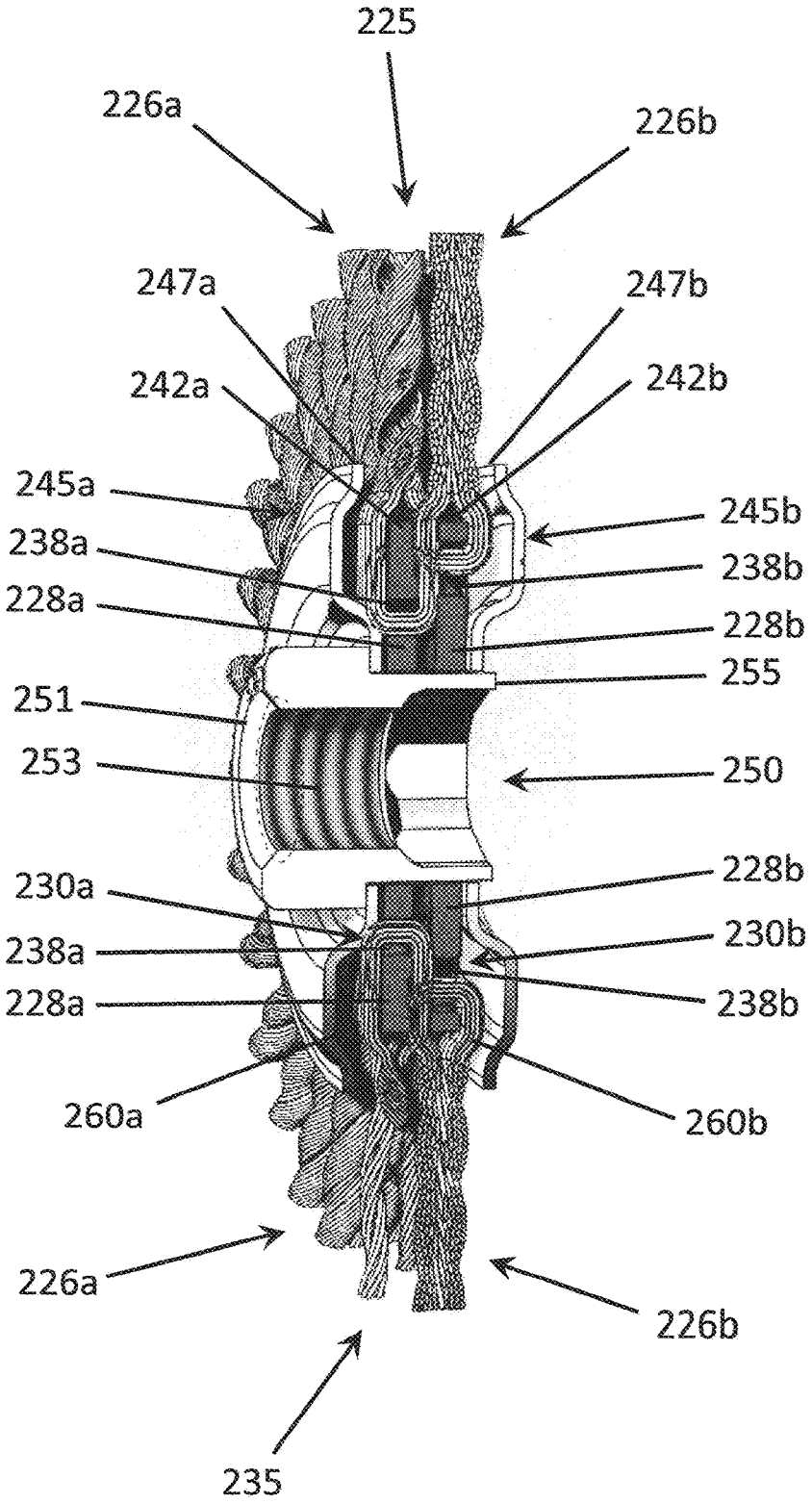
FIG. 28 is a perspective elevation cross-sectional view of the double-stringer rotary brush assembly of FIG. 22.

With reference to FIGS. 22-28, the present invention also is directed to an improved double-stringer rotary brush 225, e.g., dual brush, dually brush, or tandem brush, constructed of a pair of adjoining generally coaxial rotary radial brushes 226*a*, 226*b* arranged side-by-side that overlap one another with each brush 226*a*, 226*b* having respective opposed disc-shaped hubs 228*a*, 228*b* facing each other that are each configured with offset brush wire tuft mounting hole arrangements 230*a*, 230*b* formed of respective radially inner and radially outer sets 236*a*, 236*b* of radially offset tuft mounting holes 238*a*, 238*b* from which elongate brush wire tufts 232*a*, 232*b* respectively radially outwardly extend, producing a double-stringer brush assembly 235 of the invention possessing an advantageous combination of increased performance and longer life. With specific reference to FIG. 28, the hubs 228*a*, 228*b* of the double-stringer brush assembly 235 are sandwiched between a pair of an outer cover or face plates 245*a*, 245*b* by a mounting nut assembly 250 that operatively connects the brushes 226*a*, 226*b* to each other for rotation in unison with the mounting nut assembly 250 configured for releasable mounting of the double-stringer brush assembly 235 to a source of rotary power (not shown), such as a rotary power tool (not shown) or the like. As shown in FIG. 28, the nut assembly 250 has mounting nut 251 with internal threads 253 configured for releasable mounting to a threaded arbor of a rotary power tool and elongate tubular mount 255 extending through the cover plates 245*a*, 245*b* and hubs 228*a*, 228*b* operatively connecting them together in assembling the double-stringer rotary brush 225.

One or both hubs 228*a* and/or 228*b* of a double-stringer brush assembly 235 constructed in accordance with one aspect of the invention are configured with angularly or circumferentially spaced apart radially offset sets 236*a*, 236*b* of brush wire tuft mounting holes 238*a*, 238*b*. One or both brushes 226*a*, 226*b* can have brush wire tufts 232*a*, 232*b* with different brush wire tuft trim lengths configured to produce a double-stringer brush assembly 235 having an offset trim or offset trim length such that respective workpiece engaging faces 240*a*, 240*b* formed by the free ends of corresponding tufts 232*a*, 232*b* extend radially outwardly different distances beyond the outer peripheral edges 242*a*, 242*b* (FIGS. 26 & 28) of hubs 228*a* and/or 228*b* of the double-stringer brush assembly 235. Brush wire tufts 232*a* and/or 232*b* of one or both brushes 226*a*, 226*b* are formed of (a) at least a plurality of pairs, i.e., at least three, elongate brush wires, e.g., wires 140, and/or (b) at least a plurality of elongate brush wire strands, e.g., strands 157*a*, 157*b* or 157*c*, with each strand composed of a plurality, preferably a plurality of pairs, i.e., at least three, of elongate brush wires, e.g., wires 140. While the brush wire tufts 232*a*, 232*b* of one brush 226*a* can correspondingly overlap the brush wire tufts 232*a*, 232*b* of the other brush 226*b*, at least one preferred embodiment of the double-stringer brush assembly 235 depicted in FIGS. 22-28 is configured with the brush wire tufts 232*a*, 232*b* of the one brush 226*a* angularly offset relative to the brush wire tufts 232*a*, 232*b* of the other brush 226*b*. In such an angularly offset embodiment, the brush wire tufts 232*a*, 232*b*, of one of the brushes 226*a* are also circumferentially offset relative to the brush wire tufts 232*a*, 232*b* of the other one of the brushes 226*b*.

A double-stringer brush assembly 235 of the invention is constructed of a pair of adjoining rotary radial brushes 85 configured as depicted in FIG. 6A, a pair of adjoining rotary radial brushes 210 configured as depicted in FIGS. 6B and/or 21, a pair of the rotary radial brushes 85' configured as depicted in FIG. 17, a pair of the rotary radial brushes 85" configured as depicted in FIG. 20, a combination of rotary radial brush 85 and rotary radial brush 85', a combination of rotary radial brush 85 and rotary radial brush 85", a combination of rotary radial brush 85' and rotary radial brush 85", a combination of rotary radial brush 210 and rotary radial brush 85, a combination of rotary radial brush 210 and rotary radial brush 85', or a combination of rotary radial brush 210 and rotary radial brush 85" that each produce a double-stringer rotary brush 225 having an advantageous combination of improved performance and increased brush life. A double-stringer brush assembly 235 constructed of one of the aforementioned pairs or combinations of pairs of rotary brushes 85, 85', 85" and/or 210 is configured having the pair of the brushes 85, 85', 85" and/or 210 assembled side-by-side and overlapping each other without any cover plates 175 therebetween such that the hubs 80, 80' and/or 212 of the brushes 85, 85', 85" and/or 210 directly face or oppose one another with brush tufts 138, 138', 138", or 139 of one of the pair of brushes 85, 85', 85" and/or 210 of the double-stringer brush assembly 235 in contact with brush tufts 138, 138', 138", or 139 of the other one of the pair of brushes 85, 85', 85" and/or 210 of the double-stringer brush assembly 235. The rotary brushes 85, 85', 85" and/or 210 of the double-stringer brush assembly 235 are also configured with any combination of the brush wire tufts 138, 138', 138", or 139 disclosed above and/or depicted in FIGS. 7-13 thereby producing a double-stringer brush assembly 235 constructed in accordance with the present invention having a combination of increased abrasive material removal rates and improved surface finishing characteristics.

With continued reference to FIGS. 22-28, the double-stringer brush assembly 235 has a pair of generally coaxial brush wire tuft mounting center hubs 228*a*, 228*b* configured for rotation about an axis of rotation 252 about respective coaxial centers 254*a*, 254*b* of the hubs 228*a*, 228*b*, with each hub 228*a*, 228*b* configured for mounting of radially outwardly extending brush wire tufts 232*a*, 232*b* thereto as each one of the hubs 228*a*, 228*b* has at least a plurality of pairs of circumferentially and angularly spaced apart brush wire tuft mounting holes 238*a*, 238*b*. The total number of tuft mounting holes 238*a*, 238*b* formed in each hub 228*a*, 228*b* ranges between 28 and 72 of the holes with the total number of holes 238*a*, 238*b* formed in each hub 228*a*, 228*b* being dependent on one or more of the surface finishing application, brush wire tuft thickness, as well as the size of the brush 225, e.g., brush assembly 235, with the double-stringer brush assembly 235 manufactured in varying sizes including a four-inch brush, a four and a half inch brush, a five-inch brush, and a seven-inch brush. The brush assembly 235 has at least a plurality of pairs of elongate brush wire tufts 232*a*, 232*b* extending radially outwardly from corresponding mounting holes 238*a*, 238*b* of the respective hubs 228*a*, 228*b*, with each one of the tufts 232*a*, 232*b* extending radially outwardly from its respective hub 228*a*, 228*b* radially outwardly beyond the hubs 228*a*, 228*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above. Each one of the tufts 232*a*, 232*b* is formed of at least a plurality of pairs, i.e., at least three, elongate brush wires and/or strands, e.g., wire(s) 140 and/or strands 157*a*, 157*b* and/or 157*b*, with a free end thereof defining workpiece engaging faces 240*a*, 240*b* of the respective tufts 232*a*, 232*b*.

At least one of the hubs 228*a*, 228*b* has a first set 236*a* of at least a plurality, preferably at least a plurality of pairs, i.e., at least three, of the brush wire tuft mounting holes 238*a* spaced a radial distance from a respective center 254*a*, 254*b* of the at least one of the hubs 228*a*, 228*b*, that is greater than a second set 236*b* of a plurality, preferably at least a plurality of pairs, i.e., at least three, of the brush wire tuft mounting holes 238*b* of the at least one of the hubs 228*a*, 228*b*. Both of the hubs 228*a*, 228*b* of the double-stringer brush assembly 235 shown in FIGS. 22-28 are configured with at least one of the hubs 228*a* and/or 228*b* and preferably both of the hubs 228*a* and 228*b* having tuft mounting holes 238*a*, 238*b* spaced apart about a circumference of corresponding hub 228*a* and/or 228*b* and arranged in alternating radially spaced apart sets 236*a*, 236*b* of tuft mounting holes 238*a*, 238*b* where the first set 236*a* of holes 238*a* are spaced radially closer to the respective center 254*a*, 254*b* of the corresponding hub 228*a*, 228*b* than the second set 236*b* of holes 238*b*. Tuft mounting holes 238*a* are axially extending through-holes formed in each hub 228*a*, 228*b* that preferably are equidistantly circumferentially spaced apart along a common circle, such as in the manner depicted in FIG. 4A, spaced the same first radial distance from the respective center 254*a*, 254*b* of the corresponding hub 228*a*, 228*b* in which the holes 238*a* are disposed such that the first set 236*a* of the holes 238*a* defines a radially innermost set of brush wire tuft mounting holes 238*a* that are all spaced the same first radial distance from the respective center 254*a*, 254*b* of the corresponding hub 228*a*, 228*b* in which the radially outermost holes 238*a* are located. Tuft mounting holes 238*b* are also axially extending through-holes formed in each hub 228*a*, 228*b* that preferably are also equidistantly circumferentially spaced apart along another common circle, such as in the manner also depicted in FIG. 4A, spaced the same second radial distance from the respective center 254*a*, 254*b* of corresponding hub 228*a*, 228*b* in which the holes 238*b* are disposed that is radially farther than the first radial distance, such that the second set 236*b* of the holes 238*b* defines a radially outermost set of brush wire tuft mounting holes 238*b* that are all spaced the same second radial distance from the respective center 254*a*, 254*b* of corresponding hub 228*a*, 228*b* in which the radially outermost holes 238*b* are located. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above. Brush wire tufts 232*a*, 232*b* mounted to the corresponding alternating radially spaced apart sets 236*a*, 236*b* of holes 238*a*, 238*b* have different tuft lengths, which in turn, respectively imparts the different length tufts 232*a*, 232*b* with different stiffnesses producing a double-stringer brush assembly 235 having an advantageous blend of aggressive material removal and finer surface finishing characteristics.

At least a plurality, preferably at least a plurality of pairs, i.e., at least three, of the mounting holes 238*a* of the first set 236*a* of mounting holes 238*a* of at least one of the hubs 228*a* and/or 228*b* have a size different than a plurality, preferably a plurality of pairs, i.e., at least three, of the holes 238*b* of the second set 236*b* of the holes 238*b* of the at least one of the hubs 228*a* and/or 228*b*. In the double-stringer brush assembly 235 depicted in FIGS. 22-28, each one of the holes 238*a* of the first set 236*a* of each one of the hubs 228*a*, 228*b* are of a different size than each one of the holes 238*b* of the second set 236*b* of each one of the hubs 228*a*, 228*b*. At least a plurality, preferably at least a plurality of pairs, i.e., at least three, of the holes 238*a* of the first set 236*a* of holes 238*a* of at least one of the hubs 228*a* and/or 228*b* have a size larger than a plurality, preferably a plurality of pairs, i.e., at least three, of the holes 238*b* of the second set 236*b* of the holes 238*b* of the at least one of the hubs 228*a* and/or 228*b*. In the double-stringer brush assembly 235 depicted in FIGS. 22-28, size of the holes 238*a*, 238*b* of one of the sets 236*a*, 236*b* of the holes 238*a*, 238*b* of each one of the hubs 228*a*, 228*b* is larger than the size of the holes 238*a*, 238*a* of the other one of the sets 236*a*, 236*b* of the holes 238*a*, 238*b*. In one preferred embodiment of the double-stringer brush assembly 235, the mounting holes 238*a* or 238*b* of one of the sets 236*a* or 236*b* of the mounting holes 238*a*, 238*b* of at least one of the hubs 228*a* and/or 228*b* is one of round and oblong and the mounting holes 238*b* or 238*a* of the other one of the sets 236*b* or 236*a* of the mounting holes 238*a*, 238*b* is one of round and oblong with at least a plurality, preferably at least a plurality of pairs, i.e., at least three, of the mounting holes 238*a* of the first set 236*a* of mounting holes 238*a* of at least one of the hubs 228*a* and/or 228*b* having a size larger than a plurality, preferably a plurality of pairs, i.e., at least three, of the mounting holes 238*b* of the second set 236*b* of the mounting holes 238*b* of the at least one of the hubs 228*a* and/or 228*b*. In a preferred embodiment of the double-stringer brush assembly 235, the mounting holes 238*a*, 238*b* are round with at least a plurality, preferably at least a plurality of pairs, i.e., at least three, of the mounting holes 238*a* of the first set 236*a* of mounting holes 238*a* of at least one of the hubs 228*a* and/or 228*b* have a diameter larger than a plurality, preferably a plurality of pairs, i.e., at least three, of the mounting holes 238*b* of the second set 236*b* of the mounting holes 238*b* of the at least one of the hubs 228*a* and/or 228*b*. In the double-stringer brush assembly 235 depicted in FIGS. 22-28, the size of the radially innermost holes 238*a* of the radially innermost set 236*a* of the holes 238*a* of each one of the hubs 228*a*, 228*b* is smaller in width or diameter than the size of the radially outermost holes 238*a* of the radially outermost set 236*b* of the holes 238*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above.

Figure 22:
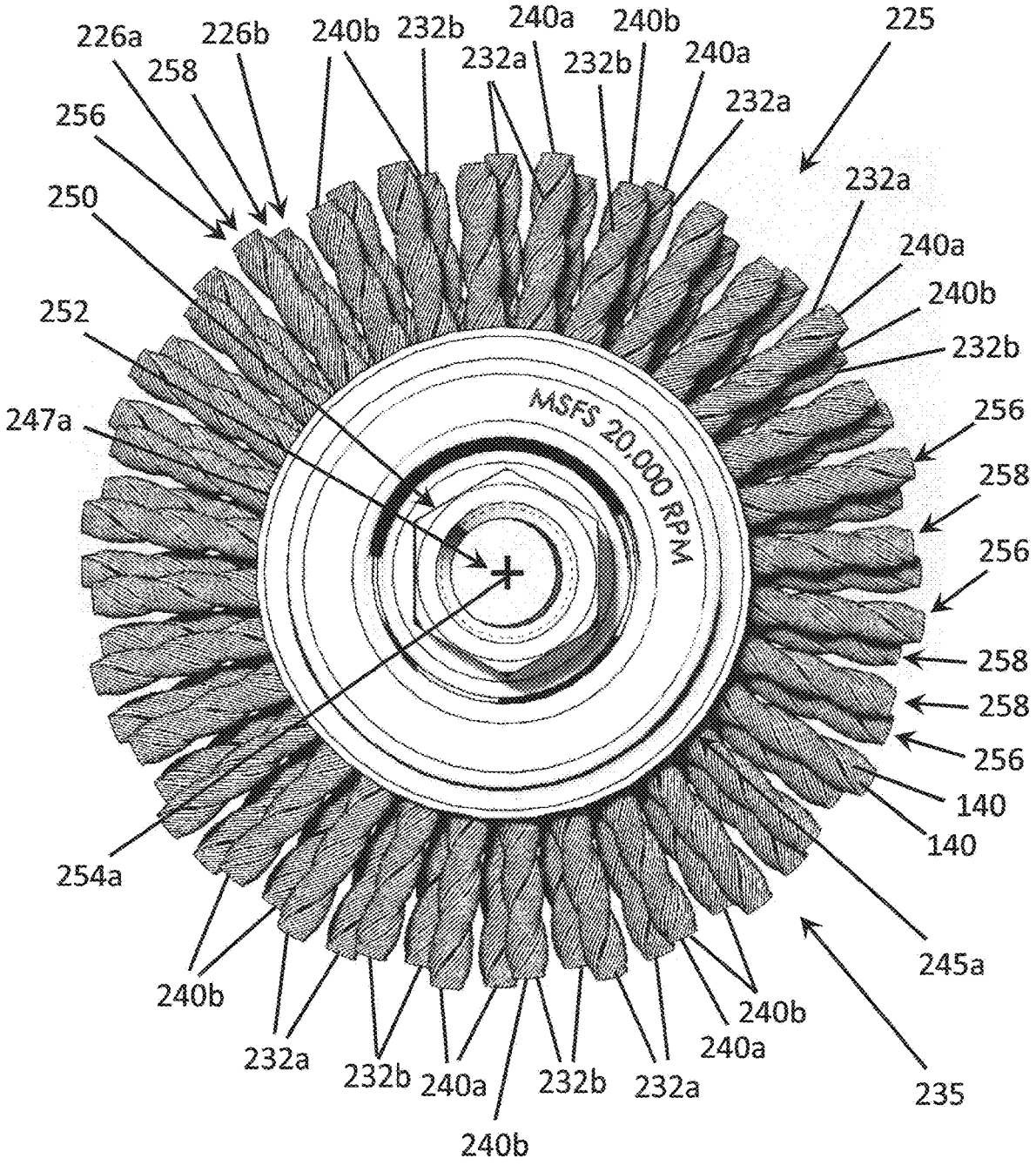
FIG. 22 is a top plan view of a preferred embodiment of a double-stringer rotary brush assembly constructed of a pair of rotary radial wire brushes constructed in accordance with the present invention operatively coupled for rotation of both brush in unison.
Figure 26:
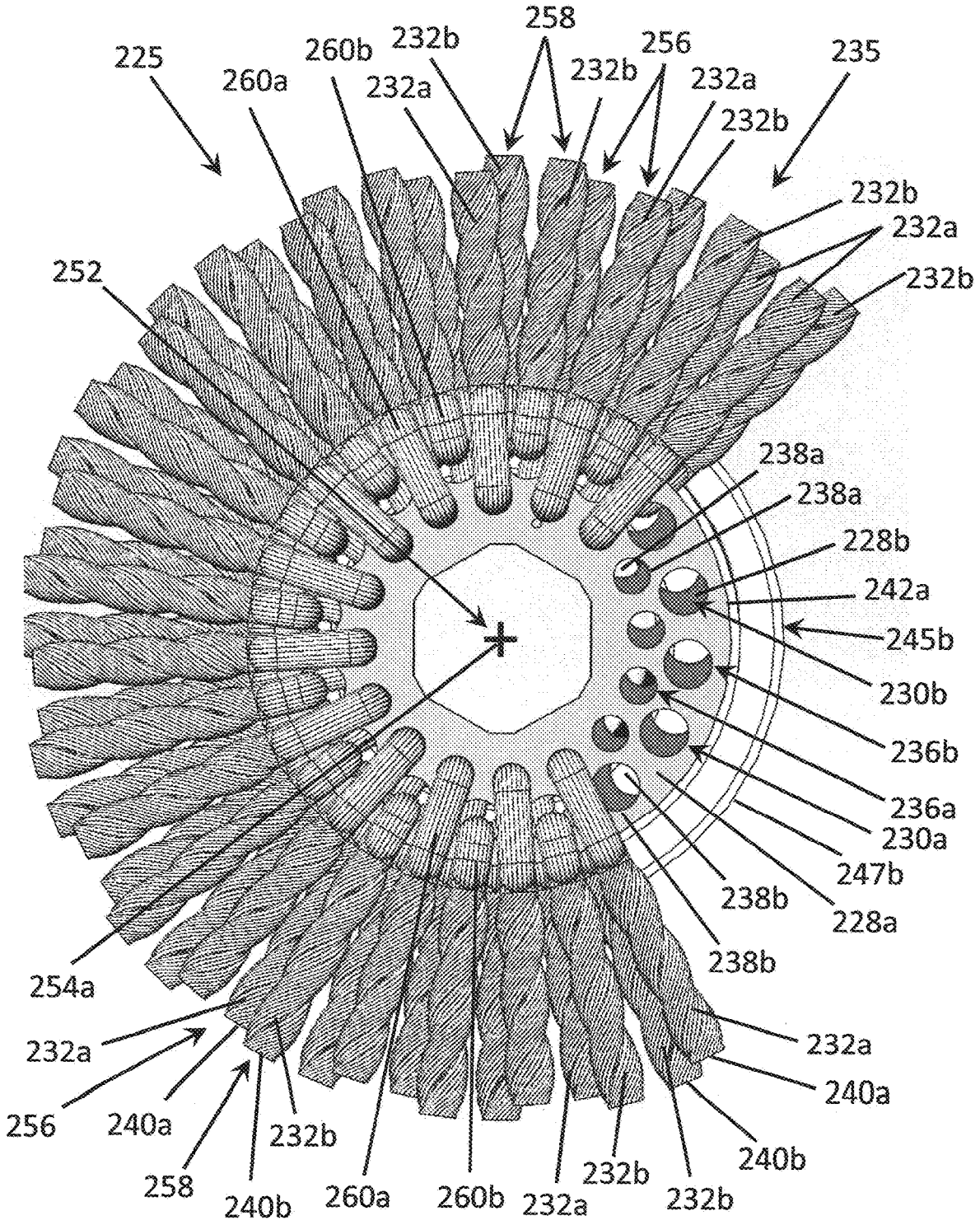
FIG. 26 is a top plan view of the double-stringer rotary brush assembly of FIG. 22 with brush wire tufts removed from both radial wire brushes for clarity illustrating an angular offset of the brush wire tuft mounting holes of one of the radial wire brushes relative to the brush wire tuft mounting holes of the other one of the radial wire brushes.
Figure 27:
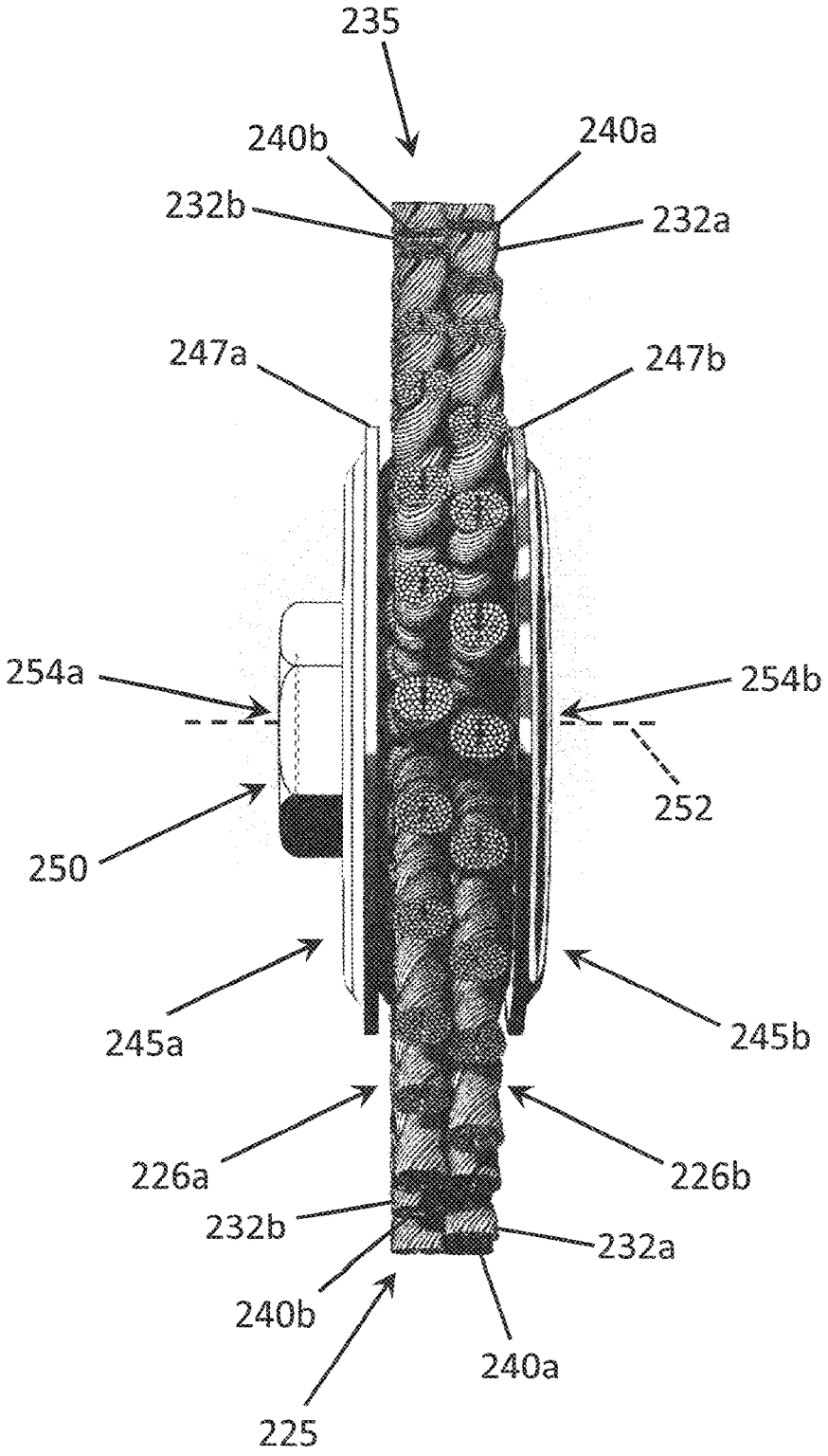
FIG. 27 is a side elevation view of the double-stringer rotary brush assembly of FIG. 22.

As best shown in FIGS. 22 and 26, at least a plurality of the brush wire tuft mounting holes 238*a* and/or 238*b* of one of the brush wire tuft mounting hubs 228*a* are respectively angularly offset relative to at least a plurality of corresponding adjacent brush wire tuft mounting holes 238*a* and/or 238*b* of the other one of the brush wire tuft mounting hubs 228*b*. As best shown in FIG. 26, at least a plurality, preferably at least a plurality of pairs, i.e., at least three, of the mounting holes 238*a* and 238*b* of one of the hubs 228*a* are angularly offset relative to at least a plurality, preferably at least a plurality of pairs, i.e., at least three, of the corresponding mounting holes 238*a* and 238*b* of the other one of the hubs 228*b* such that the corresponding mounting holes 238*a* and 238*b* of the hubs 228*a*, 228*b* are not axially aligned, are not coaxial, e.g., are eccentric, and do not overlie one another. Preferably, the mounting holes 238*a* and 238*b* of one of the hubs 228*a* are angularly offset relative to the corresponding mounting holes 238*a* and 238*b* of the other one of the hubs 228*b* such that the corresponding mounting holes 238*a* and 238*b* of the hubs 228*a*, 228*b* are not axially aligned, are not coaxial, and do not overlie one another. Such a double-stringer rotary brush 225 is configured with one of its rotary brushes 226*a* angularly offset relative to the other one of its rotary brushes 226*b* that the mounting holes 238*a*, 238*b* of the hub 228*a* of the one of the brushes 226*a* are angularly offset relative to the corresponding holes 238*a*, 238*b* of the hub 228*b* of the other one of the brushes 226*b* whereby the mounting holes 238*a*, 238*b* of the hub 228*a* of the one of the brushes 226*a* are not coaxial with the corresponding mounting holes 238*a*, 238*b* of the hub 228*b* of the other one of the brushes 226*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above.

With continued reference to FIGS. 22 and 26, at least one of the brush wire tuft mounting hubs 228*a* and/or 228*b* of the double-stringer brush assembly 235 can be and preferably is configured having a first set 256 of at least a plurality, preferably at least a plurality of pairs, i.e., at least three, of the brush wire tufts 232*a* that extend radially outwardly beyond the at least one of the brush wire tuft mounting hubs 228*a* and/or 228*b* a greater radial distance than a second set 258 comprised of at least a plurality, preferably at least a plurality of pairs, of the brush wire tufts 232*b* that extend radially outwardly beyond the at least one of the brush wire tuft mounting hubs 228*a* and/or 228*b*. In a preferred double-stringer brush assembly 235, the tufts 232*a*, 232*b* of at least one of the brushes 226*a*, 226*b* are configured with an offset trim or offset trim length like the brush 210 shown in FIG.

21 with the tufts 232*a*, 232*b* of at least one of the hubs 228*a*, 228*b* having an offset trim or offset trim length such that a first set 256 of at least a plurality, preferably at least plurality of pairs, i.e., at least three, of the tufts 232*a* have a length extending radially beyond one of an outer peripheral edge 242*a* and/or 242*b* of the at least one of the hubs 228*a* and/or 228*b* and an outer peripheral edge 247*a* and/or 247*b* of at least one of the cover plates 245*a* and/or 245*b* that is greater than a length that a second set 258 of at least a plurality, preferably at least a plurality of pairs, i.e., at least three, of the tufts 232*b* extends radially beyond the one of an outer peripheral edge 242*a* and/or 242*b* of the at least one of the hubs 228*a* and/or 228*b* and an outer peripheral edge 247*a* and/or 247*b* of at least one of the cover plates 245*a* and/or 245*b*. Such a double-stringer brush assembly 235 can be further configured with at least a plurality of the brush wire tuft mounting holes 238*a* and/or 238*b* of one of the brush wire tuft mounting hubs 228*a* respectively angularly offset relative to at least a plurality of corresponding adjacent brush wire tuft mounting holes 238*a* and/or 238*b* of the other one of the brush wire tuft mounting hubs 228*b*. The double-stringer brush assembly 235 is further configured such that at least a plurality of the brush wire tuft mounting holes 238*a*, 238*b* of one of the brush wire tuft mounting hubs 228*a* are respectively angularly offset relative to at least a plurality of corresponding adjacent brush wire tuft mounting holes 238*a*, 238*b* of the other one of the brush wire tuft mounting hubs 228*b*. Such a double-stringer brush assembly 235 has one of its brushes 226*a* angularly offset relative to the other one of its brushes 226*b* such that the mounting holes 238*a* and 238*b* of the hub 228*a* of the one of the brushes 226*a* do not overlie and are eccentric to the corresponding mounting holes 238*a* and 238*b* of the hub 228*a* of the other one of the brushes 226*b* by not being coaxial with the corresponding mounting holes 238*a* and 238*b* of the hub 228*a* of the other one of the brushes 226*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above.

With specific reference to FIGS. 24-27, each one of the brush wire tufts 232*a*, 232*b*, of each one of the brush wire tuft mounting hubs 228*a*, 228*b*, is anchored thereto by a corresponding knot 260*a*, 260*b* extending through a respective one of the brush wire tuft mounting holes 238*a*, 238*b* formed in the corresponding one of the hubs 228*a*, 228*b* in which the mounting holes 238*a*, 238*b* are disposed with the tufts 232*a* anchored to each one of the one of the knots 260*a*. One plurality of the knots 260*a* or 260*b* used to attach a corresponding plurality of the tufts 232*a* or 232*b* to one of the hubs 228*a* and/or 228*b* is larger than another plurality of the knots 260*a* or 260*b* used to attach a corresponding plurality of tufts 232*b* or 232*b* to the one of the hubs 228*a* and/or 228*b*. A first plurality of the knots 260*a* used to attach a corresponding plurality of tufts 232*a* to one of the hubs 228*a* and/or 228*b* is longer than a second plurality of the knots 260*b* used to attach a corresponding plurality of tufts 232*b* to the one of the hubs 228*a* and/or 228*b*. In the double-stringer brush assembly 235 shown in FIGS. 22-28, each one of the knots 260*a* used to attach the tufts 232*a* of the first set 256 of the tufts 232*a* to each one of the hubs 228*a*, 228*b*, has a size larger than each one of the knots 260*b* used to attach the tufts 232*b* of the second set 258 of the tufts 232*b* to each one of the hubs 228*a*, 228*b*. Each one of the knots 260*a* used to attach the tufts 232*a* of the first set 256 of the tufts 232*a* to each one of the hubs 228*a*, 228*b*, is longer than each one of the knots 260*b* used to attach the tufts 232*b* of the second set 258 of the tufts 232*b* to each one of the hubs 228*a*, 228*b*. As described above, each one of the knots 260*a*, 260*b* is a twisted wire knot formed of at least a plurality, preferably at least a plurality of pairs, of elongate brush wires, e.g., wires 140, or strands of wires, e.g., strands 157*a*, 157*b* and/or 157*b*, threaded through a corresponding one of the tuft mounting holes 238*a*, 238*b* in each one of the hubs 228*a*, 228*b* and twisted to form a respective one of the knots 260*a*, 260*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above.

If desired, the double-stringer rotary brush 225 composed of a double-stringer brush assembly 235 can be configured with (a) brush wire tufts 232*a*, 232*b* respectively extending radially outwardly from brush wire tuft mounting holes 238*a*, 238*b* of one of the hubs 228*a* with the tufts 232*a* extending radially outwardly from the radially innermost mounting holes 238*a* of the one of the hubs 228*a* extending radially outwardly beyond the outer peripheral edge 242*a* of the one of the hubs 228*a* a length or distance greater than the tufts 232*b* extending radially outwardly from the radially outermost holes 238*b* of the one of the hubs 228*a*, and (b) brush wire tufts 232*a*, 232*b* respectively extending radially outwardly from brush wire tuft mounting holes 238*a*, 238*b* of the other one of the hubs 228*b* with the tufts 232*a* extending radially outwardly from the radially innermost mounting holes 238*a* of the other one of the hubs 228*b* extending radially outwardly beyond the outer peripheral edge 242*b* of the other one of the hubs 228*b* a length or distance less than the tufts 232*b* extending radially outwardly from the radially outermost holes 238*b* of the other one of the hubs 228*b*. In a preferred embodiment like that depicted in FIG. 26, the brush wire tuft mounting holes 238*a* of one of the hubs 228*a* is angularly offset by at least 5° relative to the mounting holes 238*a* of the other one of the hubs 228*b* such that the holes 238*a* of the one of the hubs 228*a* overlap the holes 238*b* of the other one of the hubs 228*b* and the holes 238*b* of the one of the hubs 228*a* overlap the holes 238*a* of the other one of the hubs 228*b*.

The present invention also is directed to a double-stringer rotary brush 225 that is a double-stringer brush assembly 235 that includes (a) a pair of generally coaxial brush wire tuft mounting hubs 228*a*, 228*b* configured for rotation about an axis of rotation at a corresponding center thereof, each hub 228*a*, 228*b* having a plurality of pairs, i.e., at least three, of spaced apart brush wire tuft mounting holes 238*a*, 238*b*, and (b) a plurality of pairs, i.e., at least three, of brush wire tufts 232*a*, 232*b* with one of the tufts 232*a*, 232*b* extending outwardly from each one of the tuft mounting holes 238*a*, 238*b* of each one of the hubs 228*a*, 228*b*, each tuft 232*a*, 232*b* comprised of at least a plurality of brush wires 140 and extending radially outwardly of from a corresponding one of the hubs 228*a*, 228*b*. The brush mounting holes 238*a*, 238*b* of each one of the hubs 228*a*, 228*b* are circumferentially spaced apart with alternating radially spaced holes 238*a*, 238*b* arranged in a first set 236*a* of the holes 238*a* and a second set 236*b* of the holes 238*b*, and where the holes 238*a* of the first set 236*a* are spaced a radial distance from the corresponding center 254*a*, 254*b* of the hub 228*a*, 228*b* in which disposed greater than a radial distance the holes 238*b* of the second set 236*b* are spaced from the corresponding center 254*a*, 254*b* of the hub 228*a*, 228*b* in which disposed. The holes 238*a*, 238*b* of each one of the hubs 228*a*, 228*b* are circumferentially spaced apart with alternating radially spaced holes 238*a*, 238*b* arranged in a first set 236*a* of the holes 238*a* and a second set 236*b* of the holes 238*b* where the size of the brush holes 238*b* of one of the first and second sets 236*b* of the holes 238*a*, 238*b* is larger than the size of the holes 238*a* of the other one of the first and second sets 236*a* of the holes 238*a*, 238*b*. The holes 238*a*, 238*b* of each one of the hubs 228*a*, 228*b* are circumferentially spaced apart with alternating radially spaced holes 238*a*, 238*b* arranged in a first set 236*a* of the holes 238*a* and a second set 236*b* of the holes 238*b* where the diameter of the holes 238*b* of one of the first and second sets 236*b* of the holes 238*a*, 238*b* is greater than the diameter of the holes 238*a* of the other one of the first and second sets 236*a* of the holes 238*a*, 238*b*. The holes 238*a*, 238*b* of each one of the hubs 228*a*, 228*b* are circumferentially spaced apart with alternating radially spaced brush wire tuft mounting holes 238*a*, 238*b* arranged in a set 236*a* of radially innermost holes 238*a* and a set 236*b* of radially outermost holes 238*b* spaced radially outwardly of the set 236*a* of radially innermost holes 238*a* where the size of each one of the radially outermost holes 238*b* is larger than the size of each one of the radially innermost holes 238*a*. The holes 238*a*, 238*b* of each one of the hubs 228*a*, 228*b* are circumferentially spaced apart with alternating radially spaced holes 238*a*, 238*b* arranged in a set 236*a* of radially innermost holes 238*a* and a set 236*b* of radially outermost holes 238*b* spaced radially outwardly of the set 236*a* of radially innermost holes 238*a* where the diameter of each one of the radially outermost holes 238*b* is larger than the diameter of each one of the radially innermost holes 238*a*. Each one of the hubs 228*a*, 228*b* is configured with alternating brush wire tufts 232*a*, 232*b* having a different brush wire tuft length arranging the tufts 232*a*, 232*b* of each one of the hubs 228*a*, 228*b* into a first set 256 of the tufts 232*a* having a first length and a second set 258 of the tufts 232*b* having a second length that is different than the first length such that the alternating brush wire tufts have an offset trim. Each one of the hubs 228*a*, 228*b* is configured with alternating brush wire tufts 232*a*, 232*b* having different brush wire trim tuft lengths such that the alternating tufts 232*a*, 232*b* have an offset trim. Each one of the hubs 228*a*, 228*b* is configured with alternating brush wire tufts 232*a*, 232*b* having a pair of different brush wire trim tuft lengths with the tufts 232*a*, 232*b* of each one of the hubs 228*a*, 228*b* arranged in sets of alternating brush wire tufts 232*a*, 232*b* comprised of (a) a first set 256 of every other brush wire tufts 232*a* having a first trim length extending radially outwardly a first trim distance beyond an outer peripheral edge 242*a*, 242*b* of the corresponding one of the hubs 228*a*, 228*b* to which the first set 256 of the tufts 232*a* are mounted, and (b) a second set 258 of every other brush wire tufts 232*b* having a second trim length extending radially outwardly a second trim distance beyond an outer peripheral edge 242*a*, 242*b* of the corresponding one of the hubs 228*a*, 228*b* to which the second set 258 of the tufts 232*b* are mounted that is less than the first trim distance. Each one of the tufts 232*a*, 232*b* is attached to a corresponding one of the hubs 228*a*, 228*b* by a knot 260*a*, 260*b* extending through a corresponding one of the holes 238*a*, 238*b* thereof, and wherein the knots 260*a*, 260*b* of alternating tufts 232*a*, 232*b* of each one of the hubs 228*a*, 228*b* have one of a plurality of different knot sizes. The holes 238*a*, 238*b* of each one of the hubs 228*a*, 228*b* are circumferentially spaced apart with alternating radially spaced holes 238*a*, 238*b* arranged in a set 236*a* of radially innermost holes 238*a* and a set 236*b* of radially outermost holes 236*b* spaced radially outwardly of the set 236*a* of radially innermost holes 238*a*, and the knots 260*a* attaching the tufts 232*a* to a corresponding one of the radially innermost and radially outermost tuft mounting holes 238*a* of each one of the hubs 228*a*, 228*b* are larger than the knots 260*b* attaching the tufts 232*b* to the corresponding other one of the radially innermost and radially outermost holes 238*b* of each one of the hubs 228*a*, 228*b*. The brush wire tuft mounting holes 238*a*, 238*b* of each one of the brush wire tuft mounting hubs 228*a*, 228*b* are circumferentially spaced apart with alternating radially spaced brush wire tuft mounting holes 238*a*, 238*b* arranged in a set 236*a* of radially innermost brush wire tuft mounting holes 238*a* and a set 236*b* of radially outermost brush wire tuft mounting holes 238*b* spaced radially outwardly of the set 236*a* of radially innermost brush wire tuft mounting holes 238*a*, and each one of the brush wire tufts 232*a*, 232*b* are attached to the brush wire tuft mounting hubs 228*a*, 228*b* by a corresponding knot 260*a*, 260*b* extending through a corresponding one of the brush wire tuft mounting holes 238*a*, 238*b* with the brush wire tufts 232*a* attached to corresponding radially innermost brush wire tuft mounting holes 238*a* having a longer knot 260*a* than the brush wire tufts 232*b* attached to corresponding radially outermost wire tuft mounting holes 238*b*. Each one of the brush wire tufts 232*a*, 232*b* can be formed of a plurality, preferably a plurality of pairs, i.e., at least three, of wires 140 having a plurality of different wire diameters, and/or strands 157*a*, 157*b*, 157*b* formed of a plurality, preferably a plurality of pairs, i.e., at least three, of wires 140 having a plurality of different wire diameters like one of the tufts depicted in one of FIGS. 8-13 and described above. A mounting nut assembly 250 is used to hold the outer cover plates 245*a*, 245*b* and brush wire tuft mounting hubs 228*a*, 228*b* together with the brush wire tufts 232*a*, 232*b* of each one of the hubs 228*a*, 228*b* in contact with one another forming a double-stringer brush assembly 235 of the present invention. If desired, a double-stringer rotary brush 225 constructed in accordance with the present invention can also be composed of a double-stringer brush assembly 235 configured with (a) brush wire tufts 232*a*, 232*b* respectively extending radially outwardly from brush wire tuft mounting holes 238*a*, 238*b* of one of the hubs 228*a* with the tufts 232*a* extending radially outwardly from the radially innermost mounting holes 238*a* of the one of the hubs 228*a* extending radially outwardly beyond the outer peripheral edge 242*a* of the one of the hubs 228*a* a length or distance greater than the tufts 232*b* extending radially outwardly from the radially outermost holes 238*b* of the one of the hubs 228*a*, and (b) brush wire tufts 232*a*, 232*b* respectively extending radially outwardly from brush wire tuft mounting holes 238*a*, 238*b* of the other one of the hubs 228*b* with the tufts 232*a* extending radially outwardly from the radially innermost mounting holes 238*a* of the other one of the hubs 228*b* extending radially outwardly beyond the outer peripheral edge 242*b* of the other one of the hubs 228*b* a length or distance less than the tufts 232*b* extending radially outwardly from the radially outermost holes 238*b* of the other one of the hubs 228*b*. In a preferred embodiment, the brush wire tuft mounting holes 238*a* of one of the hubs 228*a* is angularly offset by at least 5° relative to the mounting holes 238*a* of the other one of the hubs 228*b* such that the holes 238*a* of the one of the hubs 228*a* overlap the holes 238*b* of the other one of the hubs 228*b* and the holes 238*b* of the one of the hubs 228*a* overlap the holes 238*a* of the other one of the hubs 228*b*.

The present invention also is directed to a double-stringer rotary brush 225 that is a double-stringer brush assembly 235 composed of a pair of rotary brushes 226*a*, 226*b* operatively connected side-by-side for rotation substantially in unison therewith with each one of the joined rotary brushes 226*a*, 226*b* having (a) a hub 228*a*, 228*b* with at least a plurality of pairs of brush wire tuft mounting holes 238*a*, 238*b* spaced radially from a central axis of rotation 252 of the brushes 226*a*, 226*b*, and circumferentially apart from one another, and (b) an elongate brush wire tuft 232*a*, 232*b* carried by each brush wire tuft mounting hole 238*a*, 238*b*, each brush wire tuft 232*a*, 232*b* extending radially outwardly from a corresponding one of the brush wire tuft mounting holes 238*a*, 238*b* beyond an outer radial peripheral edge 242*a*, 242*b* of a corresponding one of the brush wire tuft mounting hubs 228*a*, 228*b* defining a corresponding working face 240*a*, 240*b* at or adjacent free ends thereof that abrasively contact a surface during rotation of both rotary brushes 226*a*, 226*b*. Each hub 228*a*, 228*b* has a radially outermost set of brush wire tuft mounting holes 238*b* spaced circumferentially about the hub, and a radially innermost set of brush wire tuft mounting holes 238*a* spaced circumferentially about the hub that is spaced radially inwardly of the radially outermost set of brush wire tuft mounting openings 238*b*. The brush wire tufts 232*b* extending radially outwardly from the radially outermost brush mounting holes 238*b* have a working face 240*b* disposed radially outwardly of the working face 240*a* of the brush wire tufts 232*a* extending radially outwardly from the radially innermost brush wire tuft mounting holes 238*a*. The brush wire tufts 232*b* extend radially outwardly from the radially outermost brush wire tuft mounting holes 238*b* extend farther radially outwardly than the brush wire tufts 232*a* extend radially outwardly from the radially innermost brush mounting holes 238*a* and are more flexible than the brush wire tufts 232*a* that extend from the outermost brush wire tuft mounting holes 238*b*. Each one of the brush wire tufts 232*a*, 232*b* is composed of a plurality of elongate brush wires 140 or strands 157*a*, 157*b* or 157*b* composed of elongate brush wires 140 twisted together at least a plurality of times along the length of the corresponding brush wire tuft. Each one of the brush wire tufts 232*a*, 232*b* is composed of between twenty-two and thirty-four brush wires 140 twisted together along the length of the brush wire tuft. Each one of the brush wire tufts 232*a*, 232*b* is composed of at least a plurality of pairs of elongate metal or metallic brush wires 140 or strands 157*a*, 157*b* and/or 157*c* of wires 140 braided together along the length of the brush wire tuft. Each one of the brush wire tufts is composed of between twenty-two and thirty-four elongate metal or metallic brush wires 140 or strands 157*a*, 157*b*, and/or 157*b* of brush wires 140 braided together along the length of the brush wire tuft. Each one of the brush wire tufts is composed of at least a plurality of pairs of wires 140 or strands 157*a*, 157*b* and/or 157*c* of wires 140 twisted and braided together along the length of the brush wire tuft. One of the hubs 228*a*, 228*b* has (a) a radially outermost set 236*b* of tuft mounting openings 238*b* spaced circumferentially about the hub, and (b) a radially innermost set 236*a* of tuft mounting openings 238*a* spaced circumferentially about the one of the hubs that are spaced radially inwardly of the radially outermost set 236*b* of tuft mounting openings 238*b* of the one of the hubs, and another one of the hubs has (c) a radially innermost set 236*a* of tuft mounting openings 238*a* spaced circumferentially about the hub, and (d) a radially outermost set 236*b* of tuft mounting openings 238*b* spaced circumferentially about the other one of the hubs that are spaced radially outwardly of the radially innermost set 236*a* of tuft mounting openings 238*a* of the other one of the hubs. The brush wire tufts extend radially outwardly from the radially outermost tuft mount openings have a working face disposed radially outwardly of the working face of the brush wire tufts extending radially outwardly from the radially innermost brush mounting openings. The radially outermost brush wire tuft mounting openings are circumferentially staggered between the radially innermost tuft mounting openings, and each one of the brush wire tufts extending outwardly from each one of the tuft mounting openings has the same length thereby disposing the working face of the brush wire tufts extending radially outwardly from the radially outermost brush mounting openings radially outwardly of the working face of the brush wire tufts extending radially outwardly from the radially innermost brush mounting openings. One of the hubs of the double-stringer rotary brush has (a) one of the hubs configured with radially outermost brush wire tuft mounting openings circumferentially staggered between the radially innermost tuft mounting openings, and each one of the brush wire tufts extending outwardly from each one of the tuft mounting openings has the same length thereby disposing the working face of the brush wire tufts extending radially outwardly from the radially outermost brush mounting openings radially outwardly of the working face of the brush wire tufts extending radially outwardly from the radially innermost brush mounting openings, and (b) the other one of the hubs configured with radially innermost brush wire tuft mounting openings circumferentially staggered between the radially outermost tuft mounting openings, and each one of the brush wire tufts extending outwardly from each one of the tuft mounting openings has the a different length thereby disposing the working face of the brush wire tufts extending radially outwardly from the radially outermost brush mounting openings radially inwardly of the working face of the brush wire tufts extending radially outwardly from the radially innermost brush mounting openings. The radially outermost brush wire tuft mounting openings are circumferentially staggered between the radially innermost brush wire tuft mounting openings, and each one of the radially innermost and radially outermost brush mounting openings is composed of a hole, wherein holes of the radially outermost brush wire tuft mounting openings are larger than the holes of the radially innermost brush wire tuft mounting openings. Each one of the brush wire tufts utilizes a knot that is a cable knot to attach each one of the brush wire tufts to a corresponding one of the hubs and brush wire tuft mounting holes of the one of the hubs. Each one of the brush wire tufts utilizes a knot that is a stringer bead knot to attach each one of the brush wire tufts to a corresponding one of the hubs and brush wire tuft mounting holes of the one of the hubs.

The present invention therefore also is directed to a double-stringer brush assembly 235 formed of a pair of center discs or center hubs 228*a*, 228*b* operatively coupled coaxially together in tandem for rotation in unison about a common axis of rotation 252 where one or both discs or hubs 228*a*, 228*b* is formed with circumferentially spaced apart brush wire tuft anchoring or mounting holes 238*a*, 238*b* that are alternating radially offset or radially staggered with elongate brush wire tufts 232*a*, 232*b* extending radially outwardly from each one of the openings 238*a*, 238*b* with alternating tufts 232*a*, 232*b* configured with different stiffnesses producing a double-stringer brush 225 possessing both aggressive material removal characteristics from the stiffer tufts 232*a* and good surface finishing characteristics from the more flexible tufts 232*b*. The alternating radially offset or radially staggered holes 238*a*, 238*b* formed in one and preferably both of the hubs 228*a*, 228*b* are arranged in a first set 236*a* of radially innermost holes 238*a* circumferentially spaced apart about the hub 228*a* or 228*b* a first radial distance from a center 254*a* or 254*b* of the hub 228*a* or 228*b* and a second set 236*b* of radially outermost holes 238*b* circumferentially spaced apart about the hub 228*a* or 228*b* a second radial distance from the center 254*a* or 254*b* of the hub 228*a* or 228*b* that is greater than the first radial distance.

The tufts 232*a*, 232*b* extending from the radially innermost and radially outermost sets 236*a*, 236*b* of holes 238*a*, 238*b* of at least one and preferably both of the hubs 228*a*, 228*b* have tuft lengths configured to provide an offset trim between adjacent tufts 232*a*, 232*b* of at least one of the hubs 228*a* or 228*b* and preferably both of the hubs 228*a*, 228*b* such that alternating tufts 232*a*, 232*b* extend radially outwardly different lengths beyond the corresponding hub 228*a* and/or 228*b* to which the tufts 232*a*, 232*b* are attached with the tufts 232*b* extending from one of the radially innermost or radially outermost sets 236*b* of holes 238*b* having an abrasive workpiece engaging face 240*b* at their respective free ends that extend radially outwardly of the workpiece engaging face 240*a* of the tufts 238*a* extending from the other one of the radially innermost or radially outermost sets 236*a* of holes 238*a*. In a preferred embodiment, the more flexible tufts 232*b* extend from one of the sets 236*b* of radially innermost or radially outermost holes 238*b* radially outwardly beyond the hub 228*a* and/or 228*b* to which the tufts 232*b* are attached a greater distance than the stiffer tufts 232*a* that extend from the other one of the sets 236*a* of radially innermost or radially outermost holes 238*a* such that a face 240*b* of one of the more flexible tufts 232*b* engages the workpiece first polishing the workpiece before the face 240*a* of an adjacent one of the stiffer tufts 232*a* engages the workpiece abrasively removing material therefrom. Because the more flexible tufts 232*b* flex more than the stiffer tufts 232*a* and extend farther radially outwardly from the hub 228*a* and/or 228*b* than the stiffer tufts 232*a*, flexure of the flexible tuft 232*b* from contact with its workpiece engaging face 240*b* with the workpiece enables the workpiece engaging face 240*a* of the stiffer tuft 232*a* following the more flexible tuft 232*b* to nearly simultaneously contact the workpiece substantially simultaneously polishing and abrading the workpiece as the brush 225 rotates during operation.

The radially outermost holes 238*b* of at least one and preferably both of the hubs 228*a* and/or 228*b* are each larger in size than the radially innermost holes 238*a* with each one of the radially outermost holes 238*b* having a width or diameter that is greater than a width or diameter of each one of the radially innermost holes 238*a*. In such a preferred brush embodiment, the more flexible tufts 232*b* are mounted in each one of the radially outermost holes 238*b* and the stiffer tufts 232*a* are mounted in the radially innermost holes 238*a* with the larger size of the radially outermost holes 238*b* helping the tufts 232*b* mounted thereto or therein to move along the larger hole 238*b* relative to the hub to which the tufts 232*b* are attached and flex more as a result during brush use and operation. The support provided by a pair of stiffer tufts 232*a* on either side of each flexible tuft 232*b* helps increase the life of the more flexible tufts 232*b* by preventing bending and fatigue cracking of wires and/or strands of wires of the flexible tufts 232*b* thereby advantageously increasing brush life.

Each one of the tufts 232*a*, 232*b* are mounted in a corresponding one of the radially innermost and radially outermost holes 238*a*, 238*b* of at least one and preferably both of the hubs 228*a* and/or 228*b* by knots 260*a*, 260*b* having a plurality of different knot sizes with a preferred embodiment of the brush assembly 235 using a larger knot 260*a* to mount tufts 232*a*, preferably the stiffer tufts 232*a*, in the radially innermost holes 238*a* and a smaller knot 260*b* to mount tufts 232*b*, preferably the more flexible tufts 232*b*, in the radially outermost holes 238*b*. The use of a larger knot 260*a* to attach tufts 232*a* to the radially innermost holes 238*a* increases the stiffness of the tufts 232*a* attached to the radially innermost holes 238*a* because of the greater surface area of knot engagement with the hub 228*a* and/or 228*b* thereby increasing the abrasive material removal aggressiveness of the stiffer tufts 232*a* mounted to the radially innermost holes 238*a*. The use of a smaller knot 260*b* to attach tufts 232*b* to the radially outermost holes 238*b* imparts greater flexibility to the tufts 232*b* mounted to the radially outermost holes 238*b* thereby reducing their aggressiveness of material removal and improving their ability to polish the workpiece during brush operation.

Each one of the brush wire tuft mounting hubs 228*a*, 228*b* of one double-stringer brush assembly, such as depicted in FIG. 26, can be and preferably is configured with alternating brush wire tufts 232*a*, 232*b* and have one of the hubs 228*a* angularly offset relative to the other one of the hubs 228*b* such that the tufts 232*a*, 232*b* of the one of the hubs 228*a* disposed adjacent corresponding tufts 232*a*, 232*b* or 232*b*, 232*a* of the other one of the hubs 228*b* have a different length. Each one of the brush wire tuft mounting hubs 228*a*, 228*b* of such a double-stringer brush assembly, such as depicted in FIG. 26, where adjacent brush wire tufts 232*a*, 232*b* of adjacent hubs 228*a*, 228*b* have different tuft lengths can be and preferably is configured with alternating brush wire tufts 232*a*, 232*b* and have one of the hubs 228*a* angularly offset relative to the other one of the hubs 228*b* such that the tufts 232*a*, 232*b* of the one of the hubs 228*a* disposed adjacent corresponding tufts 232*a*, 232*b* or 232*b*, 232*a* of the other one of the hubs 228*b* have an offset trim length, e.g., a different offset trim length. In other words, each one of the hubs 228*a*, 228*b* is configured with alternating tufts 232*a*, 232*b* and angularly offset relative to one another such that the tufts 232*a*, 232*b* of one of the hubs 228*a* disposed adjacent the tufts 232*a*, 232*b* or 232*b*, 232*a* of the other one of the hubs 228*b* have a different offset trim length such that at least a plurality of tufts 232*a* and/or 232*b* of the adjacent hubs 228*a*, 228*b* are configured with an offset trim.

In one embodiment, both hubs 228*a*, 228*b* can be angularly arranged with the radially innermost holes 238*a* of one of the hubs 228*a* generally coaxial with the radially innermost holes 238*a* of the other one of the hubs 228*b* and the radially outermost holes 238*b* of the one of the hubs 228*a* generally coaxial with the radially outermost holes 238*b* of the other one of the hubs 228*b* such that the stiffer tufts 232*a* of both hubs 228*a*, 228*b* are substantially angularly aligned and axially overlie or axially inline with one another and the more flexible tufts 232*b* of both hubs 228*a*, 228*b* are also substantially angularly aligned and axially overlie or axially inline with one another. In a preferred embodiment, one of the hubs 228*a* is angularly offset relative to the other one of the hubs 228*b*, such as depicted in FIG. 26, such that each one of the radially innermost holes 238*a* of the one of the hubs 228*a* is angularly offset, not coaxial with, and/or eccentric relative to a corresponding one of the radially innermost holes 238*a* of the other one of the hubs 228*b* and each one of the radially outermost holes 238*b* of the one of the hubs 228*a* is angularly offset, not coaxial with, and/or eccentric relative to a corresponding one of the radially outermost holes 238*b* of the other one of the hubs 228*b*. This results in the stiffer tufts 232*a* of the one of the hubs 228*a* being angularly offset and not axially inline relative to the stiffer tufts 232*a* of the other one of the hubs 228*b* and the more flexible tufts 232*b* of the one of the hubs 228*b* being angularly offset and not axially inline relative to the more flexible tufts 232*b* of the other one of the hubs 228*b*, such as is also depicted in FIG. 26. With continued reference to FIG. 26, in one such preferred embodiment, one of the hubs 228*a* is angularly offset by at least three degrees relative to the other one of the hubs 228*b* such that the radially innermost holes 238*a* and radially outermost holes 238*b* of both hubs 228*a*, 228*b* overlap but are not coaxial, the more flexible tufts 232*b* of one of the hubs 228*a* overlaps with but is not axially inline with corresponding more flexible tufts 232*b* of the other one of the hubs 228*b*, and the stiffer tufts 232*a* of the one of the hubs 228*a* overlaps with but is not axially inline with corresponding stiffer tufts 232*a* of the other one of the hubs 228*b*.

With continued reference to FIG. 26, in such a preferred embodiment, the hubs 228*a*, 228*b* of the double-stringer brush assembly 235 can be and preferably are configured with an angular offset of at least five degrees such that the radially innermost holes 238*a* of one of the hubs 228*a* overlap corresponding radially outermost holes 238*b* of the other one of the hubs 228*b*, the radially outermost holes 238*b* of the one of the hubs 228*a* overlap corresponding radially innermost holes 238*a* of the other one of the hubs 228*b*, the stiffer tufts 232*a* of the one of the hubs 228*a* overlap and can be axially inline with corresponding more flexible tufts 232*b* of the other one of the hubs 228*b*, and the more flexible tufts 232*b* of the one of the hubs 228*a* overlap and can be axially inline with corresponding stiffer tufts 232*a* of the other one of the hubs 228*b*. Such a double-stringer brush assembly 235 is therefore configured not only with adjacent pairs of tufts 232*a*, 232*b* of each one of the hubs 228*a*, 228*b* having an offset trim or offset trim length but also with each pair of adjacent tufts 232*a*, 232*b* and 232*b*, 232*a* of adjacent hubs 228*a*, 228*b* having an offset trim or offset trim length.

Such a double-stringer rotary radial brush assembly 235 of the present invention has two sets of tufts 232*a*, 232*b* side-by-side carried by side-by-side hubs 228*a*, 228*b* rotating in unison with the stiffer tufts 232*a* of both hubs 228*a*, 228*b* of the double-stringer brush 225 providing more aggressive material removal and the more flexible tufts 232*b* of both hubs 228*a*, 228*b* providing increased polishing producing an advantageous combination or blend of relatively high abrasive material removal rates and excellent surface finishing or polishing reducing or eliminating the need for subsequent surface finishing operations while advantageously increasing the life of the brush.

Understandably, the present invention has been described above in terms of one or more preferred embodiments and methods. It is recognized that various alternatives and modifications can be made to these embodiments and methods that are within the scope of the present invention. It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

The invention claimed is:

1. A rotary brush comprising:

a plurality of pairs of brush wire tufts, each brush wire tuft having a plurality of wires and a plurality of strands, with each of said strands having a plurality of pairs of twists formed by twisting one or more wires together substantially along an entire length of each strand;

a central hub with a plurality of pairs of brush wire tuft mounting openings spaced (i) radially from a central axis of rotation of the brush, and (ii) circumferentially apart from one another, the central disc or hub further comprising (a) a radially outermost group of brush wire tuft mounting openings spaced circumferentially about the hub, and (b) a radially innermost group of brush wire tuft mounting openings spaced circumferentially about the hub that is spaced radially inwardly of the radially outermost group of brush wire tuft mounting openings;

a brush wire tuft extending outwardly from each one of the brush mounting openings; and wherein the size of the brush wire tuft mounting openings of one of the radially innermost brush wire tuft mounting openings and radially outermost brush wire tuft mounting openings is larger than the brush mounting openings of the other one of radially innermost brush wire tuft mounting openings and radially outermost brush wire tuft mounting openings.

2. The rotary brush of claim 1, wherein the strands of each brush wire tuft are twisted into a cable knot brush wire tuft configuration.

3. The rotary brush of claim 1, wherein the brush wire tufts extending radially outwardly from one of the radially innermost brush wire tuft mounting openings and radially outermost brush wire tuft mounting openings extend farther radially outwardly than the brush wires extending radially outwardly from the other one of the radially innermost brush wire tuft mounting openings and radially outermost brush wire tuft mounting openings.

4. The rotary brush of claim 1, wherein each one of the brush wire tufts is arranged in a helical coil and forming a generally cylindrical wall of the brush wire tuft.

5. The rotary brush of claim 4, wherein each one of the brush wire tufts are configured for use in one of a rotary radial wheel brush, a rotary cup brush, and a rotary end brush.

6. The rotary brush of claim 1, wherein each one of the brush wire tufts is formed into a helical arrangement comprising a twisted interlocking helical arrangement, each one of the strands having a free end defining a workpiece-engaging tuft face that is substantially flat.

7. The rotary brush of claim 1, wherein each one of the strands has a free end defining a workpiece-engaging tuft face that is substantially flat.

8. The rotary brush of claim 7, wherein the substantially flat workpiece-engaging tuft face formed by the free ends of the strands that form each one of the brush wire tufts defines a plane of the workpiece-engaging face that is oriented at an acute angle relative to a longitudinal or lengthwise extent of the tuft.

9. The rotary brush of claim 7, wherein each one of the strands of each one of the brush wire tufts have a workpiece-engaging face acutely angled relative to a longitudinal or lengthwise extent of the strand.

10. The rotary brush of claim 7, wherein each one of wires of each one of the strands of each one of the brush wire tufts have a workpiece-engaging face acutely angled relative to a longitudinal or lengthwise extent of the strand producing free ends of each one of the wires of each one of the strands of each one of the brush wire tufts having a sharp edge that more aggressively remove workpiece material during rotary brush operation.

11. The rotary brush of claim 7, wherein each one of the brush wire tufts is formed of a plurality of pairs of the strands that each are comprised of a plurality of pairs of the wires whose ends define a generally planar workpiece-engaging face, and wherein the wires of each one of the strands are twisted together substantially along their length, and the strands of each one of the brush wire tufts twisted together substantially along their length.

12. The rotary brush of claim 7, wherein each one of the brush wire tufts is formed of a plurality of pairs of the strands arranged in a plurality of pairs of rows of the strands with each one of the strands comprised of four wires whose free ends define a generally planar workpiece-engaging face of the strand, with the workpiece-engaging faces of the strands defining a generally planar workpiece-engaging face of the brush wire tuft, and wherein the wires of each one of the strands are twisted together substantially along their length, and the strands of each one of the brush wire tufts twisted together substantially along their length.

13. The rotary brush of claim 1, wherein each one of the brush wire tufts is comprised of at least a plurality of pairs of the strands twisted together substantially along the entire length of the brush wire tuft, each one of the strands formed of at least a plurality of pairs of elongate wires having a plurality of different diameters twisted and braided together substantially along the length of the strand, each one of the wires of each one of the strands having a free end defining a sharp-edged workpiece-engaging wire face with the workpiece-engaging wire faces defining a workpiece-engaging face of each one of the strands where the workpiece-engaging wire faces are not coplanar.

14. The rotary brush of claim 1, wherein each one of the brush wire tufts is comprised of a plurality of pairs of the strands twisted together substantially along the entire length of the brush wire tuft and having free ends forming a workpiece-engaging face of the brush wire tuft comprised of a plurality of pairs of rows and columns of the strands, each one of the strands formed of a plurality of pairs of wires having a plurality of pairs of different diameters twisted and braided together substantially along the length of the strand, each one of the wires of each one of the strands having a free end defining a sharp-edged workpiece-engaging wire face with the workpiece-engaging wire faces defining a workpiece-engaging face of each one of the strands where the workpiece-engaging wire faces are not coplanar.

15. The rotary brush of claim 14, wherein the strands that form each one of the brush wire tufts form a generally rectangular workpiece-engaging face of the brush wire tuft.

16. A rotary brush comprising:

a plurality of pairs of brush wire tufts, each brush wire tuft having having a plurality of wires and a plurality of strands, with each of said strands having a plurality of pairs of wires braided substantially along an entire length of each strand;

a central hub with a plurality of pairs of brush wire tuft mounting openings spaced (i) radially from a central axis of rotation of the brush, and (ii) circumferentially apart from one another, the central disc or hub further comprising (a) a radially outermost group of brush wire tuft mounting openings spaced circumferentially about the hub, and (b) a radially innermost group of brush wire tuft mounting openings spaced circumferentially about the hub that is spaced radially inwardly of the radially outermost group of brush wire tuft mounting openings;

a brush wire tuft extending outwardly from each one of the brush mounting openings; and wherein the size of the brush wire tuft mounting openings of one of the radially innermost brush wire tuft mounting openings and radially outermost brush wire tuft mounting openings is larger than the brush mounting openings of the other one of radially innermost brush wire tuft mounting openings and radially outermost brush wire tuft mounting openings.

17. The rotary brush of claim 16, wherein the brush wire tufts extending radially outwardly from one of the radially innermost brush wire tuft mounting openings and radially outermost brush wire tuft mounting openings extend farther radially outwardly than the brush wires extending radially outwardly from the other one of the radially innermost brush wire tuft mounting openings and radially outermost brush wire tuft mounting openings.

18. The rotary brush of claim 16, wherein each brush wire tuft is comprised of a plurality of strands twisted together with adjacent strands arranged in an overlapping helical configuration or an overlapping braided helical configuration.

19. The rotary brush of claim 18, wherein each brush wire tuft is generally cylindrical and hollow with a brush wire tuft sidewall formed by the overlapping helical or overlapping braided helical strands.

20. A rotary brush comprising:

a plurality of pairs of brush wire tufts, each brush wire tuft having a plurality of wires and a plurality of strands;

wherein each one of said strands is formed into a pair of helical wires having a helical pitch; and wherein at least one helical wire has a first diameter and a first pitch, at least one helical wire has a second diameter smaller than the first diameter and a second pitch greater than the first pitch, and at least one helical wire has a third diameter smaller than the first diameter and second diameter and a third pitch greater than the first pitch and second pitch.

21. A rotary brush comprising:

a plurality of pairs of brush wire tufts, each brush wire tuft having having a plurality of wires and a plurality of strands, with each of said strands having a plurality of pairs of wires braided substantially along an entire length of each strand;

wherein each one of the brush wire tufts is tubular and comprised of a plurality of strands composed of a plurality of wires arranged in a closed helix with the strands of each one of the brush wire tufts forming a generally tubular wall of the brush wire tuft;

a central hub with a plurality of pairs of brush wire tuft mounting openings spaced (i) radially from a central axis of rotation of the brush, and (ii) circumferentially apart from one another, the central disc or hub further comprising (a) a radially outermost group of brush wire tuft mounting openings spaced circumferentially about the hub, and (b) a radially innermost group of brush wire tuft mounting openings spaced circumferentially about the hub that is spaced radially inwardly of the radially outermost group of brush wire tuft mounting openings;

a brush wire tuft extending outwardly from each one of the brush mounting openings; and wherein the size of the brush wire tuft mounting openings of one of the radially innermost brush wire tuft mounting openings and radially outermost brush wire tuft mounting openings is larger than the brush mounting openings of the other one of radially innermost brush wire tuft mounting openings and radially outermost brush wire tuft mounting openings.

* * * * *